US006554542B2

(12) United States Patent
Mano et al.

(10) Patent No.: US 6,554,542 B2
(45) Date of Patent: Apr. 29, 2003

(54) STRESS TRANSMISSION DEVICE, AND STRUCTURE AND METHOD OF CONSTRUCTING THE SAME

(75) Inventors: Hideyuki Mano, Tokyo (JP); Takashi Tazoh, Tokyo (JP); Akira Ohtsuki, Tokyo (JP); Takashi Aoki, Tokyo (JP); Kazuhiko Isoda, Tokyo (JP); Toshiyuki Iwamoto, Amagasaki (JP); Noriyuki Arakawa, Amagasaki (JP); Takahiro Ishihara, Amagasaki (JP); Masayuki Ohkawa, Amagasaki (JP)

(73) Assignees: Shimizu Construction Co., Ltd., Tokyo (JP); Kubota Corporation, Osaka (JP)

( * ) Notice: Subject to any disclaimer, the term of this patent is extended or adjusted under 35 U.S.C. 154(b) by 0 days.

(21) Appl. No.: 09/813,367

(22) Filed: Mar. 20, 2001

(65) Prior Publication Data

US 2001/0046416 A1 Nov. 29, 2001

(30) Foreign Application Priority Data

| | | |
|---|---|---|
| Apr. 10, 2000 | (JP) | 2000-108477 |
| Jun. 7, 2000 | (JP) | 2000-169841 |
| Aug. 24, 2000 | (JP) | 2000-254521 |
| Aug. 30, 2000 | (JP) | 2000-261948 |
| Sep. 4, 2000 | (JP) | 2000-267764 |

(51) Int. Cl.[7] ..... E04B 1/98; E02D 31/08
(52) U.S. Cl. ..... 405/251; 52/167.6
(58) Field of Search ..... 405/229, 231, 405/251, 255; 52/167.1–167.9

(56) References Cited

U.S. PATENT DOCUMENTS

| | | | | | |
|---|---|---|---|---|---|
| 2,014,643 | A | * | 9/1935 | Bakker | 52/167.5 |
| 3,105,252 | A | * | 10/1963 | Milk | 52/167.4 |
| 4,121,393 | A | * | 10/1978 | Renault et al. | 52/167.7 |
| 4,320,549 | A | * | 3/1982 | Greb | 52/167.9 |
| 4,644,714 | A | * | 2/1987 | Zayas | 52/167.4 |
| 5,014,474 | A | * | 5/1991 | Fyfe et al. | 52/167.8 |
| 5,452,548 | A | * | 9/1995 | Kwon | 52/167.8 |
| 5,765,322 | A | * | 6/1998 | Kubo et al. | 52/167.8 |
| 6,102,627 | A | * | 8/2000 | Ueda et al. | 405/229 |
| 6,230,450 | B1 | * | 5/2001 | Kuroda et al. | 52/167.8 |

FOREIGN PATENT DOCUMENTS

| | | |
|---|---|---|
| JP | 1284613 | 11/1989 |
| JP | 8120687 | 5/1996 |
| JP | 10227039 | 8/1998 |
| JP | 10227040 | 8/1998 |

* cited by examiner

*Primary Examiner*—Thomas B. Will
*Assistant Examiner*—Tara L. Mayo
(74) *Attorney, Agent, or Firm*—Kolisch Hartwell, P.C.

(57) ABSTRACT

A stress transmission device arranged between a pile head of a foundation pile and an upper structural portion for transmitting stress between the foundation pile and the upper structural portion, to a structure which employs such a stress transmission device, and to a method of constructing such a structure. In the figures, a pile head member 5 is provided to the pile head 2*a* of the foundation pile 2, a structure support member 6 is fixed to an upper structural portion 3, and these mutually contact one another in the vertical direction via a first contacting surface 11 which defines a portion of a first imaginary spherical surface Sv1. And a prestressing steel rod 7 is fitted to the pile head member 5 and the structure support member 6 for holding them together in contact while pressing them together via the first contacting surface 11.

10 Claims, 35 Drawing Sheets

STRESS TRANSMISSION DEVICE, AND STRUCTURE AND METHOD OF CONSTRUCTING THE SAME

BACKGROUND OF THE INVENTION

1. Field of the Invention

The present invention relates to a stress transmission device which is provided between a pile head of a foundation pile and an upper construction portion for transmitting stress between the upper construction portion and the foundation pile, and to a structural element using the same and to a method of construction thereof.

The present application is based upon Japanese Patent Applications Serial Nos. 2000-108477, 2000-169841, 2000-254521, 2000-261948, and 2000-267764, and the contents of said applications are hereby incorporated into the present application by reference.

2. Description of the Related Art

In the prior art, when constructing a building, it is generally performed to support an upper structural portion upon a pile which is emplaced in a supporting ground slab, and moreover to support the entire upper structural portion in this manner.

Although in the prior art the pile head has been rigidly linked to the upper structural portion, in this case if, during an earthquake, a horizontal force is received upon the pile head, there is a fear that the pile head will be destroyed, and in order to prevent this it has become necessary to strengthen the pile head portion by increasing its diameter or the like.

In this connection, in order to reduce the stress which acts upon the pile head, a pin connecting construction has been proposed which connects the pile head to the upper structural portion in a manner to allow relative rotation therebetween, thus being made so as to release the stress upon the pile head; and also a roller connection construction has been proposed which allows sliding movement of the pile head with respect to the building, thus releasing the stress upon the pile head (for example, see Japanese Patent Application Laying-Open Publications Serial Nos. Heisei 1-284613, Heisei 8-120687, Heisei 10-227039, and 10-227040).

However, with a construction such as described above, so as to generate the desirable relative displacement between the pile head and the upper structural portion, it is necessary to reduce the amount of friction between the pile head and the upper structural portion. For this, in order to make the contacting surfaces between the pile head and the upper structural portion smooth, it is necessary to employ a resin process or a mechanical process or the like, and this entails an increase in cost.

Furthermore, with a construction such as described above, when attempting to permit relative displacement between the pile head and the upper structural portion, according to circumstances, there may be a danger of not being able reliably to perform transmission of shearing force.

Moreover, with a construction such as described above, although force may well act in the direction to separate the pile head and the upper structural portion, in the prior art, while allowing relative displacement between the pile head and the upper structural portion, it has not been considered to prevent these from coming apart in the upward direction.

Yet further, since with a construction such as described above the frictional force between the mutually superimposed surfaces has an important effect, it has been necessary to ensure that this frictional force between these surfaces should not vary due to concrete which is poured during constructing flowing in between these surfaces, or due to the generation of corrosion because of invasion of ground water after construction, or due to the invasion of earth or sand or the like.

Still yet further, in order to provide a construction such as described above, after the pile head has been formed, it has been necessary to wait for the concrete which has been poured for the pile head to harden, and to perform processing upon the pile head, and thereafter the process of providing the above described construction has been necessary, which has all necessitated using a time period greater than prescribed.

SUMMARY OF THE INVENTION

The present invention has been conceived as a result of consideration of this type of problem, and has as its objective to propose a stress transmission device, and a structure which employs it, which, without any accompanying elevation of cost, while preventing the transmission of bending moment between the pile head and the upper structural portion, also in this case can satisfactorily cope with shearing force or pulling force or the like acting between the pile head and the upper structural portion.

Further, another objective of the present invention is to propose a stress transmission device, and a structure which employs it, which reliably prevent the entry of foreign objects or matter between the contacting surfaces, so as reliably to realize their function.

Further, another objective of the present invention is to propose a structure and a method of constructing the same, in which the above described stress transmission device can reliably be set up in a short time period, and which thereby make it possible to shorten the period of construction.

In order to attain the above described objectives, the present invention utilizes the following means.

A first aspect of the present invention is a stress transmission device, comprising a pile head member which is set upon a pile head of a foundation pile, and a structure support member which is fixed to an upper structural portion and is arranged to face said pile head member, and said pile head member and said structure support member mutually contact one another in the vertical direction via a first contacting surface which defines a portion of a first imaginary spherical surface, and a tension member is fitted to said pile head member and said structure support member for holding them together in contact while pressing them together via said first contacting surface.

According to the above described structure, it is possible to prevent the structure support member from rising up from the pile head member, provided that the pulling force which acts between the pile head member and the structure support member is less than the pushing force of the tension member.

According to another aspect of the present invention, one of said pile head member and said structure support member is provided with a spherical seat and a concave surface is formed upon the other, and said first contacting surface is constituted by mutually contacting together the outer surface of said spherical seat and said concave surface, and the outer surface of said spherical seat is formed so as to define the same surface as said first imaginary spherical surface, and a through hole is formed in said concave surface for passing through said tension member, and an aperture portion is formed in a position of said spherical seat which opposes said through hole, and, along with said tension member being arranged so as to pass through said through hole and said aperture portion, both its ends are respectively engaged to said pile head member and said structure support member by engagement members.

According to the above described structure, it is possible to press the pile head member and the structure support member together via the first contacting surface.

According to another aspect of the present invention, said tension member is arranged so that its central axis lies along the vertical axis which passes through the center of curvature of said spherical seat.

According to the above described structure, it is ensured that the component of the pushing force between the spherical seat and the concave surface which is perpendicular to the first contacting surface does not become excessive in the vicinity of the outer edge portion of the spherical seat.

According to another aspect of the present invention, one of said engagement members which are provided at both the ends of said tension member contacts said pile head member or said structure support member via a second contacting surface which defines a portion of a second imaginary spherical surface, and the centers of curvature of said first and said second imaginary spherical surfaces coincide.

According to the above described structure, when the pile head member and the structure support member undergo mutual relative displacement along the first imaginary spherical surface, it is possible for the tension member to be displaced relative to the pile head member and the structure support member in the same direction.

According to another aspect of the present invention, the diameter of a one of said through hole and said aperture portion at said first contact surface is greater than that of the other; and the radial dimensions of said through hole and said aperture portion are determined so that, when said pile head member and said structure support member are relatively displaced through the maximum rotational angle which is anticipated to take place between said foundation pile and said upper structural portion, at said first contacting surface, said other of said through hole and said aperture portion is positioned in the interior of said one.

According to the above described structure, no change of the surface area of the first contacting surface takes place, even when the through hole and the aperture portion undergo mutual relative displacement.

According to another aspect of the present invention, the radial dimensions of said through hole and said aperture portion are determined so that their inner circumferential surfaces are positioned outside the range in which said tension member is positioned, when said pile head member and said structure support member are relatively displaced through the maximum rotational angle which is anticipated to take place between said foundation pile and said upper structural portion.

According to the above described structure, it is ensured that no contact occurs between the tension member and the inside circumferential surfaces of the through hole and of the aperture portion.

Another aspect of the present invention is a structure, comprising a foundation pile, an upper structural portion which is supported by said foundation pile, and, between said foundation pile and said upper structural portion, a stress transmission device for transmitting stress therebetween, comprising a pile head member which is set upon a pile head of said foundation pile, and a structure support member which is fixed to said upper structural portion and is arranged to face said pile head member; wherein said pile head member and said structure support member mutually contact one another in the vertical direction via a first contacting surface which defines a portion of a first imaginary spherical surface; and a tension member is fitted to said pile head member and said structure support member for holding them together in contact while pressing them together via said first contacting surface.

According to another aspect of the present invention, one of said pile head member and said structure support member is provided with a spherical seat and a concave surface is formed upon the other, and said first contacting surface is constituted by mutually contacting together the outer surface of said spherical seat and said concave surface; the outer surface of said spherical seat is formed so as to define the same surface as said first imaginary spherical surface; a through hole is formed in said concave surface for passing through said tension member, and an aperture portion is formed in a position of said spherical seat which opposes said through hole; and along with said tension member being arranged so as to pass through said through hole and said aperture portion, both its ends are respectively engaged to said pile head member and said structure support member by engagement members.

According to another aspect of the present invention, said tension member is arranged so that its central axis lies along the vertical axis which passes through the center of curvature of said spherical seat.

According to another aspect of the present invention, one of said engagement members which are provided at both the ends of said tension member contacts said pile head member or said structure support member via a second contacting surface which defines a portion of a second imaginary spherical surface, and the centers of curvature of said first and said second imaginary spherical surfaces coincide.

According to another aspect of the present invention, the diameter of a one of said through hole and said aperture portion at said first contact surface is greater than that of the other; and the radial dimensions of said through hole and said aperture portion are determined so that, when said pile head member and said structure support member are relatively displaced through the maximum rotational angle which is anticipated to take place between said foundation pile and said upper structural portion, at said first contacting surface, said other of said through hole and said aperture portion is positioned in the interior of said one.

According to another aspect of the present invention, the radial dimensions of said through hole and said aperture portion are determined so that their inner circumferential surfaces are positioned outside the range in which said tension member is positioned, when said pile head member and said structure support member are relatively displaced through the maximum rotational angle which is anticipated to take place between said foundation pile and said upper structural portion.

Another aspect of the present invention is a stress transmission device, comprising a pile head member which is set upon a pile head of a foundation pile, and a structure support member which is fixed to an upper structural portion which is supported by said foundation pile, and is arranged to face said pile head member; wherein: said pile head member and said structure support member mutually contact one another in the vertical direction via a contacting surface which defines a portion of an imaginary spherical surface; and said contacting surface is formed in an annular shape whose central axis is the vertical axis through the center of curvature of said imaginary spherical surface.

If the above described structure is employed, it is possible to reduce the component in the normal direction of the contacting surface of the axial force which acts upon the pile head member from the structure support member, as compared to the case in which they contact over a predetermined range in the vicinity of the vertical axis of the imaginary spherical surface as a contacting surface between the pile head member and the structure support member. Further, it is likewise possible to reduce the component which tends to generate horizontal slippage of the horizontal force which acts between the pile head member and the structure support member.

According to another aspect of the present invention, said contacting surface is constituted as the contact surface between a convex surface which is formed upon one of said pile head member and said structure support member and a concave surface which is formed upon the other; and at least a one of said convex surface and said concave surface is formed from an outer ring portion and a central portion whose central axis is said vertical axis, and said outer ring portion constitutes a surface the same as said imaginary spherical surface, while said central portion is shaped as concave, taking said imaginary spherical surface as a reference.

According to the above described structure, the central portion of one of the convex surface and the concave surface does not contact the other, and only its outer ring portion comes to be in contact with the other.

According to another aspect of the present invention, said central portion is formed as an aperture portion in said convex surface or in said concave surface.

By this type of structure, the central portion can easily be formed in a concave shape.

According to another aspect of the present invention, said central portion is a horizontal surface which is formed upon said convex surface.

According to this type of structure, it is possible to form the central portion in a concave shape, taking the imaginary spherical surface as a reference, by a simple process.

According to another aspect of the present invention, the outer circumferential edge portion of said convex surface is formed as a curved surface whose radius of curvature in a vertical cross section is smaller than that of said imaginary spherical surface.

According to this type of structure, it is possible to reduce the friction at the outer circumferential portion of the concave surface, and this portion is prevented from becoming a support point when relative rotational displacement takes place between said convex surface and said concave surface.

Another aspect of the present invention is a structure, comprising a foundation pile, an upper structural portion which is supported by said foundation pile, and, between said foundation pile and said upper structural portion, a stress transmission device for transmitting stress therebetween, comprising a pile head member which is set upon a pile head of said foundation pile, and a structure support member which is fixed to said upper structural portion and is arranged to face said pile head member; wherein said pile head member and said structure support member mutually contact one another in the vertical direction via a contacting surface which defines a portion of an imaginary spherical surface; and said contacting surface is formed in an annular shape whose central axis is the vertical axis through the center of curvature of said imaginary spherical surface.

According to another aspect of the present invention, said contacting surface is constituted as the contact surface between a convex surface which is formed upon one of said pile head member and said structure support member and a concave surface which is formed upon the other; and at least a one of said convex surface and said concave surface is formed from an outer ring portion and a central portion whose central axis is said vertical axis, and said outer ring portion constitutes a surface the same as said imaginary spherical surface, while said central portion is shaped as concave, taking said imaginary spherical surface as a reference.

According to another aspect of the present invention, said central portion is formed as an aperture portion in said convex surface or in said concave surface.

According to another aspect of the present invention, said central portion is a horizontal surface which is formed upon said convex surface.

According to another aspect of the present invention, the outer circumferential edge portion of said convex surface is formed as a curved surface whose radius of curvature in a vertical cross section is smaller than that of said imaginary spherical surface.

Another aspect of the present invention is a stress transmission device, comprising a pile head member which is set upon a pile head of a foundation pile, a structure support member which is fixed to an upper structural portion and is arranged to face said pile head member, and a pulling out resistant member which is fixed with respect to one or the other of said foundation pile and said upper structural portion and is arranged so as to project towards the other; wherein said pile head member and said structure support member mutually contact one another in the vertical direction via a first contacting surface which defines a portion of a first imaginary spherical surface; said pulling out resistant member is made so as to be stopped with respect to at least one of said pile head member and said structure support member, when said upper structural portion is displaced in the direction to separate it from said foundation pile; said pulling out resistant member, when it is stopped with respect to said pile head member or said structure support member, contacts said pile head member or said structure support member via a second contacting surface which defines a portion of a second imaginary spherical surface, and the centers of curvature of said first and said second imaginary spherical surfaces coincide.

If this type of structure is utilized, it is possible satisfactorily to rotationally displace the upper structural portion with respect to the foundation pile, since relative displacement between the pile head member and the structure support member can take place along the first imaginary spherical surface. Further, it is possible to stop the upper structural portion from coming up away from the foundation pile, due to the provision of the pulling out resistant member. Yet further, in this case, since the pulling out resistant member can be relatively displaced with respect to one or the other of the pile head member and the structure support member along the second imaginary spherical surface, therefore the pulling out resistant member offers no impediment to the mutual rotational displacement of the upper structural portion and the foundation pile.

According to another aspect of the present invention, said first contacting surface is formed in an annular shape whose central axis is the vertical axis through the center of curvature of said first imaginary spherical surface.

According to this type of structure, by comparison to the case in which the pile head member and the structure support member contact one another over a predetermined range in the vicinity of the vertical axis of the first imaginary spherical surface as the first contacting surface, it is possible to reduce the component in the normal direction of the contacting surface of the axial force which acts upon the pile head member from the structure support member, and by doing this it is likewise possible to reduce the frictional resistance at the first contacting surface. Further, it is also possible to reduce the component which tends to generate horizontal slippage of the horizontal force which acts between the pile head member and the structure support member.

According to another aspect of the present invention, a spherical seat whose interior is empty is provided to said pile head member and a concave surface is formed upon said structure support member, and said first contacting surface is defined by the mutual contact of an outer surface of said spherical seat and said concave surface; along with the outer surface of said spherical seat being formed so as to define a surface which is the same as said first imaginary spherical surface, its inner surface is formed so as to define a surface which is the same as said second imaginary spherical surface, and moreover said spherical seat comprises an aperture portion which is pierced through its said outer surface and its said inner surface; said pulling out resistant member comprises a rod shaped main portion which is fixet to said upper structural portion and a head portion provided at an end of said main portion whose radial dimension is greater than that of said aperture portion, and said main portion is passed through said aperture portion, while said head portion is arranged so as to be in a state confronting said inner surface of said spherical seat; and said second contacting surface is defined by the mutual contact between said head portion and said inner surface of said spherical seat.

According to this kind of structure, it is possible for the structure support member and the pulling out resistant member to contact the pile head member upon imaginary spherical surfaces which have the same center of curvature.

According to another aspect of the present invention, the central portion of said concave surface is shaped as concave, taking said first contacting surface as a reference.

According to this type of structure, the central portion of the concave surface does not contact the spherical seat, and only the outer edge portion on the outside of said central portion contacts said spherical seat.

According to another aspect of the present invention, a through hole is formed in the central portion of said concave surface for passing through said pulling out resistant member, and said aperture portion is formed in a position to face said through hole.

According to this type of structure, the pulling out resistant member is passed through the through hole in its state in which it is directly fixed to the upper structural portion, and, along with projecting towards the foundation pile from the central portion of the concave surface, its head portion can be put into the interior portion of the spherical seat.

According to another aspect of the present invention, the magnitude of the radial dimension of said aperture portion is determined so that said main portion of said pulling out resistant member and the inner surface of said aperture portion do not contact one another, when said pulling out resistant member is displaced through the maximum rotational angle which is anticipated to take place between said foundation pile and said upper structural portion.

According to such a structure, no impediment is offered to relative displacement between the pile head member and the structure support member by contact of the pulling out resistant member against the inner surface of the aperture portion.

According to another aspect of the present invention, concavities and convexities are provided upon said main portion of said pulling out resistant member for ensuring force for fixing said pulling out resistant member into concrete from which said upper structural portion is made.

According to this structure, it is possible to fix the pulling out resistant member very strongly to the upper structural portion.

According to another aspect of the present invention, upon said main portion of said pulling out resistant member, at a portion which is fixed to said upper structural portion, a radially enlarged portion is formed whose radial dimension is greater as compared to other portions of said main portion.

According to such a structure, it is possible to fix the pulling out resistant member very strongly to the upper structural portion.

According to another aspect of the present invention, said pulling out resistant member is made so that its said head portion and its said main portion can be separated from one another.

According to such a structure, it is possible to utilize different materials for the head portion and for the main portion of the pulling out resistant member.

Another aspect of the present invention is a structure, comprising a foundation pile, an upper structural portion which is supported by said foundation pile, and, between said foundation pile and said upper structural portion, a stress transmission device for transmitting stress therebetween, comprising a pile head member which is set upon a pile head of a foundation pile, a structure support member which is fixed to said upper structural portion and is arranged to face said pile head member, and a pulling out resistant member which is fixed with respect to one or the other of said foundation pile and said upper structural portion and is arranged so as to project towards the other; wherein said pile head member and said structure support member mutually contact one another in the vertical direction via a first contacting surface which defines a portion of a first imaginary spherical surface; said pulling out resistant member is made so as to be stopped with respect to at least one of said pile head member and said structure support member, when said upper structural portion is displaced in the direction to separate it from said foundation pile; said pulling out resistant member, when it is stopped with respect to said pile head member or said structure support member, contacts said pile head member or said structure support member via a second contacting surface which defines a portion of a second imaginary spherical surface, and the centers of curvature of said first and said second imaginary spherical surfaces coincide.

According to another aspect of the present invention, said first contacting surface is formed in an annular shape whose central axis is the vertical axis which passes through the center of curvature of said first imaginary spherical surface.

According to another aspect of the present invention, a spherical seat whose interior is empty is provided to said pile head member and a concave surface is formed upon said structure support member, and said first contacting surface is defined by the mutual contact of an outer surface of said spherical seat and said concave surface; along with the outer surface of said spherical seat being formed so as to define a surface which is the same as said first imaginary spherical surface, its inner surface is formed so as to define a surface which is the same as said second imaginary spherical surface, and moreover said spherical seat comprises an aperture portion which is pierced through its said outer surface and its said inner surface; said pulling out resistant member comprises a rod shaped main portion which is fixed to said upper structural portion and a head portion provided at an end of said main portion whose radial dimension is greater than that of said aperture portion, and said main portion is passed through said aperture portion, while said head portion is arranged so as to be in a state confronting said inner surface of said spherical seat; and said second contacting surface is defined by the mutual contact between said head portion and said inner surface of said spherical seat.

According to another aspect of the present invention, said pulling out resistant member is arranged so that its head portion is separated from the inner surface of said spherical seat, when the axial force which acts upon said stress transmission device is a compression force.

According to such a construction, if a pulling upward force does not act upon the upper structural portion, no frictional force is generated between the pulling out resistant member and the spherical seat.

According to another aspect of the present invention, the central portion of said concave surface is shaped as concave, taking said first contacting surface as a reference.

According to another aspect of the present invention, a through hole is formed in the central portion of said concave surface for passing through said pulling out resistant member, and said aperture portion is formed in a position to face said through hole.

According to another aspect of the present invention, the magnitude of the radial dimension of said aperture portion is determined so that said main portion of said pulling out resistant member and the inner surface of said aperture portion do not contact one another, when said pulling out resistant member is displaced through the maximum rotational angle which is anticipated to take place between said foundation pile and said upper structural portion.

According to another aspect of the present invention, concavities and convexities are provided upon said main portion of said pulling out resistant member for ensuring force for fixing said pulling out resistant member into concrete from which said upper structural portion is made.

According to another aspect of the present invention, upon said main portion of said pulling out resistant member, at a portion which is fixed to said upper structural portion, a radially enlarged portion is formed whose radial dimension is greater as compared to other portions of said main portion.

According to another aspect of the present invention, said pulling out resistant member is made so that its said head portion and its said main portion can be separated from one another.

Another aspect of the present invention is a stress transmission device, comprising, upon a pile head member which is provided to a pile head of a foundation pile, a structure support member, which is fixed to an upper structural portion and is superimposed upon a spherical surface of said pile head member, and which has a spherical surface which conforms to said spherical surface of said pile head member; and, between said superimposed spherical surfaces, a seal which seals said spherical surfaces from the outside is inserted.

Thus, according to this aspect of the present invention, the superimposed and contacting spherical surfaces are protected from the outside by the seal, and the invasion of concrete which is being poured, or of ground water, earth, or sand, is prevented.

According to another aspect of the present invention, a seal is provided between the outer surfaces of said superimposed pile head member and structure support member.

Accordingly the spherical surfaces are protected by this seal member at the outer circumferential edges of the pile head member and the structure support member, so that, in particular during transportation or during construction or the like, the invasion of foreign matter between the contacting spherical surfaces is effectively prevented.

Another aspect of the present invention is a structure, comprising a foundation pile, an upper structural portion which is supported by said foundation pile, and, between said foundation pile and said upper structural portion, a stress transmission device for transmitting stress therebetween, wherein said foundation pile is a cast-in-place concrete pile, and in the interior of an iron bar cage which is comprised in said foundation pile, an iron bar cage for anchoring of tubular shape whose diameter is smaller than that of said iron bar cage is disposed in the state of being embedded in the concrete from which said foundation pile is made; and said iron bar cage for anchoring comprises a plurality of anchoring reinforcement members which are arranged vertically, with the upper end portions of these anchoring reinforcement members being arranged in a state so as to project upwards higher than said pile head, and moreover a lower portion of said stress transmission device is fixed to said upper end portions, and also said iron bar cage for anchoring is connected to said iron bar cage via a position maintenance member.

According to this type of structure, when making the pile, it is possible to embed the iron bar cage for anchoring in the pile at the same time as pouring the concrete, and thereby it is possible to perform the pouring of the concrete for the pile and the emplacement of the anchoring arrangements at the same time.

According to another aspect of the present invention, said iron bar cage for anchoring is formed by mutually connecting together said anchoring reinforcement members by annular shaped ring members which are disposed to extend in the circumferential direction of said iron bar cage for anchoring, and a plurality of said position maintenance members of the same shape are provided between said iron bar cage and said ring members, and these position maintenance members are disposed so as to extend from the outer peripheral surfaces of said ring members in the radially outward directions of said ring members.

According to this type of structure, it is possible to ensure that the iron bar cage for anchoring is centralized in the iron bar cage by using these position maintenance members.

According to another aspect of the present invention, anchoring iron bars for fixing said upper structural portion are embedded in said upper structural portion, and lower end portions of said anchoring iron bars for fixing said upper structural portion are arranged so as to project in the downwards direction from the lower surface of said upper structural portion, with an upper portion of said stress transmission device being fixed to said lower end portions.

By doing this, it is possible to fix the stress transmission device to the upper structural portion very strongly.

Another aspect of the present invention is a method of constructing a structure which comprises a foundation pile and an upper structural portion which is supported by said foundation pile, comprising: digging a hole in a ground slab for embedding said pile; arranging an iron bar cage in said dug out hole; arranging a tubular shaped iron bar cage for anchoring which has been made to be of a smaller diameter than said iron bar cage, in the interior of said iron bar cage, and positioning it so that at least its upper end portion protrudes out above said dug out hole; connecting said iron bar cage for anchoring to said iron bar cage and fixing the position of said iron bar cage for anchoring within said iron bar cage; pouring concrete into said dug out hole; and thereafter fixing a lower portion of a stress transmission device to said upper end portion of said iron bar cage for anchoring, and fixing an upper portion of said stress transmission device to said upper structural portion.

According to another aspect of the present invention, said iron bar cage for anchoring is made by connecting, around an annular shaped ring member, a plurality of anchoring reinforcement members so that they extend parallel to the central axis of said ring member; by, when fixing said iron bar cage for anchoring inside said iron bar cage, providing a plurality of position maintenance members which are of the same shape to the outer circumferential surface of said ring member, so that they extend from said outer circumferential surface of said ring member in the radially outward direction of said ring member; and by arranging said iron bar cage for anchoring in this state into the inside of said iron bar cage, and fixing the other end portions of said position maintenance members remote from said ring member to said iron bar cage.

DETAILED DESCRIPTION OF THE PREFERRED EMBODIMENTS

Next, a number of preferred embodiments of the present invention will be explained in detail with reference to the figures.

The First Preferred Embodiment

Figure 4:
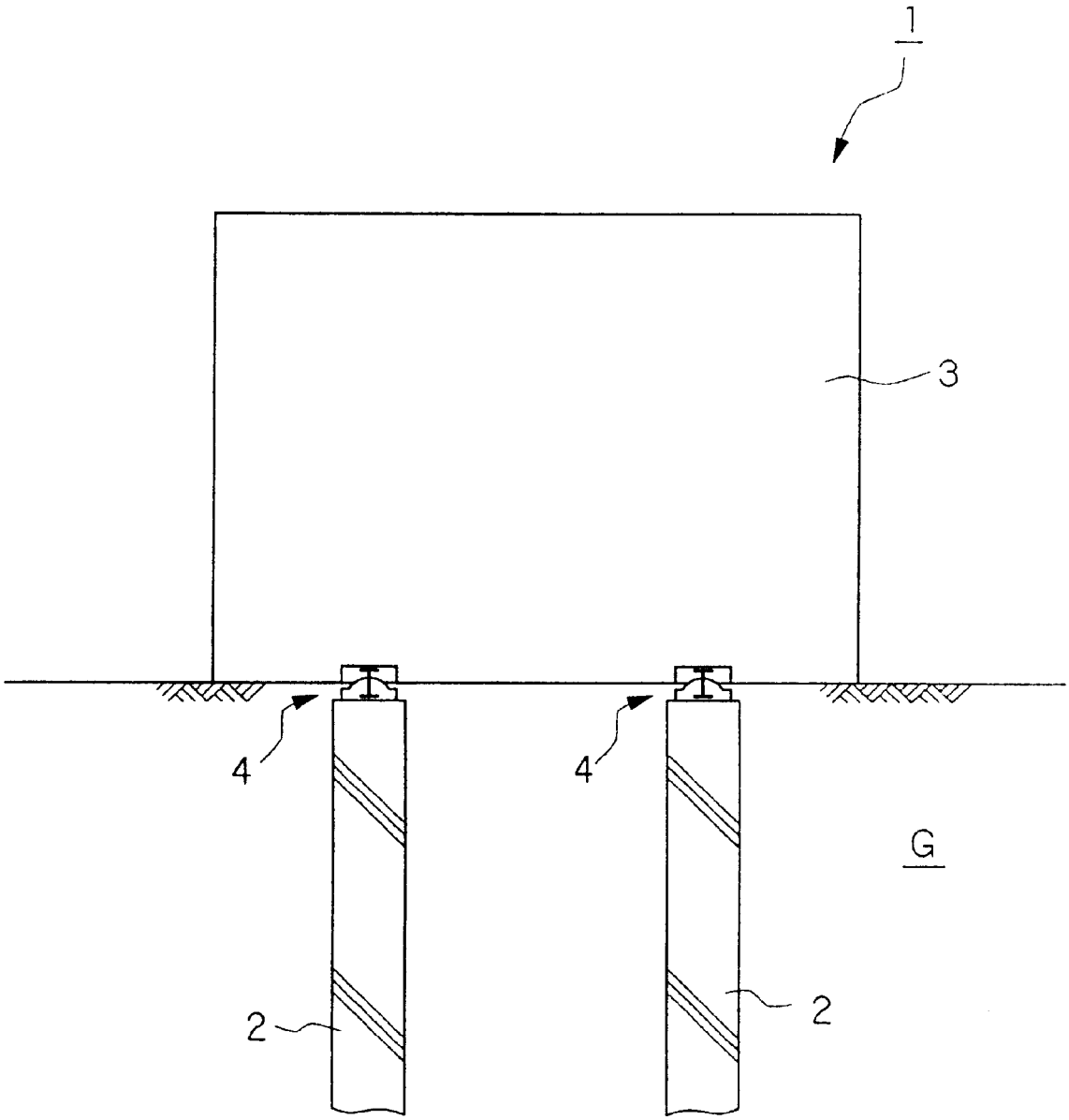
FIG. 4 is a vertical sectional figure showing in schematic form a building to which the stress transmission device shown in FIG. 1 has been applied.

FIG. 4 is a figure showing in schematic form a stress transmission device according to a first preferred embodiment of the present invention, and in this figure the reference numeral 1 denotes a building (a structure). This building 1 comprises foundation piles 2 which are emplaced within a ground slab G, and an upper structural portion 3 which is supported upon the foundation piles 2; and its construction incorporates stress transmission devices 4 for performing transmission of stress between the foundation piles 2 and the upper structural portion 3.

Figure 1:
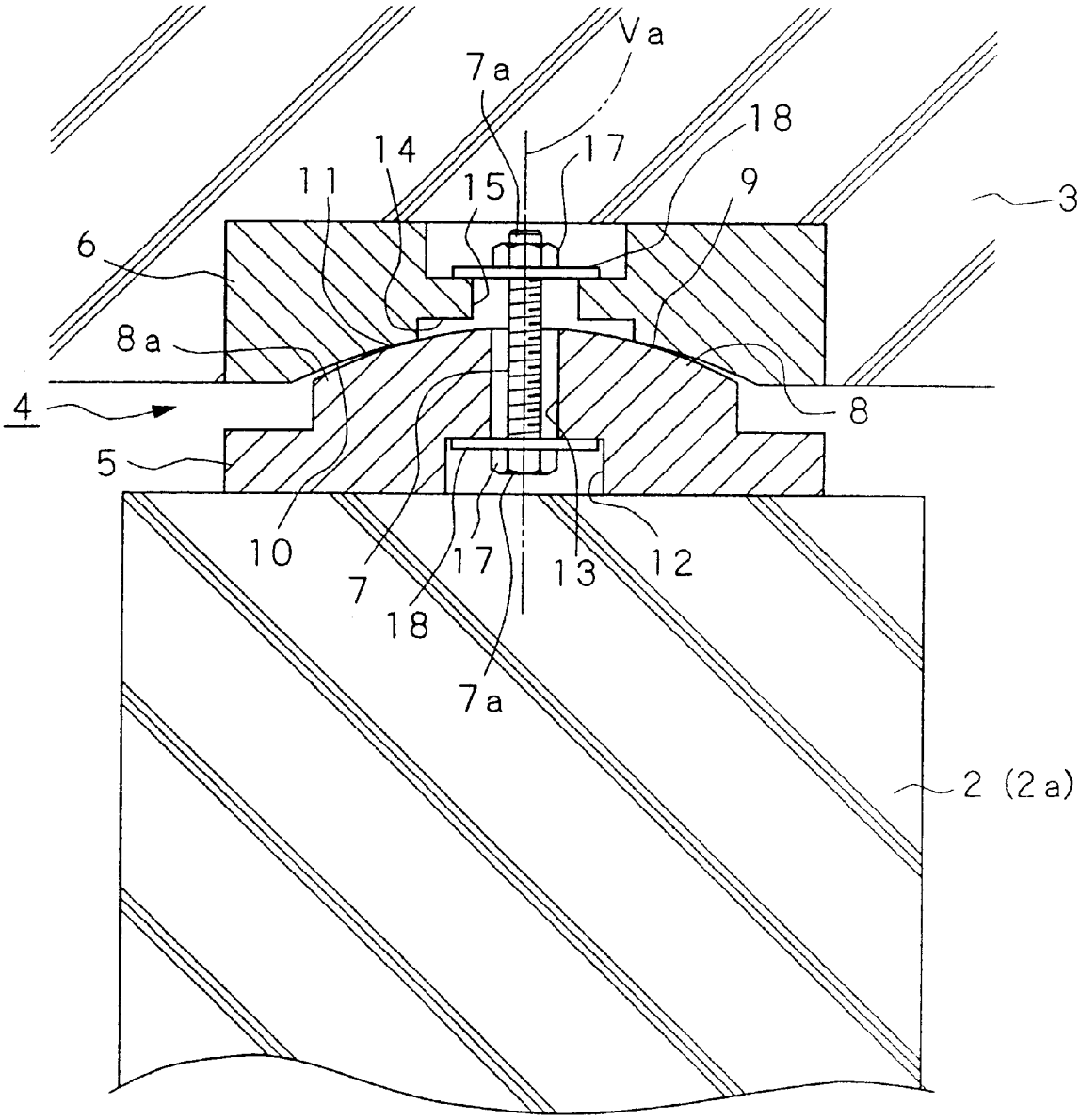
FIG. 1 is an enlarged vertical sectional figure showing in schematic form a stress transmission device according to a first preferred embodiment aspect of the present invention.

FIG. 1 is an enlarged vertical sectional figure showing one of these stress transmission devices 4. As shown in this figure, the stress transmission device 4 broadly comprises a pile head member 5 which is provided upon a pile head 2*a* of the foundation pile 2, a structure support member 6 which is fixed to the upper structural portion 3 in a position to oppose the pile head member 5, and a prestressing steel rod 7 (a tension member) which is fixed to this pile head member 5 and this structure support member 6. This pile head member 5, structure support member 6, and prestressing steel rod 7 are all formed as axially symmetric around the vertical axis Va.

As shown in the figure, the pile head member 5 is formed with a convex spherical seat 8, and, by the outer surface 9 of this spherical seat 8 rubbing against a concave surface 10 formed upon the structure support member 6, the pile head member 5 and the structure support member 6 are mutually contacted together via a first contact surface 11. It should be understood that the curvature of the concave surface 10 of the structure support member 6 is formed to be somewhat weaker than that of the outer convex surface 9 of the spherical seat 8 of the pile head member 5.

The spherical seat 8 is formed with an aperture portion 13 which pierces through from its outer surface 9 to its bottom portion 12. On the other hand, the structure support member 6 is formed with the central portion of its concave surface 10 being formed in a hollowed out shape so as to constitute a hollowed out portion 14, and moreover a through hole 15 is provided in the central portion of the hollowed out portion 14.

The prestressing steel rod 7 passes through this aperture portion 13 and this through hole 15, and is set up so that its central axis coincides with the vertical axis Va. At the two ends 7*a*, 7*a* of the prestressing steel rod 7 there are fixed nuts 17 (stop members) and washers 18 (also stop members), and, by the washers 18 stopping against the pile head member 5 and the structure support member 6, the two ends 7*a*, 7*a* of the prestressing steel rod 7 are respectively engaged to the pile head member 5 and to the structure support member 6. And the pile head member 5 and the structure support member 6 are pulled together at the first contact surface 11 by the prestressing steel rod 7 being pre-stressed.

Figure 2:
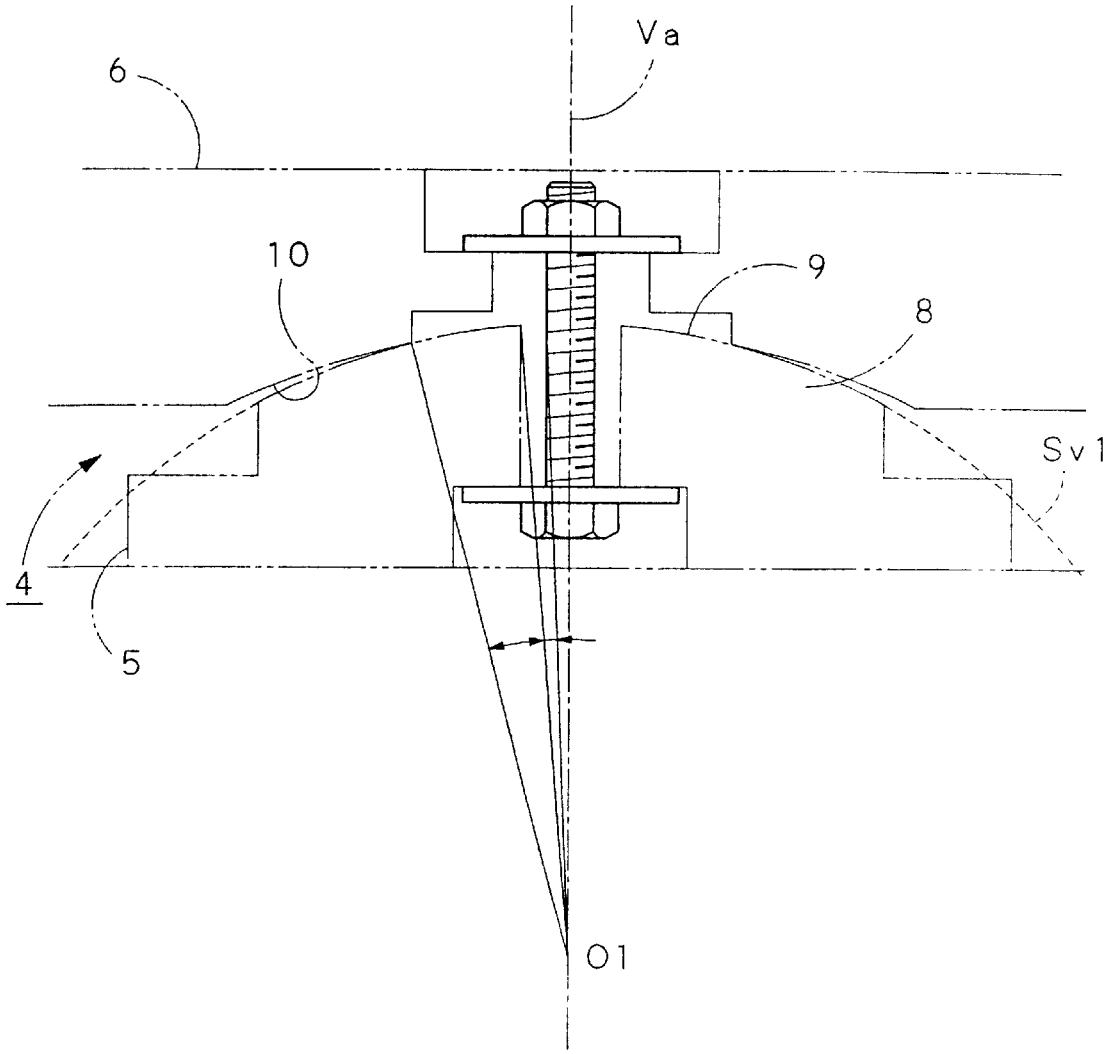
FIG. 2 is a vertical sectional figure showing in enlarged view the form of a ball seat which is provided to a pile head member of the stress transmission device shown in FIG. 1.

The outer surface 9 of the spherical seat 8, as shown in FIG. 2, is formed so that it defines the same surface as a first imaginary spherical surface Sv1 whose center of curvature O1 is positioned upon the vertical axis Va as central axis, and due to this the first contacting surface 11 comes to define a portion of this first imaginary spherical surface Sv1.

Figure 3:
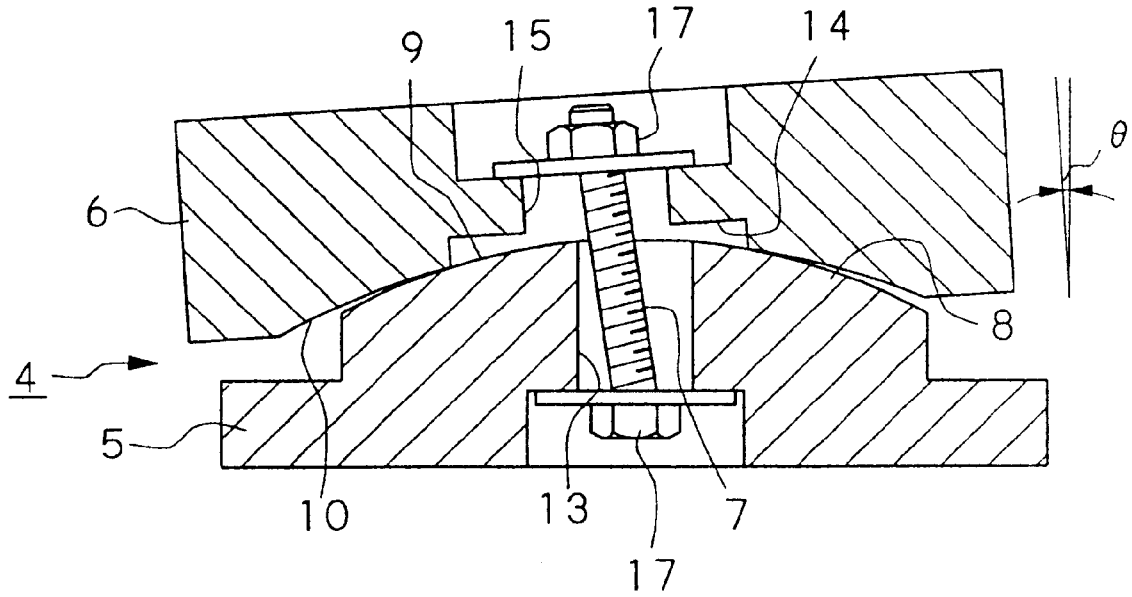
FIG. 3 is a vertical sectional figure showing the situation when, with the stress transmission device shown in FIG. 1, a relative displacement has taken place between the pile head member and a structural element support member.

Further, in this stress transmission device 4, as shown in FIG. 3, the through hole 15 and the aperture portion 13 are formed with their diametrical dimensions being determined so that, when the pile head member 5 and the structure support member 6 have undergone relative displacement by the maximum rotational angle θ which is anticipated to be subtended between the foundation pile 2 and the upper structural portion 3, this through hole 15 and aperture portion 13 do not come into contact with the prestressing steel rod 7, in other words so that the inner circumferential surfaces of the through hole 15 and the aperture portion 13 are positioned further outwards that the range over which the prestressing steel rod 7 can reach.

Further, in this stress transmission device 4, the diametrical dimension of the hollowed out portion 14 and the diametrical dimension of the aperture portion 13, which constitute the edges of the end portions of the through hole 15 and the aperture portion 13 where they open to the first contacting surface 11, are so determined that, when the pile head member 5 and the structure support member 6 have undergone relative displacement by the maximum rotational angle θ which is anticipated to be subtended between the foundation pile 2 and the upper structural portion 3, at the first contacting surface 11, the aperture portion 13 is always positioned within the hollowed out portion 14. Due to this, no change of the contacting surface area between the concave surface 10 and the spherical seat 8 takes place accompanying that the aperture portion 13 is positioned outside the hollowed out position 14.

Next the operation of this first preferred embodiment of the present invention, and the benefits which it provides, will be described.

With the above described stress transmission device 4 and building 1, the pile head member 5 and the structure support member 6 are mutually contacted in the upwards and downwards direction via the first contacting surface 11 which describes a portion of the first imaginary spherical surface Sv1, and the prestressing steel rod 7 is engaged with the pile head member 5 and the structure support member 6 in order to pull them together into contact via this first contacting surface 11. By doing this, it is possible to prevent the support member 6 from rising away from the pile head member 5, as long as the tension force which acts between the pile head member 5 and the structure support member 6 to pull them apart is less than the pulling together force which is exerted by the prestressing steel rod 7. Due to this, along with preventing the upper structural portion 3 from coming away, it is ensured that mutual relative displacement between the pile head member 5 and the structure support member 6 only takes place along the first imaginary spherical surface Sv1, so that rotational deformation capacity is provided for the engaging portions of the pile head 2*a* and the upper structural portion 3, and it is possible to ensure that the bending moment which is transmitted between the upper structural portion 3 and the foundation pile 2 does not become excessive. Furthermore, since the structure support member 6 does not come up away from the pile head member 5, thereby not only is it possible always to transmit shearing force between the upper structural portion 3 and the pile head 2*a*, but it is ensured that no excessive stress should act upon the pile head member 5 or the pile head 2*a*, as might otherwise be generated if the structure support member 6 and pile head member 5 were to become separated and then should collide together as they came back into contact with one another; and thereby it is possible to ensure the stability and safety of the building 1 during an earthquake.

Moreover, with the above described building 1, since the structure arranges for the pile head member 5 and the structure support member 6 to be connected together by the prestressing steel rod 7, therefore it is possible for any lifting up force which acts upon the upper structural portion 3 to be transmitted via the prestressing steel rod 7 to the foundation pile 2, and thereby it is possible efficiently to make use of the resistance which the foundation pile 2 offers to being pulled out.

Yet further, with the above described stress transmission device 4 and building 1, the first contacting surface 11 is formed by providing the spherical seat 8 to the pile head member 5, and by also forming the concave surface 10 upon the structure support member 6, and thus it is arranged that the outer surface 9 of the spherical seat 8 and the concave surface 10 are mutually contacted together. And the outer surface 9 of the spherical seat 8 is formed so as to define a surface which is the same as the first imaginary spherical surface Sv1, and the prestressing steel rod 7 is passed through the through hole 15 which is formed in the concave surface 10 and the inner portion of the aperture portion 13 which is formed in the spherical seat 8, and its ends 7*a*, 7*a* are engaged to the pile head member 5 and the structure support member 6 by the nuts 17 and the washers 18. By this construction, the pile head member 5 and the structure support member 6 can be pulled together and contacted via the first contacting surface 11 with a very simple structure.

Since in this case the prestressing steel rod 7 is arranged so as to extend along the vertical axis Va as a central axis, thereby the pulling force which pulls together the spherical seat 8 and the concave surface 10 acts in the vertical direction. Here, since the sloping angle of the outer edge portion 8*a* (see FIG. 1) upon the spherical seat 8 which defines the first contacting surface 11 is comparatively large, it is ensured that, at this outer edge portion 8*a*, the component of the pressing force which acts upon the outer surface 9 of the spherical seat 8 perpendicularly to the first contacting surface 11 does not become excessive. By this, the frictional force which acts between the outer surface 9 of the spherical seat 8 and the concave surface 10 in the vicinity of the outer edge portion 8*a* of the spherical seat 8 does not become large, and there is little danger that the pre-stressing of the prestressing steel rod 7 should exert any influence upon the rotational capability between the pile head member 5 and the structure support member 6.

Further, since with the above described stress transmission device 4 and building 1, in the through hole 15, the diametrical dimension of the hollowed out portion 14 which defines the edge portion of the through hole 15 which contacts the first contacting surface 11 is made to be comparatively large as compared to the diametrical dimension of the aperture portion 13, and furthermore the diametrical dimensions of the through hole 15 and the aperture portion 13 are so determined that the edge of the aperture portion 13 is positioned within the hollowed out portion 14, when the relative displacement between the pile head member 5 and the structure support member 6 assumes the value of the maximum rotational angle θ which is anticipated to be subtended between the foundation pile 2 and the upper structural portion 3, thereby the area of the first contacting surface 11 does not vary, even when the position of the through hole 15 and the aperture portion 13 has thus been relatively displaced, and it is always possible suitably to support the compression force which acts between the pile head member 5 and the structure support member 6, as is desirable.

Furthermore, with the above described stress transmission device 4 and building 1, since the diametrical dimensions of the through hole 15 and the aperture portion 13 are determined so that, even when the pile head member 5 and the structure support member 6 are relatively displaced through the maximum rotational angle θ, their inner peripheral surfaces are located outside of the range in which the prestressing steel rod 7 is located, thereby the relative displacement of the pile head member 5 and the structure support member 6 is not disturbed by the prestressing steel rod 7 coming into contact with the inner circumferential surfaces of the through hole 15 and the aperture portion 13, and thus the rotational deformation capacity between the pile head 2*a* and the upper structural portion 3 is always preserved, so that it is possible to suppress transmission of bending moment between these members.

It should be noted that, with this first preferred embodiment, it would also be possible to utilize other constructions for the structure and the like of the stress transmission device 4 and the building 1 to which it is applied, while remaining within the gist of the present invention and not deviating from its scope.

Figure 5:
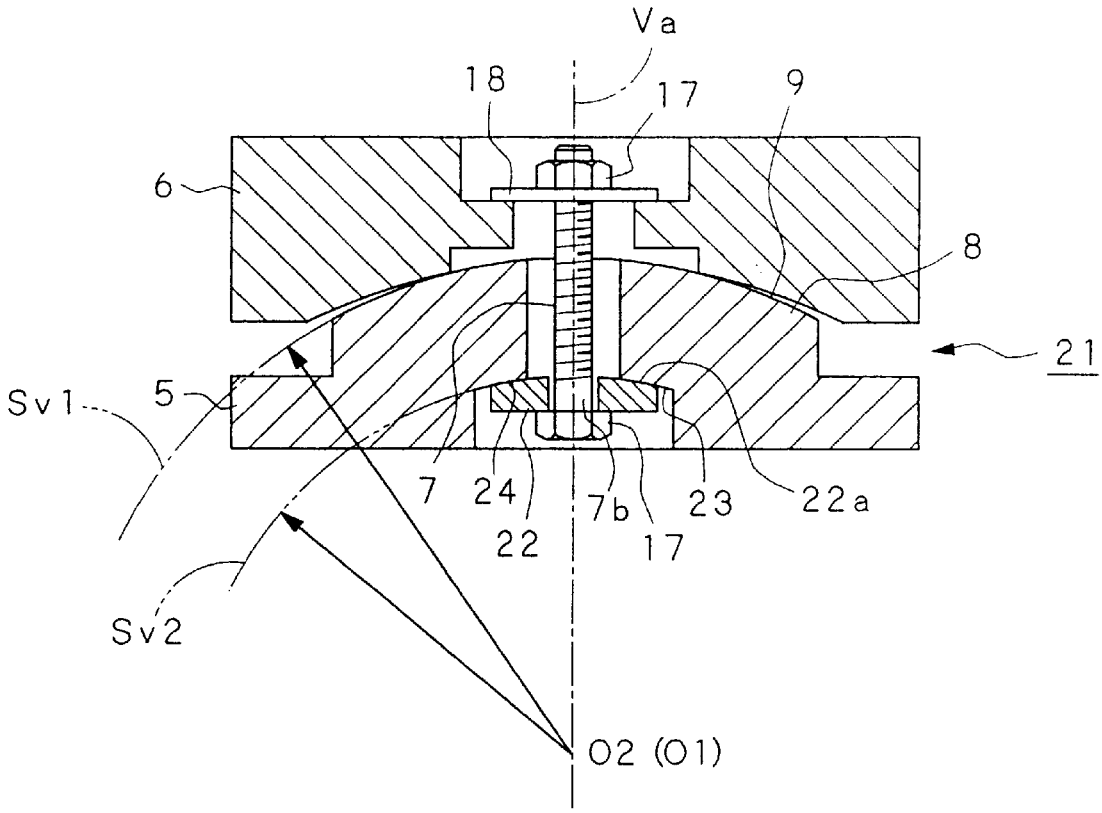
FIG. 5 is an enlarged vertical sectional figure showing in schematic form a variant example of the stress transmission device according to the first preferred embodiment of the present invention.
Figure 6:
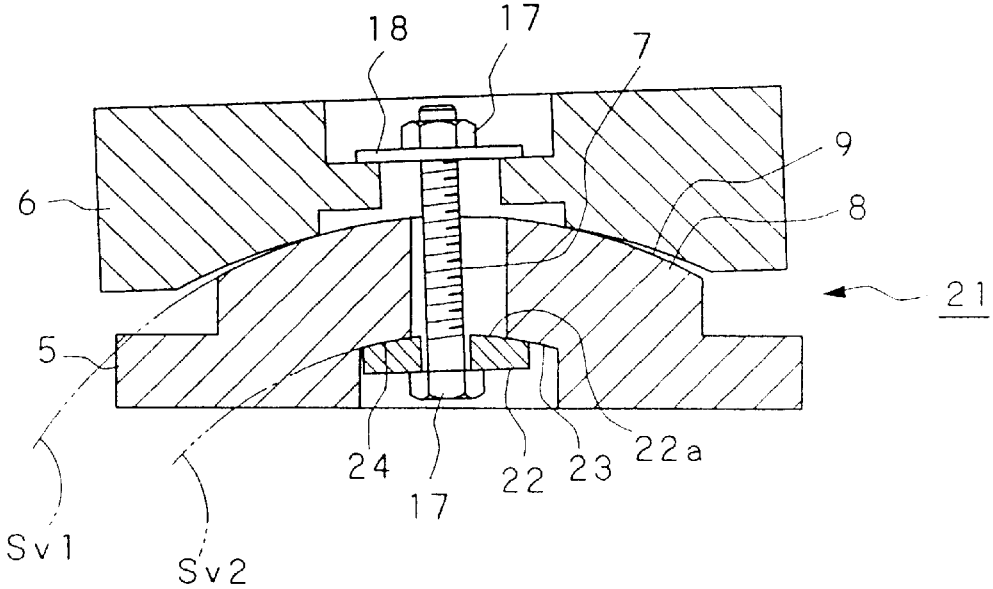
FIG. 6 is a vertical sectional figure showing the situation when, with the stress transmission device shown in FIG. 5, a relative displacement has occurred between a pile head member and a structural element support member.

For example, the structure of the stress transmission device is not limited to the one shown in FIGS. 1 through 3; a variant structure such as the one which is shown in FIGS. 5 and 6 may also be employed.

The stress transmission device 21 shown in FIG. 5 has a structure which is almost identical to that of the stress transmission device 4 shown in FIGS. 1 through 4, except for the fact that the structure of the engagement portions between the lower end portion 7*b* of the prestressing steel rod 7 and the pile head member 5 is different from that which was utilized in the stress transmission device 4.

With this stress transmission device 21, the structure is such that the lower end portion 7*b* of the prestressing steel rod 7 is engaged to an inner surface 23 of the spherical seat 8 of the pile head member 5 by a nut 17 and a curved surface metallic seat washer 22. Further, an upper surface 22*a* of the curved surface metallic seat washer 22 and the inner surface 23 of the spherical seat 8 are formed so as to describe the same surface as a second imaginary spherical surface Sv2, and thereby a second contacting surface 24 which is defined by the upper surface 22*a* of the curved surface metallic seat washer 22 and the inner surface 23 of the spherical seat 8 comes to describe the same surface as this second imaginary spherical surface Sv2.

Further, here, the center of curvature O2 of this second imaginary spherical surface Sv2 coincides with the center of curvature O1 of the first imaginary spherical surface Sv1.

With the stress transmission device 21 according to this construction, since, as shown in FIG. 6, when the pile head member 5 and the structure support member 6 undergo relative displacement along the first imaginary spherical surface Sv1, it is possible for the curved surface metallic sheet washer 22 to undergo relative displacement with respect to the inner surface 23 of the spherical seat 8 along the second imaginary spherical surface Sv2, therefore relative displacement of the prestressing steel rod 7 with respect to the pile head member 5 according to the displacement of the structure support member 6 becomes possible, without its being restricted by the pile head member 5. Due to this, there is little danger of the existence of the prestressing steel rod 7 exerting any influence upon the relative displacement of the pile head member 5 and the structure support member 6, and it becomes possible to ensure a desirable sliding performance between the pile head member 5 and the structure support member 6.

Figure 7:
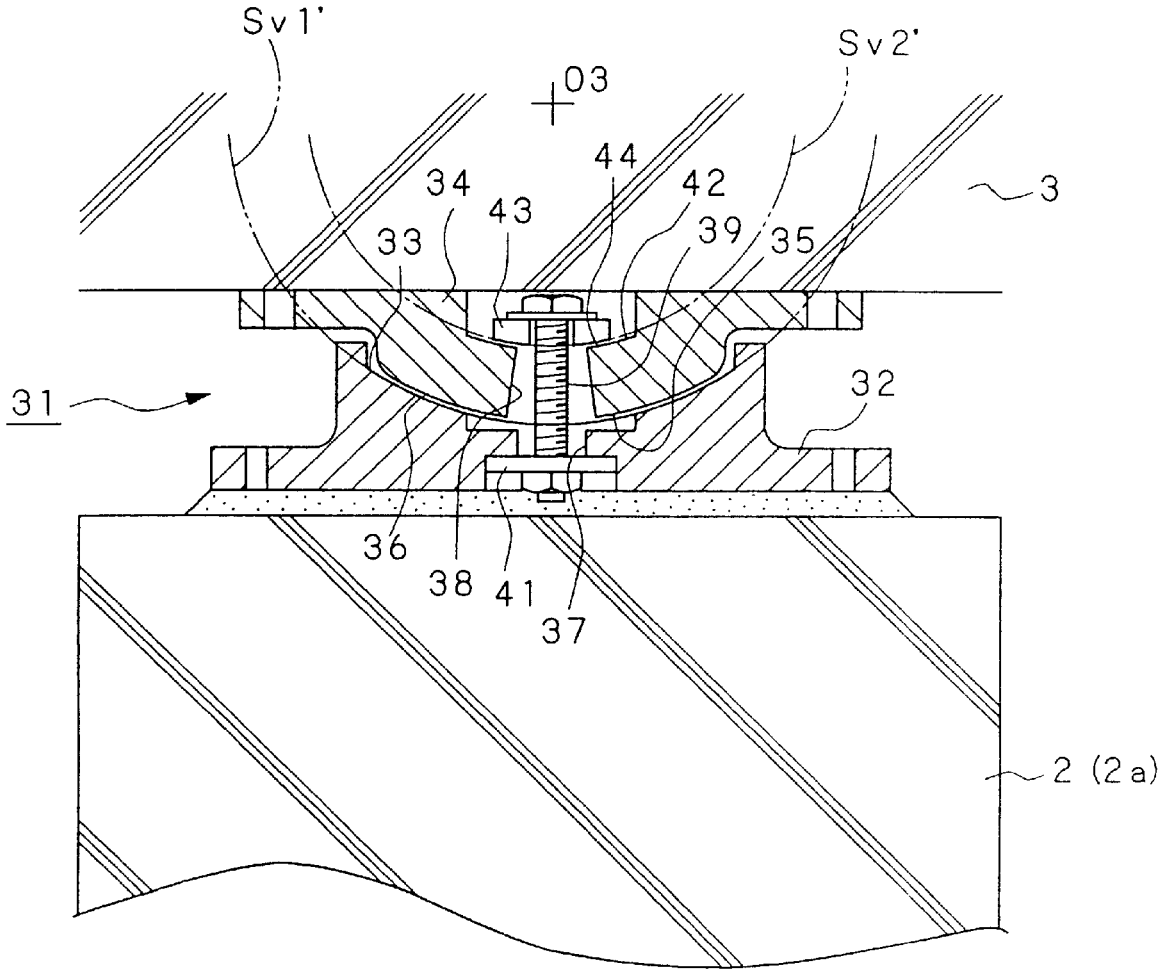
FIG. 7 is an enlarged vertical sectional figure showing in schematic form another variant example of the stress transmission device according to the first preferred embodiment of the present invention.

Further, although with the above described first embodiment and with its variant shown in FIGS. 5 and 6 the spherical seat 8 was formed in the pile head member 5 and the concave surface 10 was formed in the structure support member 6, it is also possible to utilize an opposite construction, as shown in FIG. 7.

In the construction of the stress transmission device 31 shown in FIG. 7, a concave surface 33 is formed in a pile head member 32 which is provided to a foundation pile 2, and a spherical seat 35 which projects in the downward direction is formed in a structure support member 34 which is fixed to an upper structural portion 3 and is situated opposing the pile head member 32; and, furthermore, the contacting surfaces of the concave surface 33 and the outer surface of the spherical seat 35 constitute a first contact surface 36 which defines a portion of a first imaginary spherical surface Sv1'.

Yet further, in this stress transmission device 31, along with a through hole 37 being formed in the concave surface 33, an aperture portion 38 is formed in the spherical seat 35 in a position which opposes the through hole 37, and the construction includes a prestressing steel rod 39 which is arranged to pass through this through hole 37 and this aperture portion 38. The prestressing steel rod 39 is stopped against the pile head member 32 by a stopper member 41, and is stopped against an inner surface 42 of the spherical seat 35 by a curved surface metallic seat washer 43. Moreover, by a pre-stressing force being imposed upon the prestressing steel rod 39, the pile head member 32 and the structure support member 34 are squeezed together at the first contacting surface 36 with a predetermined pressing force.

Further, the curved surface metallic seat washer 43 is made so as to contact against the inner surface 42 of the spherical seat 35 via a second contacting surface 44 which defines a surface the same as a second imaginary spherical surface Sv2'. This second imaginary spherical surface Sv2' and the first imaginary spherical surface Sv1' have the same center of curvature O3.

With a construction like that of FIG. 7, in the event of an earthquake, as long as the tension force which acts between the pile head member 32 and the structure support member 34 to pull them apart is less than the pulling together force which is exerted by the prestressing steel rod 39, it is possible to prevent the structure support member 34 from coming up away from the pile head member 32. Due to this, along with preventing the upper structural portion 3 from coming away, it is ensured that mutual relative displacement between the pile head member 32 and the structure support member 34 only takes place along the first imaginary spherical surface Sv1', so that rotational deformation capacity is provided for the engaging portions of the pile head 2*a* and the upper structural portion 3, and it is possible to ensure that the bending moment which is transmitted between the upper structural portion 3 and the foundation pile 2 does not become excessive. Furthermore, in this case, since it is possible to ensure that the curved surface metallic seat washer 43 undergoes displacement relative to the inner surface 42 of the spherical seat 35 along the second imaginary spherical surface Sv2', thereby relative displacement of the prestressing steel rod 39 with respect to the pile head member 32 according to the displacement of the structure support member 34 becomes possible, without the prestressing steel rod 39 being restricted by the pile head member 32, and it becomes possible to ensure a desirable sliding performance between the pile head member 32 and the structure support member 34.

Moreover, since the structure support member 34 does not come up away from the pile head member 32, thereby not only is it possible always to transmit shearing force between the upper structural portion 3 and the pile head 2*a*, but it is ensured that no excessive stress should act upon the pile head member 5 or the pile head 2*a*, as might otherwise be generated if the structure support member 6 and pile head member 5 were to become separated and then should collide together as they came back into contact with one another; and thereby it is possible to ensure the stability and safety of the building 1 during an earthquake.

In this manner, it is possible to realize the same beneficial effects as in the first embodiment described above by applying this variant construction in which the positions of the spherical seat and the concave surface are reversed top and bottom as well.

Further, although in this first preferred embodiment the curvature of the concave surface 10 was made to be somewhat weaker than the curvature of the outer surface 9 of the spherical seat 8, an alternative construction would also be possible in which they were the same, so that these surfaces coincided. Further, in the above described first preferred embodiment, instead of the prestressing steel rod 7, it would also be possible to utilize a member which pre-stressing force could be provided, such as a prestresssing steel wire or the like.

Yet further, although in the above described first preferred embodiment the stress transmission device 4 was applied to a building 1, it is not limited to this application; in fact, this stress transmission device 4 can be applied to all types of structure which have an upper structural portion 3 upon a foundation pile 2, such as civil engineering structures and the like.

The Second Preferred Embodiment

Figure 11:
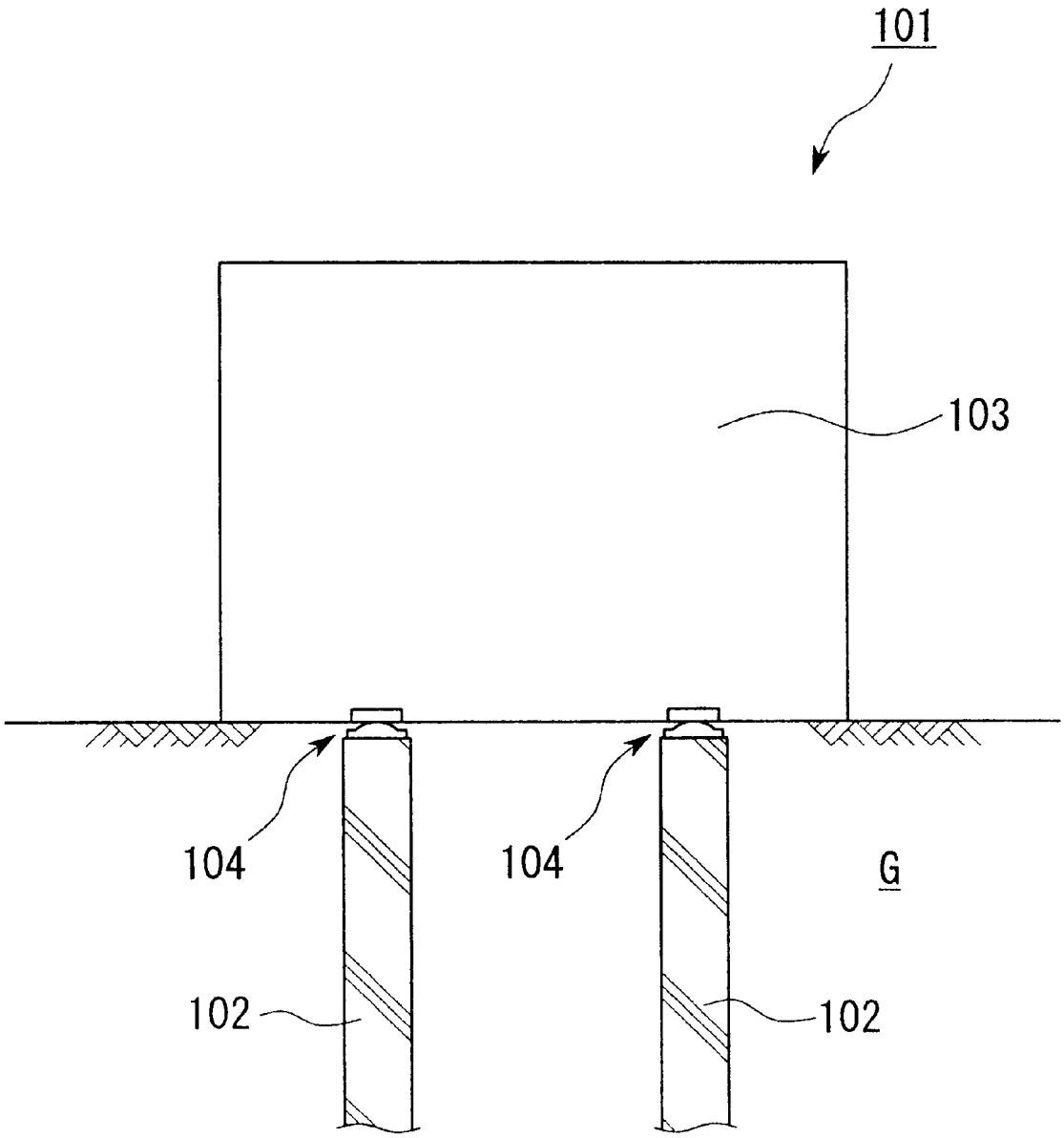
FIG. 11 is a vertical sectional figure showing a building to which the stress transmission device shown in FIG. 8 has been applied.

FIG. 11 is a figure showing in schematic form an example of a stress transmission device according to a second preferred embodiment of the present invention, and in this figure the reference numeral 101 denotes a building (a structure). This building 101 comprises foundation piles 102 which are emplaced within a ground slab G, and an upper structural portion 103 which is supported upon the foundation piles 102; and its construction incorporates stress transmission devices 104 for performing transmission of stress between the foundation piles 102 and the upper structural portion 103.

Figure 8:
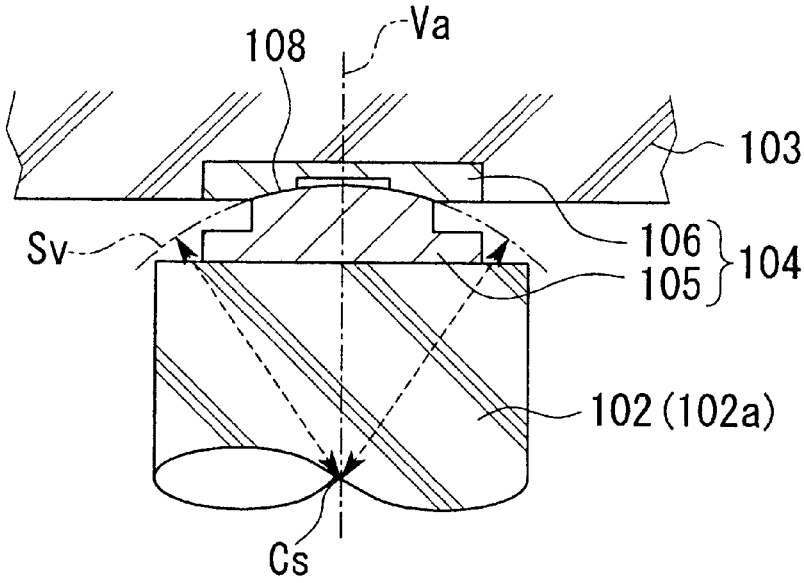
FIG. 8 is a vertical sectional figure showing in schematic form a second preferred embodiment of the stress transmission device according to the present invention.

FIG. 8 is an enlarged vertical sectional figure showing one of these stress transmission devices 104. As shown in this figure, the stress transmission device 104 comprises a pile head member 105 which is provided to a pile head 102*a* of the foundation pile 102, and a structure support member 106 which is fixed to the upper structural portion 103 in a position to oppose the pile head member 105.

Figure 9:
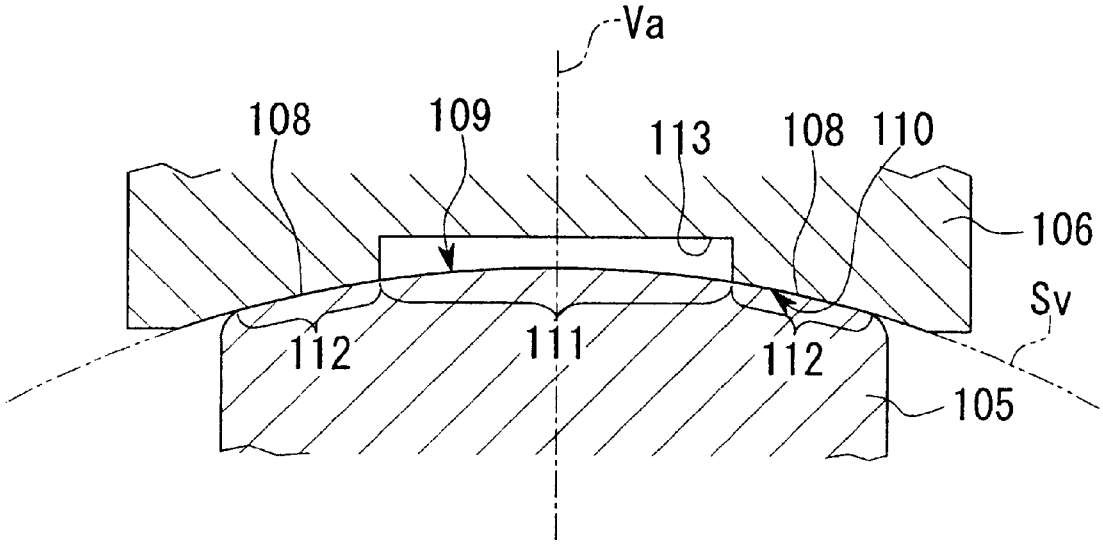
FIG. 9 is a vertical sectional figure showing an enlarged view of the vicinity of the contacting surfaces between a pile head member and a structual element support member shown in FIG. 8.

And, in this stress transmission device 104, the pile head member 105 and the structure support member 106 mutually contact one another in the upwards and downwards direction via a contacting surface which defines a portion of an imaginary spherical surface Sv. FIG. 9 is a figure showing an enlarged view of the vicinity of this contacting surface 108. The contacting surface 108 is formed by the contact between a convex surface 109 which is formed upon the pile head member 105 and a concave surface 110 which is formed upon the structure support member 106. This convex surface 109 and this concave surface 110, together, are formed so as to define a surface the same as the imaginary spherical surface Sv, and the vertical axis Va which passes through the center of curvature Cs (refer to FIG. 8) of the imaginary spherical surface Sv is the axis of symmetry of the convex surface 109 and this concave surface 110 and constitutes their rotational axis. Accordingly, the contacting surface 108 is formed so as to define a curved surface of an axially symmetric form about this rotational axis Va.

Further, the concave surface 110 comprises a central portion 111 which is centered about the vertical axis Va and an outer annular portion 112 which surrounds this central portion 111. The central portion 111 of the concave surface 110 is formed with an aperture portion 113, and by doing this a concave shape is defined, when the imaginary spherical surface Sv is taken as a reference. Accordingly, in the concave surface 110, only the outer annular portion 112 is formed as the contacting surface 108 which contacts the convex surface 109.

Figure 10:
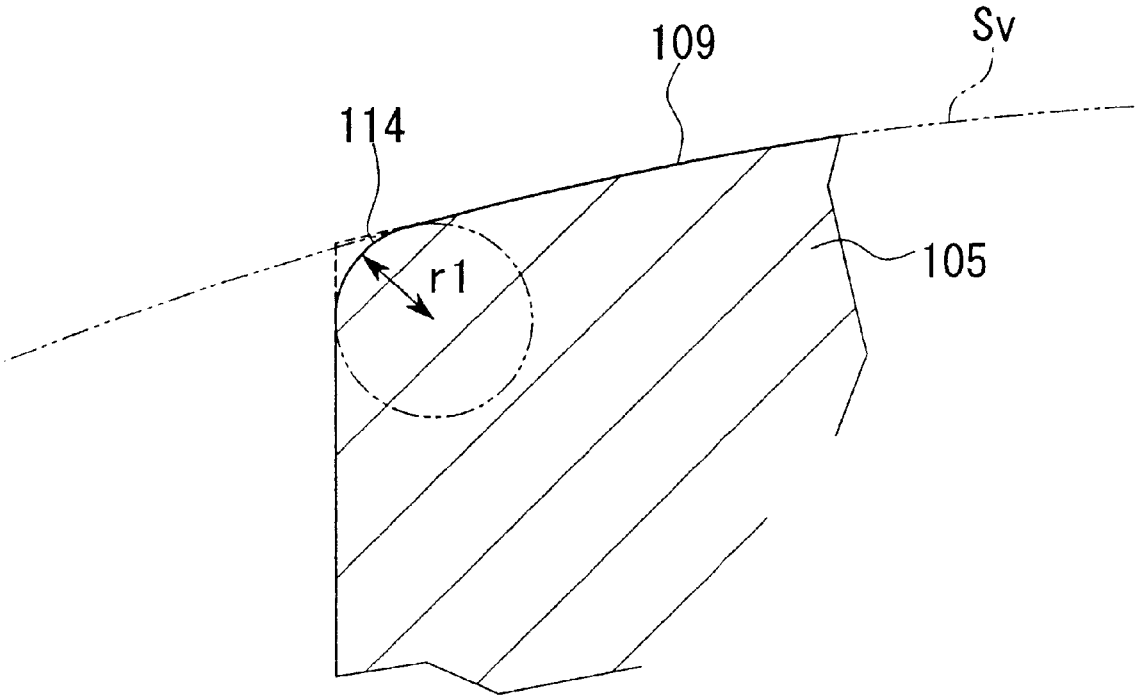
FIG. 10 is a vertical sectional figure showing an enlarged view of an outer circumferential edge portion of a convex surface of the pile head member shown in FIG. 8.

FIG. 10 is an enlarged view showing an outer circumferential edge portion 114 of the convex surface 109. As shown in this figure, this outer circumferential edge portion 114 of the convex surface 109 is formed as a curved surface whose radius of curvature in vertical cross section (shown as r1 in the figure) is comparatively small as compared with the radius of curvature of the imaginary spherical surface Sv.

Figure 12:
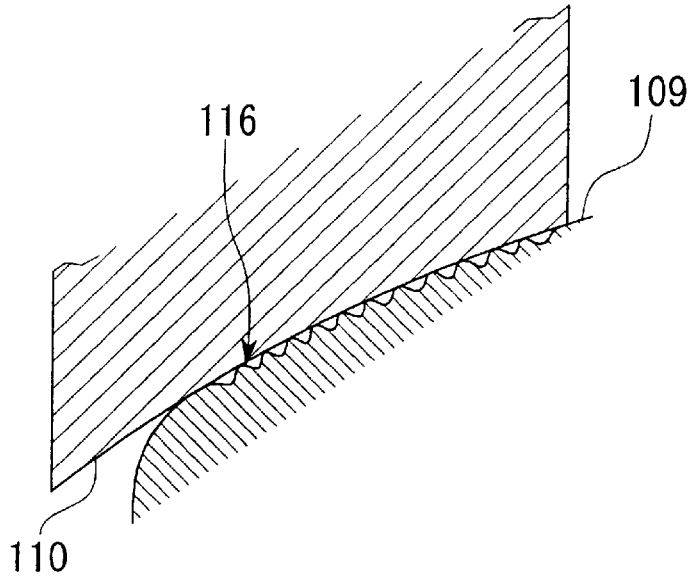
FIG. 12 is a vertical sectional figure showing a further enlarged view of the vicinity of the contacting surfaces between the pile head member and the structual element support member shown in FIG. 9.
Figure 13:
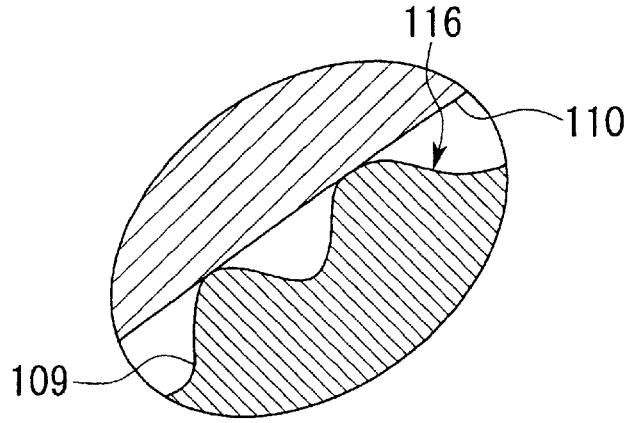
FIG. 13 is a yet further enlarged vertical sectional figure showing an essential portion of the FIG. 12 structure.
Figure 14:
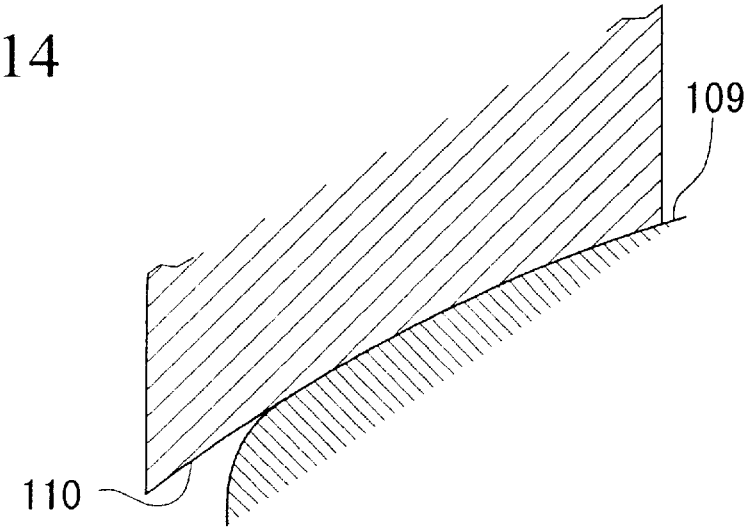
FIG. 14 is a vertical sectional figure showing, in the comparison case when both the concave surface of the pile head member and the convex surface of the structural element support member are formed as smooth, these contacting surfaces.

Moreover, FIG. 12 is a figure showing the contact portion between the convex surface 109 and the concave surface 110 in a further enlarged view. As shown in the figure, minute convexities and concavities 116 are formed upon the surface of the convex surface 109 by casting. Further, these convexities and concavities 116 are formed principally in the direction perpendicular to the drawing paper in the figure. On the other hand, the concave surface 110 is formed as smooth by comparison with the convex surface 109. This is shown in a yet more highly enlarged view in FIG. 13, and, as shown in this figure, by forming these regular convexities and concavities 116 upon the convex surface 109, the contact area between the concave surface 110 and the convex surface 109 is reduced, by comparison with the case in which both the concave surface 110 and the convex surface 109 are formed as smooth (this comparison case is shown in FIG. 14).

With the building 101 and the stress transmission device 104 according to this construction, the pile head member 105 and the structure support member 106 come to be mutually contacted together in the upward and downward direction only via the outer annular portion 112 of the concave surface 110. By doing this, the frictional resistance between the pile head member 105 and the structure support member 106 can be reduced, as compared to the case (as shown for example in FIG. 16) in which they are in contact over the entire extent of the surface which surrounds the vertical axis Va within the imaginary spherical surface Sv.

Figure 16:
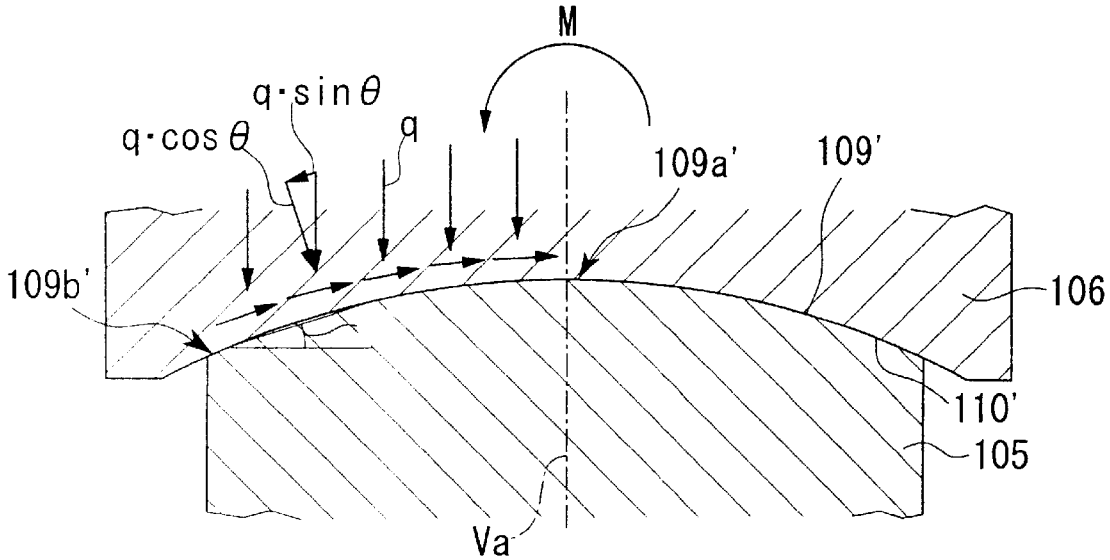
FIG. 16 is a vertical sectional figure for explanation of the frictional force which acts upon the contacting surfaces shown in FIG. 15, under the hypothesis that no aperture portion has been provided in the concave surface of the structural element support member.

In the case when as shown in FIG. 16 no aperture portion 113 has been formed in either the concave surface 110' or the convex surface 109', then the axial force q which is transmitted from the upper structural portion when a bending moment M acts comes to be supported over a wide region on the convex surface 109', from its central portion 109*a*' which is comparatively near to being planar to its outer edge portion 109*b*'. In this case, if as shown in the figure the angle of the concave surface 110' from a horizontal plane is termed θ, the component in the normal direction of the axial force q which acts upon the contacting surface between the convex surface 109' and the concave surface 110' is equal to q·cos θ, and accordingly the friction between the convex surface 109' and the concave surface 110', which constitutes the resistance when the structure support member 106 slides along the pile head member 105, can be expressed as $\mu$q·cos θ, where $\mu$ is the coefficient of friction between the contacting surfaces. Further, since the angle θ is small in the vicinity of the central portion 109*a*' of the convex surface 109', the frictional force between the convex surface 109' and the concave surface 110' is almost equal to $\mu$q.

Figure 15:
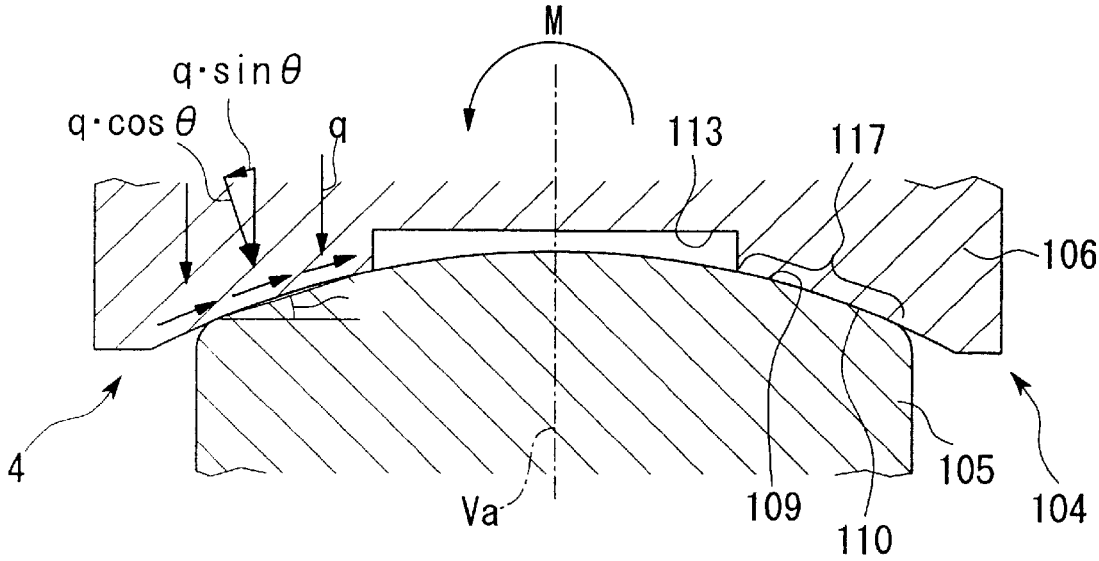
FIG. 15 is a vertical sectional figure for explanation of the frictional force which acts upon the contacting surfaces shown in FIG. 9.

By contrast to the above case, with the stress transmission device 104 shown in FIG. 15, the axial force q comes to be supported by the outer annular portion 117 of the convex surface 109, whose angle of inclination θ is quite steep. Accordingly in this case cos θ is smaller, and, if the same axial force q acts, the frictional resistance becomes smaller as compared with the case shown in FIG. 16, and as a result it becomes possible to generate rotation between the convex surface 109 and the concave surface 110 with a smaller bending moment.

Moreover, since with the construction shown in FIG. 15 the component q·sin θ of the axial force q which generates rotation becomes large as compared with the case shown in FIG. 16, therefore because of this it is possible to restrain to a small value the bending moment which is required when the convex surface 109 and the concave. surface 110 undergo relative displacement.

Accordingly, it becomes possible to reduce the bending moment M which is required when the pile head member 105 and the structure support member 106 undergo relative displacement along the imaginary spherical surface Sv, and thereby it becomes possible to suppress the bending moment which is transmitted between the foundation pile 2 and the upper structural portion 3, and to ensure the performance of the entire building 101 as a whole with regard to deformation, so that a further level of safety enhancement for the building can be anticipated.

Further, with this stress transmission device 104, since the transmission of stress is performed only by the outer annular portion 112 of the concave surface 110, thereby it becomes possible to increase the component of the acting axial force which resists against horizontal slippage between the pile head member 105 and the structure support member 106, and moreover it becomes possible to reduce the component of the horizontal force which acts between the pile head member 105 and the structure support member 106 which tends to produce horizontal slippage.

Figure 17:
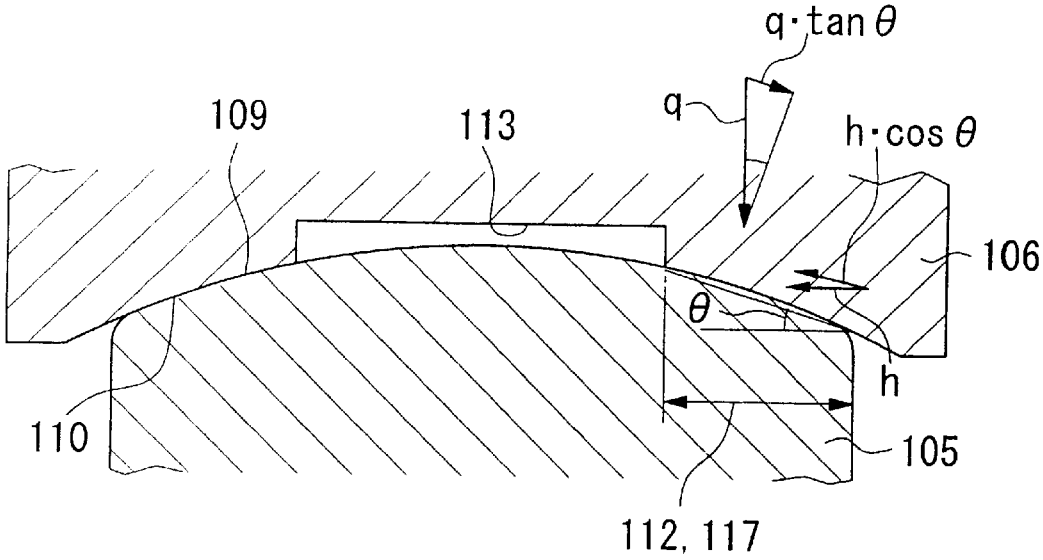
FIG. 17 is a vertical sectional figure for the contacting surfaces shown in FIG. 9, for explanation of the force which resists a horizontal force which acts between the pile head member and the structural element support member.
Figure 18:
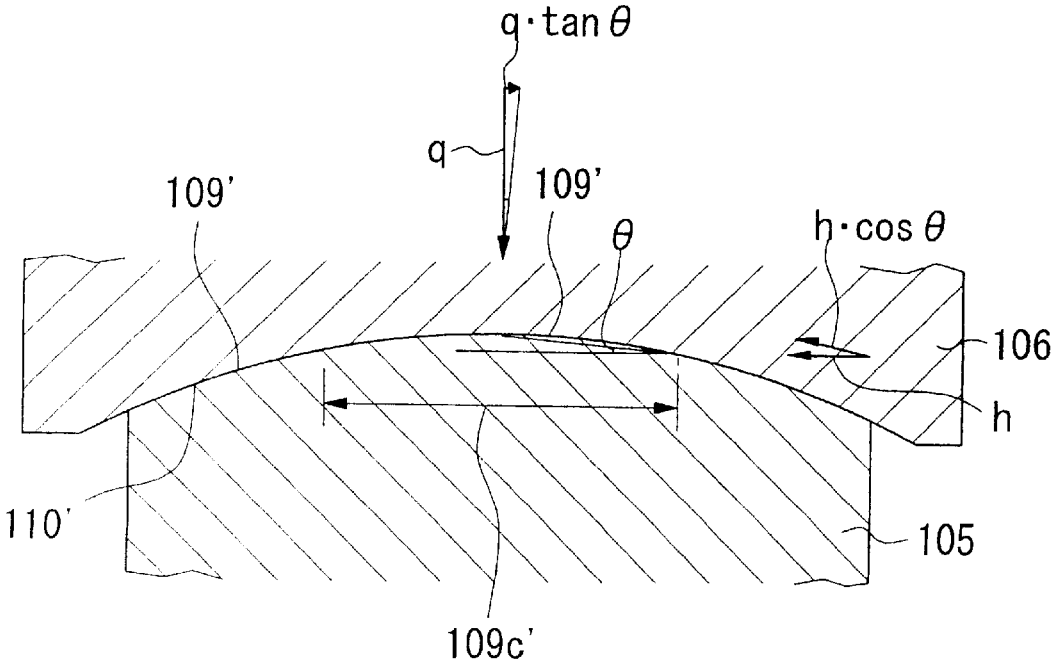
FIG. 18 is a vertical sectional figure, for the contacting surfaces shown in FIG. 17, for explanation of the force which resists a horizontal force which acts between the pile head member and the structural element support member, under the hypothesis that no aperture portion has been provided in the concave surface of the structural element support member.

As shown in FIG. 18, as compared with the case in which axial force is transmitted from the concave surface 110' in the vicinity of the head portion 109*a*' of the convex surface 109' (for example, in a region like that shown by 109*c*' in the figure), in the case that the aperture portion 113 is provided in the concave surface 110 as shown in FIG. 17, since the inclination θ of the contacting surface is comparatively large as compared with the case of FIG. 18, therefore on the one hand the component h·cos θ of the horizontal force h which tends to generate horizontal slippage becomes small, and also the component q·tan θ of the axial force q which resists against horizontal slippage becomes large. Due to this, it becomes possible to increase the shearing force which can be transmitted between the pile head member 105 and the structure support member 106.

Figure 19:
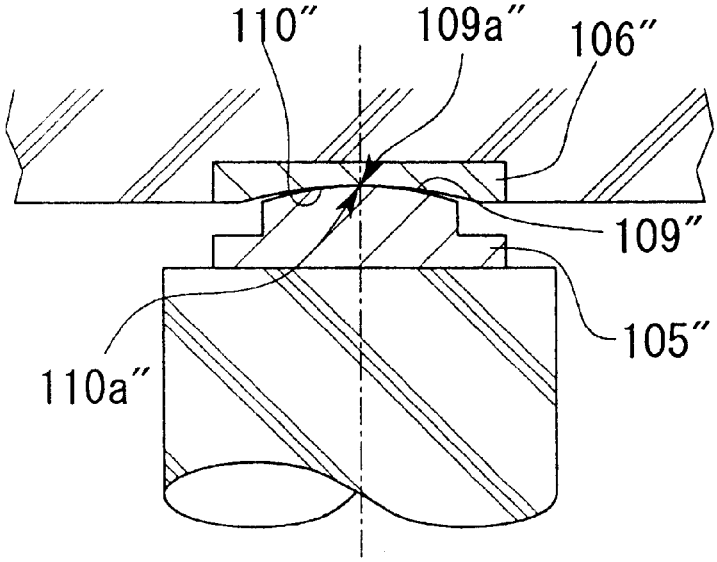
FIG. 19 is a vertical sectional figure showing, for the structure shown in FIGS. 16 and 18, the situation with the pile head member and the structural element support member in the event that the curvature of the concave surface does not fit the convex surface.
Figure 20:
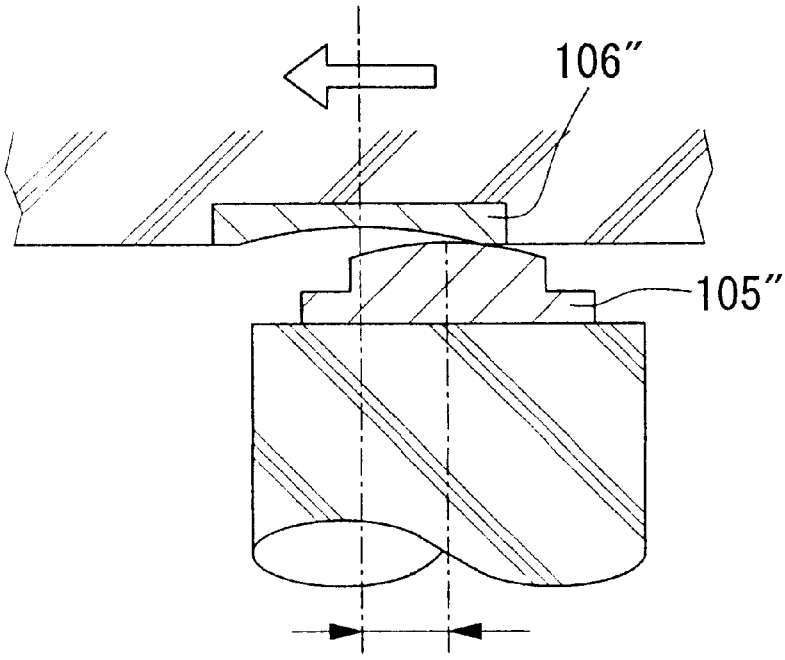
FIG. 20 is a vertical sectional figure showing, for the structure shown in FIG. 19, the situation when horizontal slippage has occurred between the pile head member and the structural element support member.

At this time, in particular, if as shown in FIG. 19 the radius of curvature of the concave surface 110" is greater as compared with that of the convex surface 109" and moreover no aperture portion 113 like the one of FIG. 17 is provided, then, since the convex surface 109" and the concave surface 110" only contact one another at the narrow region of their central portions 109*a*" and 110*a*", therefore the shearing force which can be transmitted between the convex surface 109" and the concave surface 110" becomes extremely small, and there is a fear that, as shown in FIG. 20, horizontal slippage may occur between the pile head member 105" and the structure support member 106" and that they may come apart; however, by applying a construction like the one which is shown in FIG. 17, even if for example the curvatures of the convex surface 109 and the concave surface 110 do not agree with one another, it is possible to obtain a circular shaped contact between the pile head member 105 and the structure support member 106 by the outer annular portion 112 of the concave surface 110 (the outer annular portion 117 of the convex surface 109). Accordingly, the shearing force which can be transmitted between the pile head member 105 and the structure support member 106 is increased, and thereby it becomes possible to ensure the safety of the building as a whole.

Figure 21:
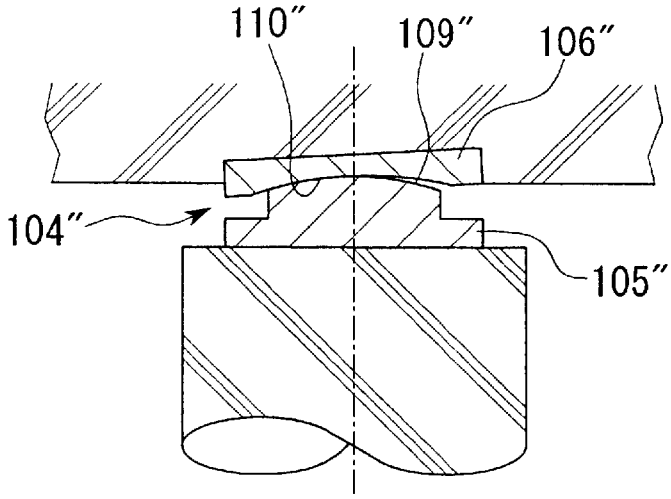
FIG. 21 is a vertical sectional figure showing, for the structure shown in FIG. 19, the situation when the structural element support member has been set up at an inclination.

Further, if the curvatures of the convex surface 109" and the concave surface 110" do not agree with one another, and moreover no aperture portion 113 like the one of FIG. 17 is provided, then, as shown in FIG. 21, when the stress transmission member 104" is being set up, the structure support member 106" can easily rotate, and accordingly it may easily occur that the structure support member 106" undesirably comes to be set up in a tilted orientation; however, with a construction like the one shown in FIG. 17, since it is possible to set the structure support member 106 upon the pile head member 105 stably because the contact between the pile head member 105 and the structure support member 106 at the outer annular portion 112 of the concave surface 110 (the outer annular portion 117 of the convex surface 109) is arranged to take place around an annular shape, and accordingly the stability during construction is good, and it is possible to ensure the accuracy of the construction process.

Yet further, since with the above described stress transmission device 104, along with the concave surface 110 being made up from the central portion 111 and the outer annular portion 112, the outer annular portion 112 is formed to have a surface the same as the imaginary spherical surface Sv and the central portion 111 is formed in a concave shape when the imaginary spherical surface Sv is taken as a reference, therefore only the outer annular portion 112 comes to contact against the convex surface 109, and due to this it is possible easily to implement an annular shaped contacting structure between the pile head member 105 and the structure support member 106, and it is possible to obtain the beneficial effects which are described above.

In this connection, since the central portion 111 is formed as the aperture portion 113, it is easily possible to form the central portion 111 in a concave shape with respect to the imaginary spherical surface Sv, so that it is possible to contact the pile head member 105 and the structure support member 106 together along an annular shaped contact surface by a simple process.

Moreover, with the above described stress transmission device 104, since the outer circumferential edge portion 114 of the convex surface 109 is formed as a curved surface whose radius of curvature r1 in vertical cross section is much smaller as compared with the radius of curvature of the imaginary spherical surface Sv, therefore it is possible to reduce the friction which is generated at this outer circumferential edge portion 114 of the convex surface 109.

Figure 22:
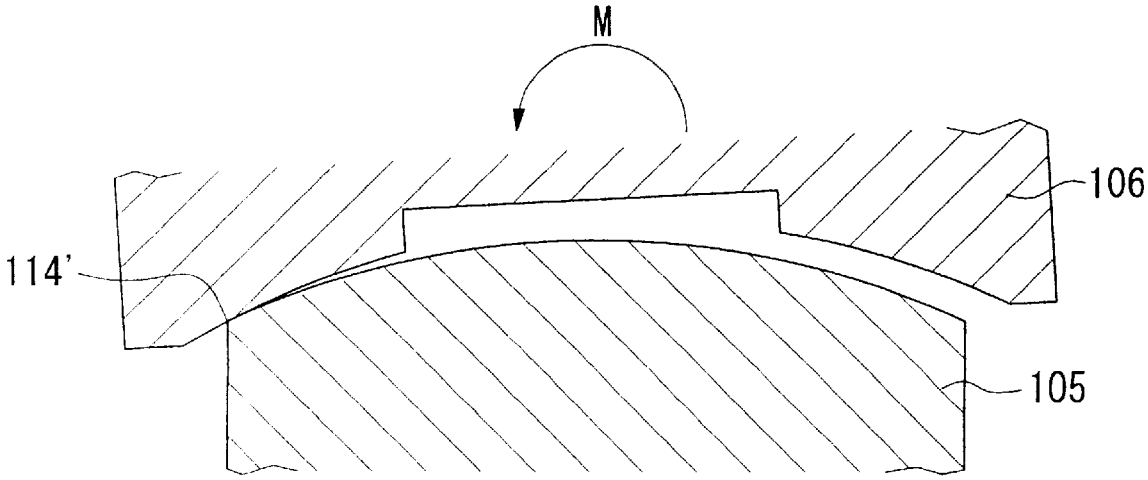
FIG. 22 is a vertical sectional figure for the contacting surfaces of the pile head member and the structural element support member shown in FIG. 15, for showing the behavior which may be imagined to occur in the structural element support member, under the hypothesis that the outer circumferential edge portion of the convex surface of the pile head member has not been processed into a curved surface.

As shown in FIG. 22, in a construction in which this outer circumferential edge portion 114" is not formed as a curved surface, when a bending moment M acts between the structure support member 106 and the pile head member 105, friction can easily be generated at the outer circumferential edge portion 114', and the structure support member 106 is raised up around this portion as a support point, and thereafter it may well be the case that the behavior may take place such as the generation of sliding in which friction stops and starts. However, with this embodiment of the present invention, by processing the outer circumferential edge portion 114 into a curved surface, it becomes possible to generate smooth slippage between these two members.

Figure 23:
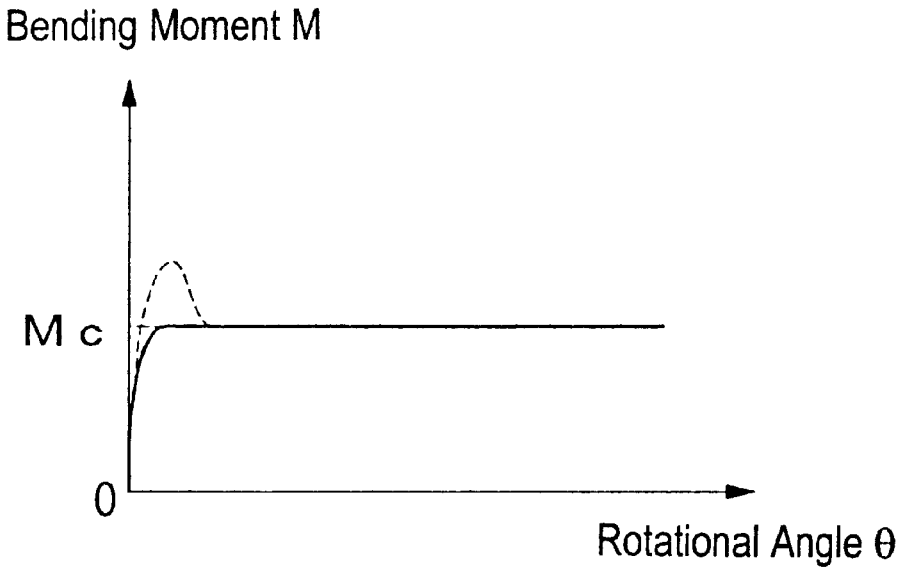
FIG. 23 is a graph for comparison of the relationships between the rotational angle (around a horizontal axis) between the pile head member and the structural element support member and the bending moment (around a vertical axis) transmitted between them both, in the cases that the outer circumferential edge portion of the convex surface of the pile head member has been, and has not been, processed into a curved surface.

In this case, the relationship between the rotational angle θ between the pile head member 105 and the structure support member 106 and the bending moment M which is transmitted between these two members is broadly the one shown in FIG. 23. As shown in FIG. 23, in the case (shown in this figure by the dashed line) that the outer circumferential edge portion 114 of the convex surface 109 is not processed into a curved surface, as the mutual rotational angle θ rises from zero, the bending moment M which acts between the pile head member 105 and the structure support member 106 initially rises to a peak, then drops down, and thereafter converges to a constant line Mc. On the other hand, in the case (shown in this figure by the solid line) that the outer circumferential edge portion 114 of the convex surface 109 is processed into a curved surface, this type of behavior does not take place, but as the mutual rotational angle θ rises, the behavior occurs that the bending moment M gradually approaches and converges to the constant line Mc. Accordingly, it is possible to repress the rise of the bending moment M which is required in the case that the pile head member 105 undergoes rotational displacement with respect to the structure support member 106, and it is possible to obtain a satisfactory rotational deformation performance for the stress transmission device 104.

Further, with the above described stress transmission device 104, since the surface of the convex surface 109 is formed into the minute concavities and convexities 116, and moreover the concave surface 110 is formed as smooth, therefore it is possible to reduce the contacting surface area between these two members, and due to this it is possible to reduce the frictional force which acts between them. Accordingly, it is possible further to reduce the bending moment M which is required when mutual rotational displacement takes place between the pile head member 105 and the structure support member 106, and it is possible to obtain a satisfactory rotational deformation performance for the stress transmission device 104.

Moreover, it would also be acceptable to utilize some other structure for the above described second preferred embodiment of the present invention, provided that it does not deviate from the scope of the gist of the present invention.

For example, in the shown example of the second embodiment described above, the aperture portion 113 was provided by being formed in the concave surface 110 only, but the present invention is not to be considered as being limited to this structure; alternatively, it would also be acceptable for the aperture portion 113 to be formed in the convex surface 109, or for aperture portions to be formed in both the concave surface 110 and the convex surface 109.

Further, the shapes of the pile head member 105 and of the structure support member 106 are not to be considered as being limited to the ones described above; as shown in FIG. 24, it would also be acceptable to form the central portion of the convex surface 109 of the pile head member 105 as a horizontal surface 119, while not providing any aperture portion in the concave surface 110 of the structure support member 106 but simply forming it as a unitary spherical surface. By doing this, by only a very simple process, it is possible to form the central portion of the convex surface 109 into a shape which, taking the imaginary spherical surface Sv as a reference, is concave, and thereby it is possible to implement a construction in which only the outer annular portion 117 of the convex surface 109 contacts against the concave surface 110, so that it is possible to obtain the same benefits as those described above.

Figure 24:
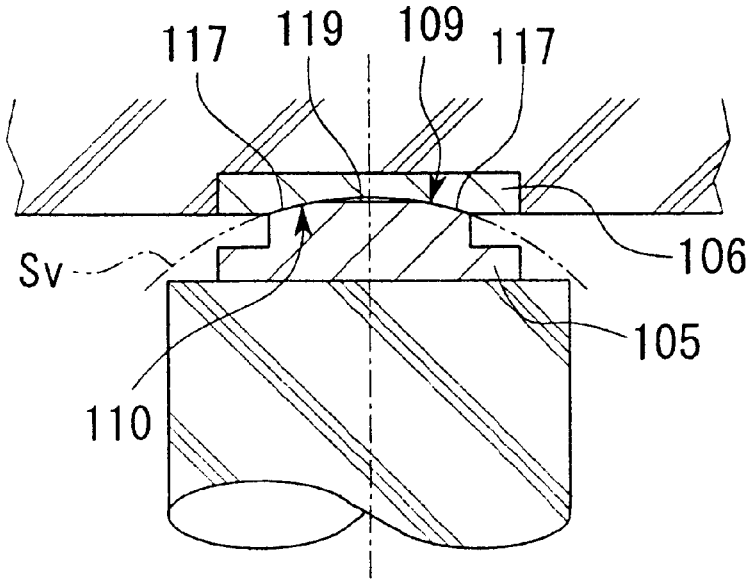
FIG. 24 is a vertical sectional figure showing in schematic form another example of a stress transmission device according to a variant of the second preferred embodiment of the present invention.

Further, with the second embodiment described above, and also with the variant thereof shown in FIG. 24, the convex surface 109 was formed upon the pile head member 105, and the concave surface 110 was formed upon the structure support member 106, but the present invention is not to be considered as being limited by this construction; it would also be acceptable, as an alternative, to form a concave surface upon the pile head member 105, to form a convex surface upon the structure support member 106, and mutually to contact these surfaces together.

Further, with the second embodiment described above, although the curvatures of the convex surface 109 and of the concave surface 110 were made to be the same, the present invention is not to be considered as being limited to this structure; it would also be possible, without departing from the principles of the present invention, for the radius of curvature of the concave surface 110 to be somewhat greater as compared with the radius of curvature of the convex surface 109.

Furthermore, the curvatures of the convex surface 109 and of the concave surface 110, and the diameter of the aperture portion 113, are not to be considered as being limited to the ones shown in the description of the above embodiment; it would be possible to determine upon suitable values for these parameters in consideration of the magnitudes of the axial force and the horizontal force acting upon the pile head 102*a*.

Further, with the second preferred embodiment described above, although the stress transmission device 104 was described in terms of its being applied to the building 101, the stress transmission device according to the present invention is not to be considered as being limited to that application; such a stress transmission device 104 could be applied to a civil engineering structure or the like, or indeed to any structure having a foundation pile and an upper structural portion.

Further, in another connection, it would also be possible to implement the present invention with a different structure, without departing from the gist of the present invention; and it is unnecessary to say that it would also be acceptable to use the above described variant examples in suitable selection and arrangement.

The Third Preferred Embodiment

Figure 29:
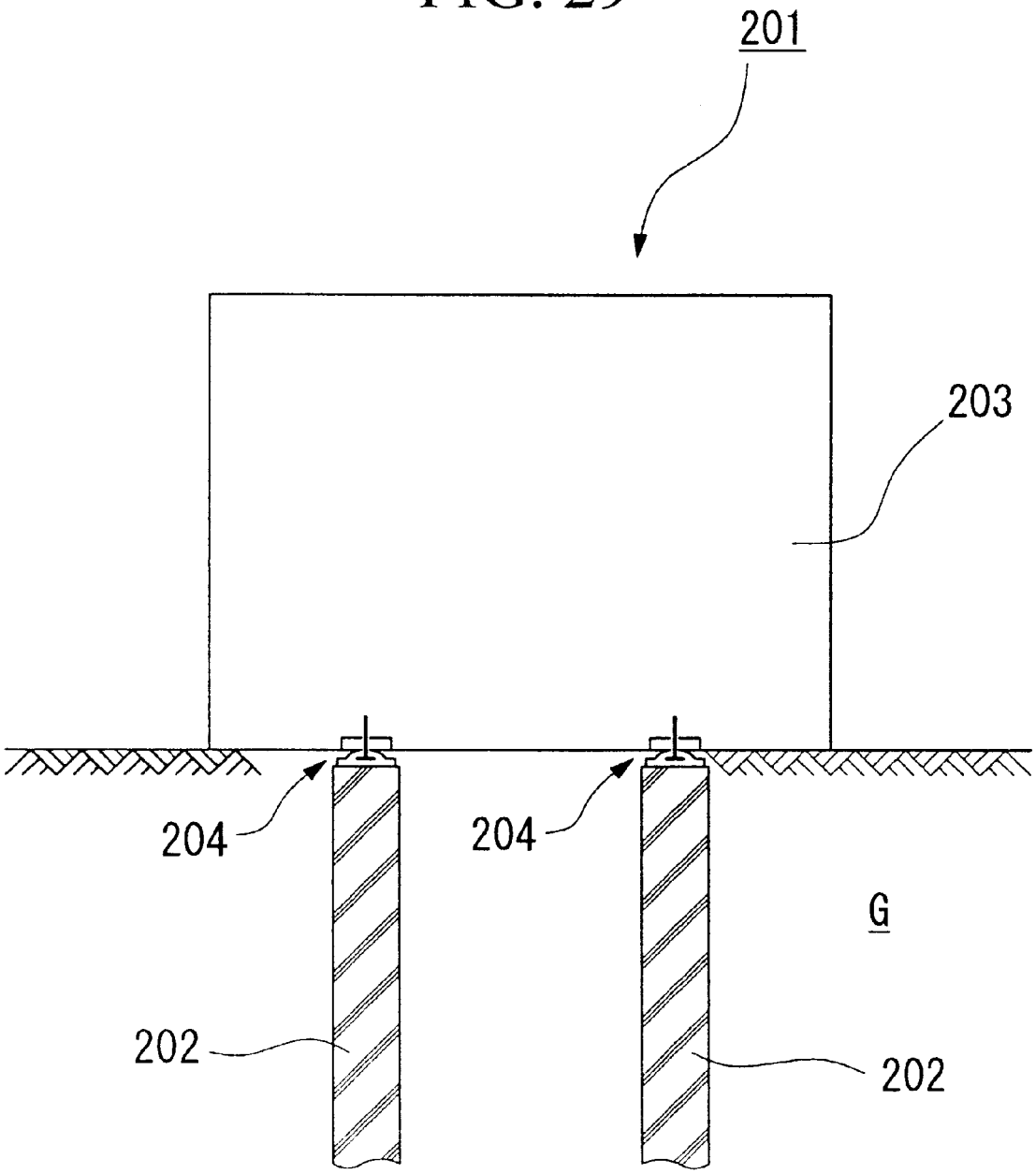
FIG. 29 is a vertical sectional figure showing in schematic form a building to which the stress transmission device shown in FIGS. 25 through 29 has been applied.

FIG. 29 is a vertical sectional figure showing in schematic form a third preferred embodiment of the present invention, and in this figure the reference numeral 201 denotes a building (a structure). This building 201 comprises foundation piles 202 which are emplaced within a ground slab G, and an upper structural portion 203 which is supported upon the foundation piles 202; and its construction incorporates stress transmission devices 204 for performing transmission of stress between the foundation piles 202 and the upper structural portion 203.

Figure 25:
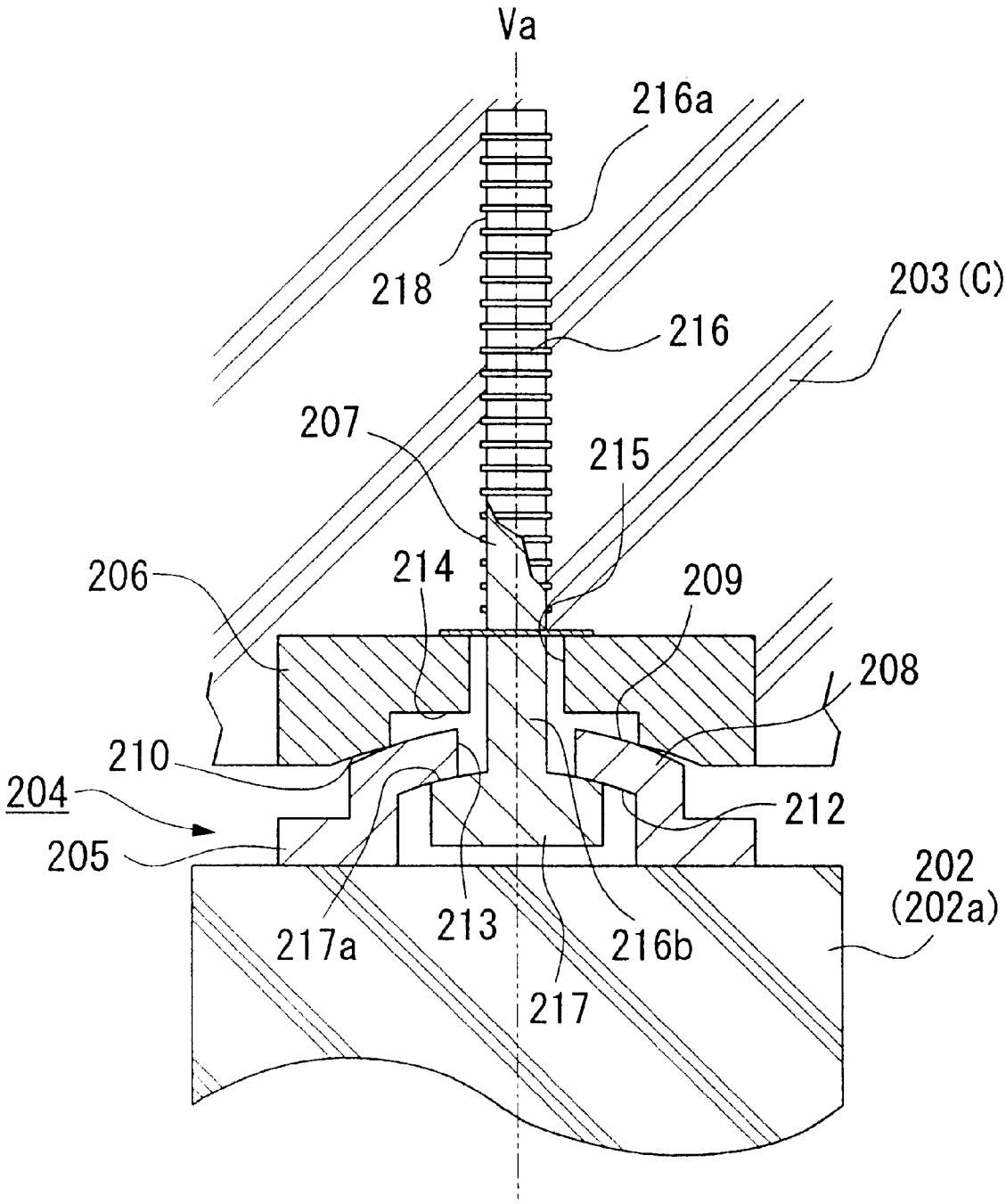
FIG. 25 is an enlarged vertical sectional figure showing in schematic form a stress transmission device according to a third preferred embodiment of the present invention.

FIG. 25 is an enlarged vertical sectional figure showing one of these stress transmission devices 204. As shown in this figure, the stress transmission device 204 broadly comprises a pile head member 205 which is provided on top of a pile head 202*a* of the foundation pile 202, a structure support member 206 which is fixed to the upper structural portion 203 in a position to oppose the pile head member 205, and a pulling out resistant member 207 which is fixed into this upper structural portion 203 and is arranged to project so as to oppose the foundation pile 202. This pile head member 205, structure support member 206, and pulling out resistant member 207 are all formed as axially symmetric around the vertical axis Va.

As shown in the figure, the pile head member 205 is formed with a convex spherical seat 208, and the outer surface 209 of this spherical seat 208 contacts against a concave surface 210 which is formed upon the structure support member 206. Further, the spherical seat 208 is formed as hollow, with an aperture portion 213 which pierces through from its outer surface 209 to its inner surface 212.

On the other hand, the structure support member 206 is formed with the central portion of its concave surface 210 being formed in a hollowed out shape so as to constitute a concave portion 214, and moreover a through hole 215 is provided in the central portion of this concave portion 214. Further, the curvature of the concave surface 210 is formed to be somewhat weaker than that of the outer convex surface 209 of the spherical seat 208.

The pulling out resistant member 207 comprises a main rod shaped portion 216 and a head portion 217 which is of greater diameter than the main portion 216 and is provided at the end of said main portion 216.

The upper end portion 216*a* of the main portion 216 is embedded within the upper structural portion 203, and moreover its lower end portion 216*b* is passed through the through hole 215 which is formed in the structure support member 206 and through the aperture portion 213 of the spherical seat 208. And the head portion 217 of the pulling out resistant member 207 is received in the inner portion of the spherical seat 208, with its upper surface 217*a* being formed to conform to the inner surface 212 of the spherical seat 208. And the curvature of this upper surface 217*a* of the head portion 217 of the pulling out resistant member 207 is formed to be approximately the same as the curvature of the inner surface 212 of the spherical seat 208. The diametrical dimension of the head portion 217 is made to be greater as compared with that of the aperture portion 213 of the spherical seat 208.

Further, as shown in the figure, concavities and convexities 218 are formed upon the upper end portion 216*a* of the main portion 216 of the pulling out resistant member 207, in order to ensure its fixing strength into the concrete C from which the upper structural portion 203 is formed.

Figure 26:
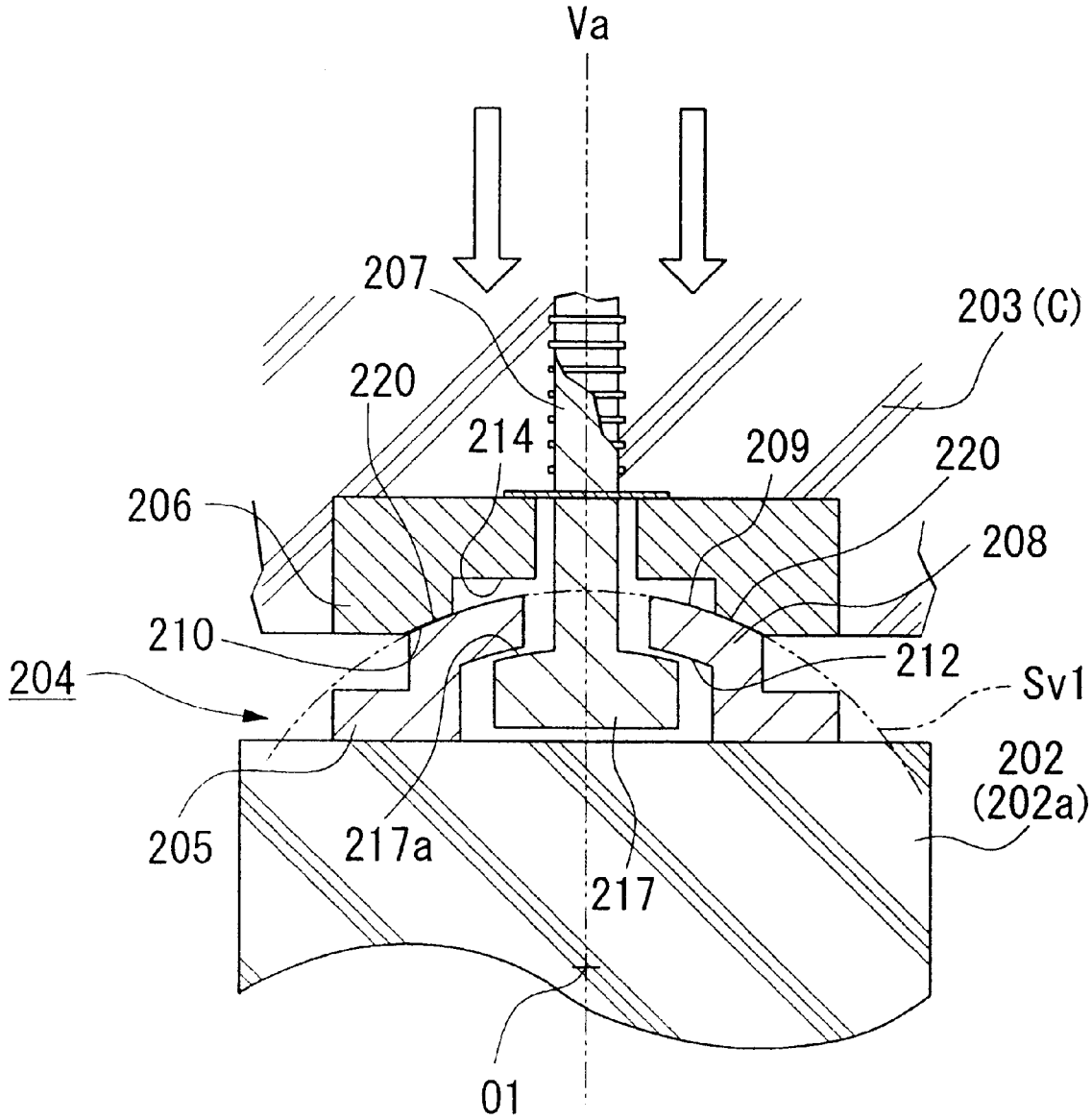
FIG. 26 is a vertical sectional figure showing the situation when the weight of an upper structural portion acts upon the stress transmission device shown in FIG. 25.

This stress transmission device 204 is for being set up in the building 201 in order to transmit the load of the upper structural portion 203 to the foundation pile 202, but it is deformed as shown in FIG. 26 by the action of the load of the upper structural portion 203. In this case, the spherical seat 208 is deformed in the downward direction, and the curvature of its outer surface 209 becomes somewhat weaker. Due to this, the mutual contact in the upward and downward direction between the outer surface 209 of the spherical seat 208 and the concave surface 210 of the structure support member 206 comes to define a portion of a first imaginary spherical surface Sv1 via a first contacting surface 220, as shown in the figure. Further, in this case, since the concave portion 214 is formed in the central portion of the concave surface 210, the first contacting surface 220 comes to be formed in an annular shape whose central axis is the vertical axis Va, which passes through the center of curvature O1 of the first imaginary spherical surface Sv1.

Yet further, in the case shown in FIG. 26, since the position of the upper structural portion 203 is displaced to some extent in the downward direction in accompaniment with the deformation of the spherical seat 208, thereby a gap is opened up between the upper surface 217*a* of the head portion 217 of the pulling out resistant member 207 and the inner surface 212 of the spherical seat 208.

Figure 27:
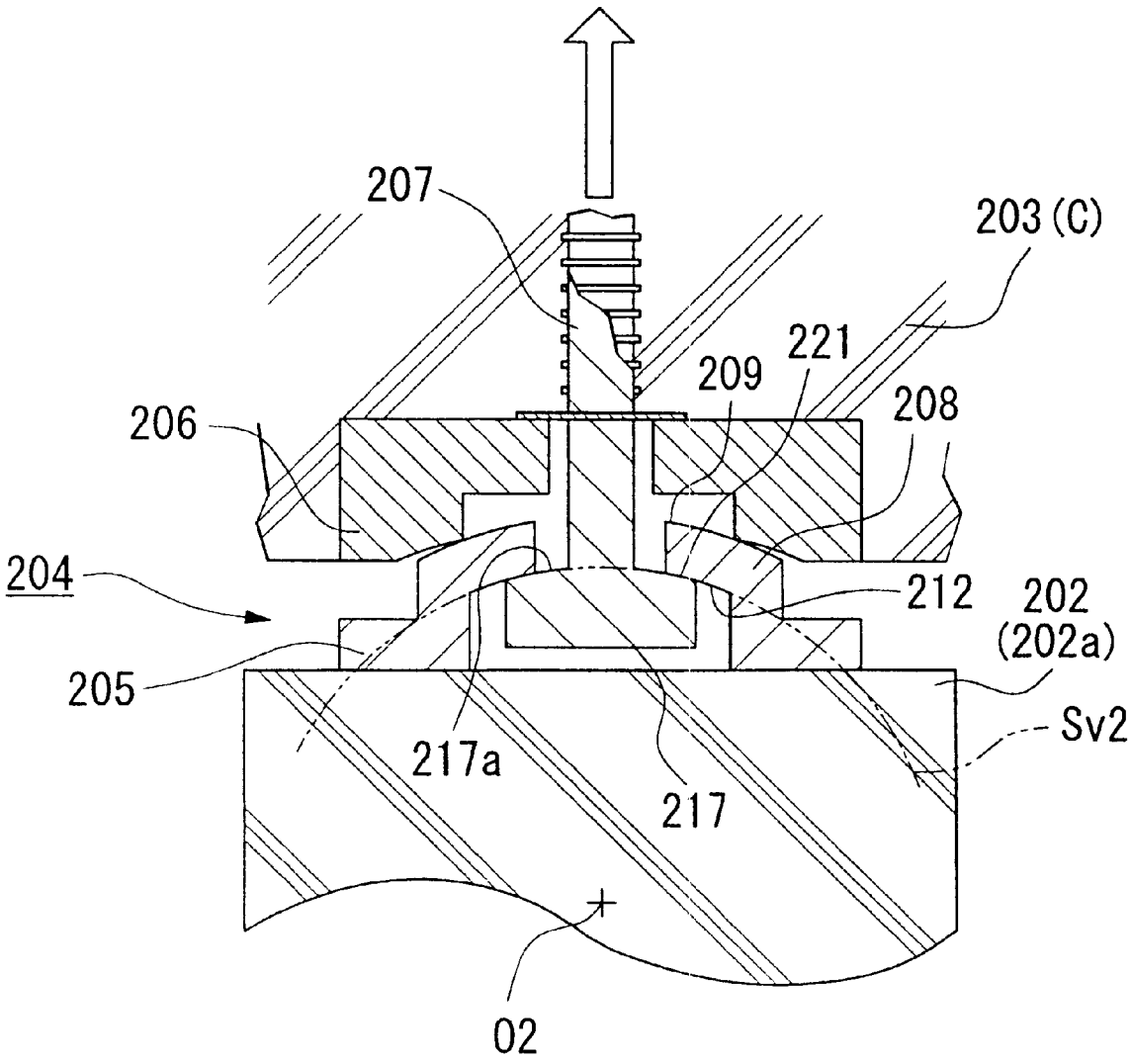
FIG. 27 is a vertical sectional figure showing the situation when a pulling force acts upon the stress transmission device shown in FIG. 25.

Further, in the event of an earthquake, although it is to be anticipated that the phenomenon of rising up of the upper structural portion 203 will take place due to the action of acceleration in the upward direction, at this time the stress transmission device 204 will come to be in a state like the one shown in FIG. 27.

FIG. 27 shows the state of the structure with the upper structural portion 203 somewhat separated from the foundation pile 202. At this time, the upper structural portion 203 is prevented from rising further upwards by the engagement of the head portion 217 of the pulling out resistant member 207 which is fixed to the upper structural portion 203 against the inner surface 212 of the spherical seat 208. Further, since the curvature of the upper surface 217*a* of the head portion 217 of the pulling out resistant member 207 agrees with the curvature of the inner surface 212 of the spherical seat 208, thereby the contact between the pulling out resistant member 207 and the spherical seat 208 via the second contacting spherical surface 221 comes to define a portion of the second imaginary spherical surface Sv2, as shown in the figure. It should be noted that the center of curvature O2 of the second imaginary spherical surface Sv2 is set to agree with the center of curvature O1 of the first imaginary spherical surface Sv1 shown in FIG. 26.

Figure 28:
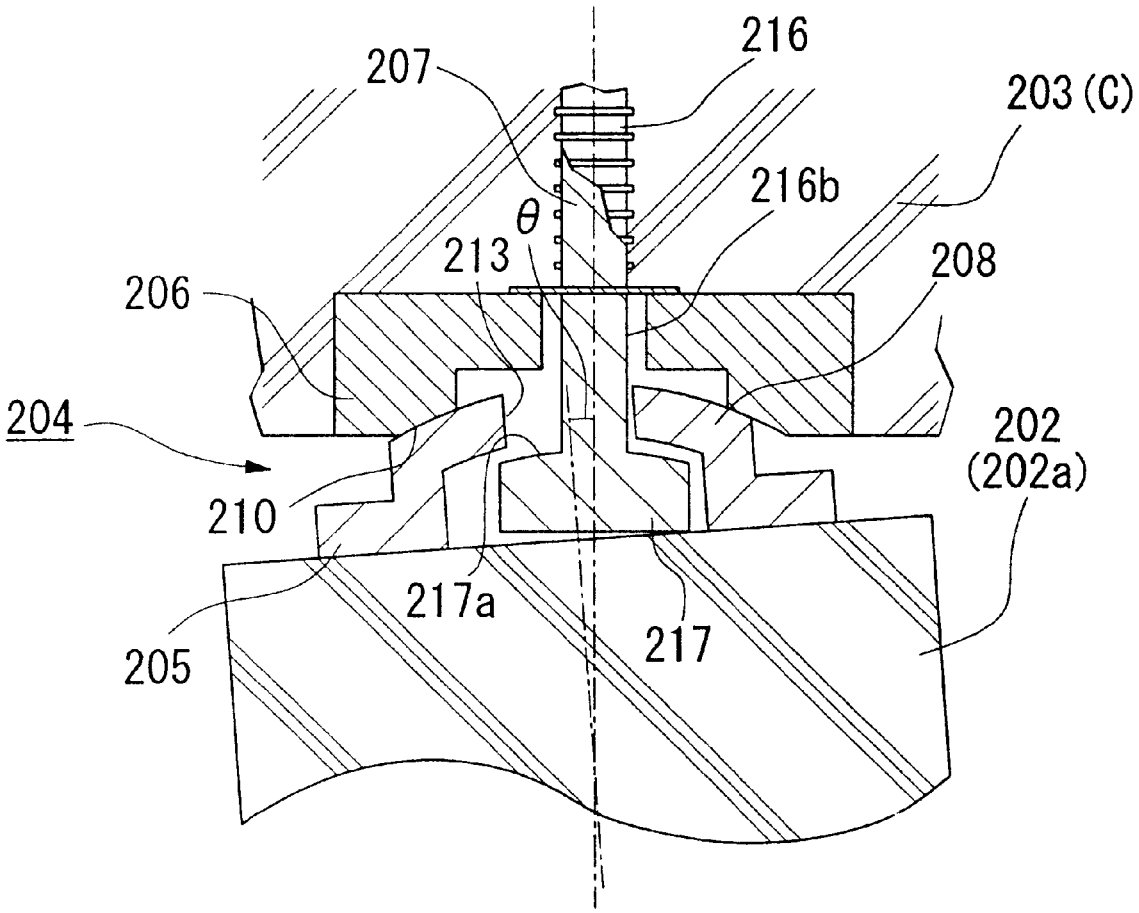
FIG. 28 is a vertical sectional figure showing the situation when, with the stress transmission device shown in FIG. 25, a relative displacement has occurred between a pile head member and a structural element support member.

Further, as shown in FIG. 28, the dimensions of the aperture portion 213 formed in the spherical seat 208 are determined to be great enough that the main portion 216 of the pulling out resistant member 207 does not come into contact with the inner surface of the aperture portion 213, even when the foundation pile 202 and the upper structural portion 203 have been subjected to a mutual angular displacement through the maximum rotational angle θ which it is anticipated will take place between the foundation pile 202 and the upper structural portion 203.

The operation of this third preferred embodiment will now be explained.

As described above, with this stress transmission device 204, when a load acts from the upper structural portion 203 (when the axial force which acts upon this stress transmission device 204 is a compression force), then the pile head member 205 and the structure support member 206 contact one another via the first contacting surface 220 which describes a portion of the first imaginary spherical surface Sv1, while on the other hand, when a pulling force acts from the upper structural portion 203 (when the axial force which acts upon this stress transmission device 204 is a pulling force), then the pile head member 205 and the structure support member 206 contact one another via the second contacting surface 221 which describes a portion of the second imaginary spherical surface Sv2. Accordingly, when during an earthquake a horizontal force acts upon the upper structural portion 203, if the axial force which acts upon the stress transmission device 204 is a compression force, the pile head member 205 and the structure support member 206 undergo mutual relative displacement along the first imaginary spherical surface Sv1. On the other hand, if the axial force which acts upon the stress transmission device 204 is a pulling force, the pile head member 205 and the structure support member 206 undergo mutual relative displacement along the second imaginary spherical surface Sv2. Now, since the centers of curvature O1 and O2 of the first and second imaginary spherical surfaces Sv1 and Sv2 are coincident, no problem arises even if the axial force changes its sense during rotation, and it is possible for the pile head member 205 and the structure support member 206 to perform mutual relative displacement in a smooth fashion. Due to this, along with preventing the upper structural portion 203 from coming off, it is possible to assure the rotational deformation capacity for the connecting structure between the pile head 202*a* and the upper structural portion 203, and it is possible to ensure that the bending moment which is transmitted between the upper structural portion 203 and the foundation pile 202 does not become excessive.

Furthermore, since the structure support member 206 and the pulling out resistant member 207 are arranged in such a configuration as to sandwich between them the spherical seat 208 of the pile head member 205 by its inner surface 212 and its outer surface 209, thereby, even when a horizontal force acts, it is possible for the structure support member 206 and the pulling out resistant member 207 to prevent the structure support member 206 from raising up upon the spherical seat 208. Accordingly, provided that the pulling out resistant member 207 does not break, it is possible reliably to transmit shearing force, even in the case that the axial force is so small that the transmission of shearing force is difficult.

Further since, by forming the concave portion 214 in the concave surface 210 of the structure support member 206, the first contacting surface 220 is formed in an annular shape around, as a central axis, the vertical axis Va which passes through the center of curvature O1 of the first imaginary spherical surface Sv1, thereby it is possible to make the inclination of the first contacting surface 220 greater, as compared with the case in which predetermined regions of the pile head member 205 and the structure support member 206 in the vicinity of the vertical axis Va contact one another upon the first imaginary spherical surface Sv1 as a contacting surface.

Figure 31:
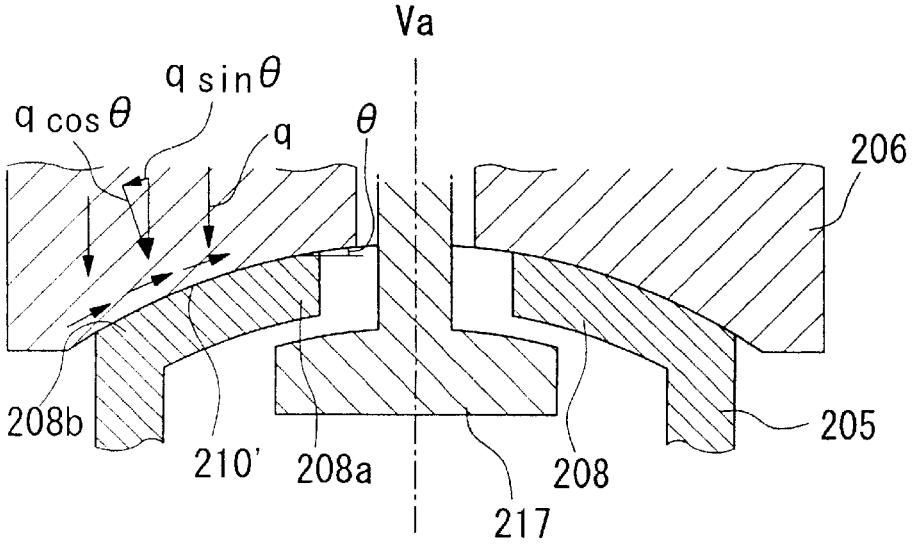
FIG. 31 is a vertical sectional figure showing for explanation of the frictional force which acts upon this first contacting surface, under the hypothesis that no aperture portion has been provided in the concave surface of the structural element support member.

In the case when as shown in FIG. 31 no concave portion 214 has been formed in the concave surface 210', then the axial force q which is transmitted from the upper structural portion 203 comes to be supported over a wide region on the spherical seat 208, from its central portion 208*a* which is comparatively near to being planar to its outer edge portion 208*b*. In this case, if as shown in the figure the angle of the concave surface 210' from a horizontal plane is termed θ, the component in the normal direction of the axial force q which acts upon the contacting surface between the concave surface 210' and the spherical seat 208 is equal to q·cos θ, and accordingly the friction between the spherical seat 208 and the concave surface 210', which constitutes the resistance when the structure support member 206 slides along the pile head member 205, can be expressed as $\mu q \cdot \cos\theta$, where $\mu$ is the coefficient of friction between the contacting surfaces. Further, since the angle θ is small in the vicinity of the central portion 208*a* of the spherical seat 208, therefore the frictional force between the spherical seat 208 and the concave surface 210' is almost equal to $\mu q$.

Figure 30:
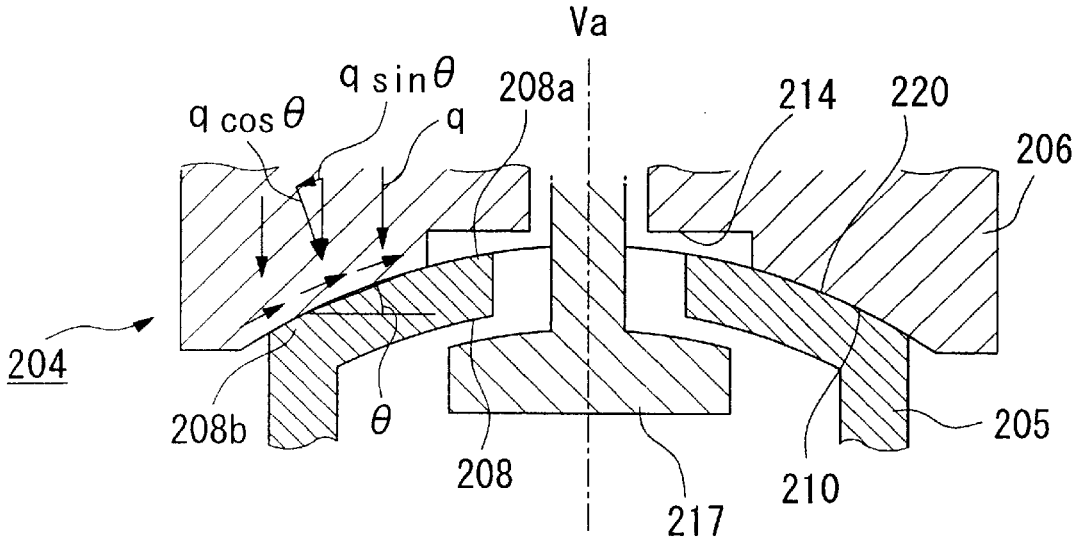
FIG. 30 is a vertical sectional figure for explanation of the frictional force which acts upon a first contacting surface shown in FIG. 26.

By contrast to the above case, with the stress transmission device 204 shown in FIG. 30, the axial force q comes to be supported mainly by the outer annular portion 208*b* of the spherical seat 208, whose angle of inclination θ is quite steep. Accordingly in this case cos θ is smaller, and, if the same axial force q acts, the frictional resistance becomes smaller as compared with the case shown in FIG. 31, and as a result it becomes possible to generate rotation between the spherical seat 208 and the concave surface 210 with a smaller bending moment.

Moreover, since with the construction of the stress transmission device 204 shown in FIG. 30 the component q·sin θ of the axial force q which generates rotation becomes large as compared with the case shown in FIG. 31, therefore because of this it is possible to restrain to a small value the bending moment which is required when the spherical seat 208 and the concave surface 210 undergo relative displacement.

By doing this, it becomes possible easily to enable relative displacement between the pile head member 205 and the structure support member 206 along the first imaginary spherical surface Sv1.

Further, in this case, since it is possible to make the inclination of the first contacting surface 220 great, along with increasing the component of the axial force q acting between the foundation pile 202 and the upper structural portion 203 which resists against horizontal slippage between the pile head member 205 and the structure support member 206, it also becomes possible to reduce the component of the horizontal force which acts between the foundation pile 202 and the upper structural portion 203 which tends to produce horizontal slippage.

Figure 32:
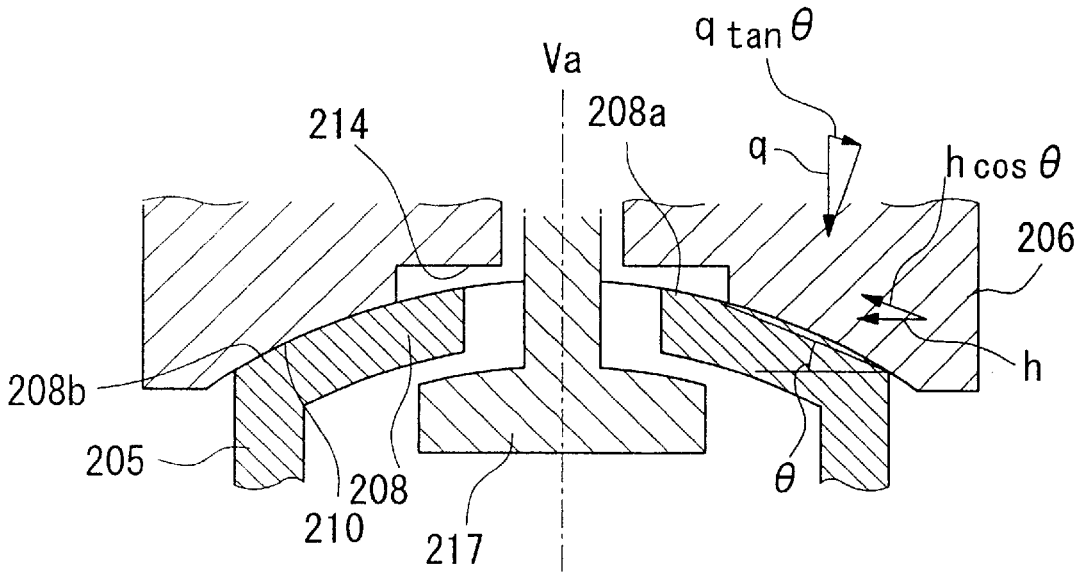
FIG. 32 is a vertical sectional figure for explanation of the force which resists a horizontal force which acts between the pile head member and the structural element support member, for the first contacting surface shown in FIG. 26.
Figure 33:
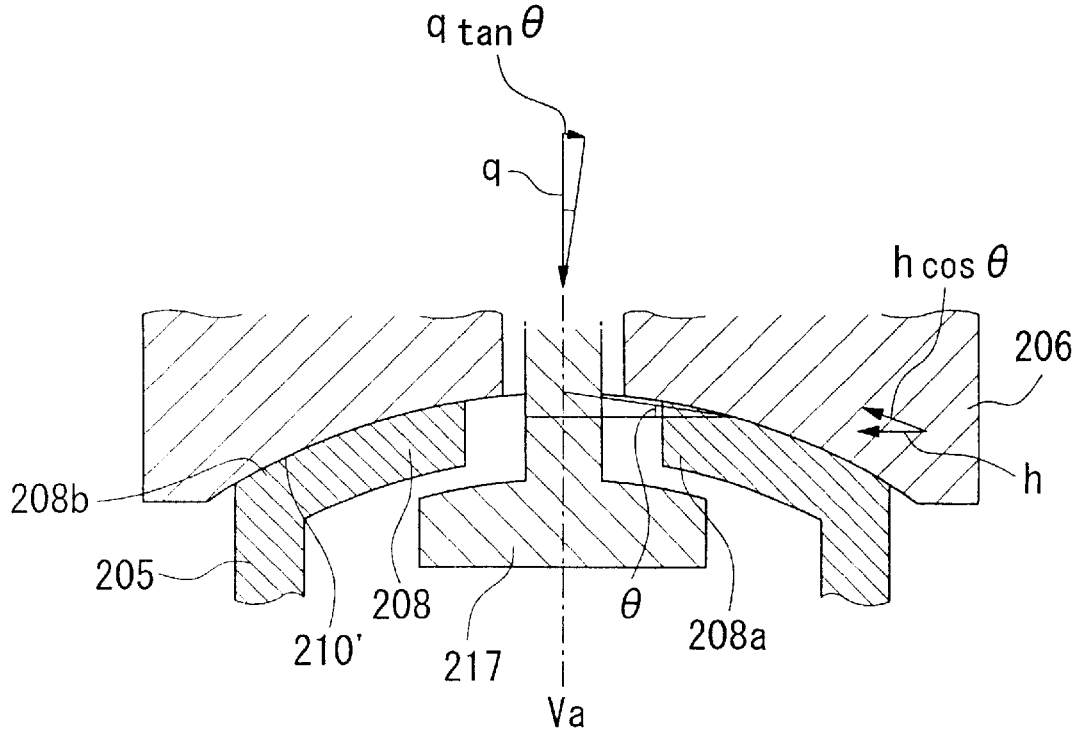
FIG. 33 is a vertical sectional figure for explanation of the force which resists a horizontal force which acts between the pile head member and the structural element support member in FIG. 32, for the contacting surfaces, under the hypothesis that no aperture portion has been provided in the concave surface of the structural element support member.

That is to say, as shown in FIG. 33, as compared with the case in which axial force is transmitted from the concave surface 210' in the vicinity of the head portion 208*a* of the spherical seat 208, in the case that the concave portion 214 is provided in the concave surface 210' as shown in FIG. 32, since the inclination θ of the contacting surface is comparatively large as compared with the case of FIG. 33, therefore on the one hand the component h·cos θ of the horizontal force h which tends to generate horizontal slippage becomes small, and also the component q·tan θ of the axial force q which resists against horizontal slippage becomes large. Due to this, it becomes possible to increase the shearing force which can be transmitted between the pile head member 205 and the structure support member 206.

Due to this, it becomes possible to increase the shearing force which can be transmitted between the pile head member 205 and the structure support member 206, and it is possible to ensure the safety of the building as a whole.

With the above described stress transmission device 204 and building 201, the pile head member 205 and structure support member 206 mutually contact one another in the upwards and downwards direction via the first contacting surface 220 which defines a portion of the first imaginary spherical surface Sv1. And, if the upper structural portion 203 becomes displaced in the direction to separate it from the foundation pile 202, then the pulling out resistant member 207 not only is stopped against the pile head member 205, but also comes to contact against the pile head member 205 via the second contacting surface 221 which defines a portion of the second imaginary spherical surface Sv2. And the centers of curvature of the first and second imaginary spherical surfaces Sv1 and Sv2 mutually coincide. Due to this, there is no problem even if the axial force varies during rotation, and it is possible for the pile head member 205 and the structure support member 206 to undergo relative displacement smoothly. Thereby, along with preventing the pulling up of the upper structural portion 203, it is possible to ensure the rotational deformation capacity for the pile head 202, and to suppress the bending moment which is transmitted between the upper structural portion 203 and the foundation pile 202, whereby it is possible to preserve the stability of the building 201 as a whole.

Further since, according to the above described stress transmission device 204 and building 201, the first contacting surface 220 is formed in an annular shape which takes as its central axis the vertical axis Va which passes through the center of curvature O1 of the first imaginary spherical surface Sv1, thereby it is possible to increase the inclination of the contacting surface, by comparison with the case in which the pile head member 205 and the structure support member 206 contact one another upon a predetermined region within the first imaginary spherical surface Sv1 in the vicinity of the vertical axis Va as a contacting surface, and accordingly, along with increasing the ease of relative displacement between the pile head member 205 and the structure support member 206 along the first imaginary spherical surface Sv1, it increases the shearing force which it is possible to transmit between the pile head member 205 and the structure support member 206, whereby it becomes possible to ensure the safety of the building 201 as a whole.

Furthermore, with the above described stress transmission device 204 and building 201, in the pile head member 205, the spherical seat 208 is provided so that its outer surface 209 and inner surface 212 define surfaces the same as the first and second imaginary spherical surfaces Sv1 and Sv2, and the first contacting surface 220 is formed by mutually contacting together the outer surface 209 of the spherical seat 208 and the concave surface 210 which is provided upon the structure support member 206, and also the second contacting surface 221 is formed by mutually contacting together the inner surface 212 of the spherical seat 208 and the head portion 217 of the pulling out resistant member 207. Due to this, by a simple construction, the structure support member 206 and the pulling out resistant member 207 can be arranged to contact against the pile head member 205 upon the first and second imaginary spherical surfaces Sv1 and Sv2 which have the same center of curvature.

Further since, with the above described stress transmission device 204 and building 201, the central portion of the concave surface 210 of the structure support member 206 is made as the concave portion 214, thereby this central portion of the concave surface 210 does not contact against the spherical seat 208, and only the outer edge portion of the outer side of the central portion contacts against the spherical seat 208. Due to this, by a simple process, the central portion of the concave surface 210 is prevented from contacting against the spherical seat 208, and it becomes possible to increase the inclination of th contacting surface between the concave surface 210 and the spherical seat 208.

Yet further in this case, since the through hole 215 is formed in the central portion of the concave surface 210 for the insertion of the pulling out resistant member 207, thereby, in the state in which the pulling out resistant member 207 is directly fixed to the upper structural portion 203, it projects towards the foundation pile 202 from the central portion of the concave surface 210, and its head portion 217 can be received within the interior portion of the spherical seat 208. Due to this, it is possible to provide the pulling out resistant member 207 so that it is well held.

Further, with the above described stress transmission device 204 and building 201 which employs it, since the dimensions of the aperture portion 213 are determined to be sufficiently large for the main portion 216 of the pulling out resistant member 207 and the inner surface of the aperture portion 213 not to come into contact with one another when the pulling out resistant member 207 is angularly displaced through the maximum rotational angle θ which is anticipated ever to take place between the foundation pile 202 and the upper structural portion 203, thereby it becomes possible to avoid deterioration of the deformation performance of the stress transmission device 204 accompanying the provision of the pulling out resistant member 207.

Yet further, with the above described stress transmission device 204 and building 201 which employs it, since the concavities and convexities 218 are provided upon the main portion 216 of the pulling out resistant member 207 for securing its fixing force into the concrete C from which the upper structural portion 203 is manufactured, thereby it is possible to fix the pulling out resistant member 207 strongly with respect to the upper structural portion 203, and it is possible to ensure its performance for preventing the upper structural portion 203 from coming up and away.

Even yet further, since in the above described building 201 the construction is such that a gap opens up between the head portion 217 of the pulling out resistant member 207 and the inner surface of the spherical seat 208 when the load of the upper structural portion 203 acts upon the stress transmission device 204 as a compressive force, therefore no frictional force is generated between the pulling out resistant member 207 and the spherical seat 208, as long as no pulling upward force acts upon the upper structural portion 203. Accordingly, in this type of case, satisfactory relative displacement becomes possible between the pile head member 205 and the structure support member 206, and it is possible to ensure the benefit of reduction of the bending moment which is transmitted by the stress transmission device 204.

It should be noted that, in the third preferred embodiment of the present invention which has been described above by way of example, it would be acceptable to use other structures for the stress transmission device 204, and for the building 201 to which it is applied, provided that no deviation from the principles of the present invention is undergone.

For example, the construction of the stress transmission device is not to be considered as being limited to that shown in FIGS. 25 through 28 and described above; the structure shown in FIGS. 34 through 36 would also be acceptable.

Figure 34:
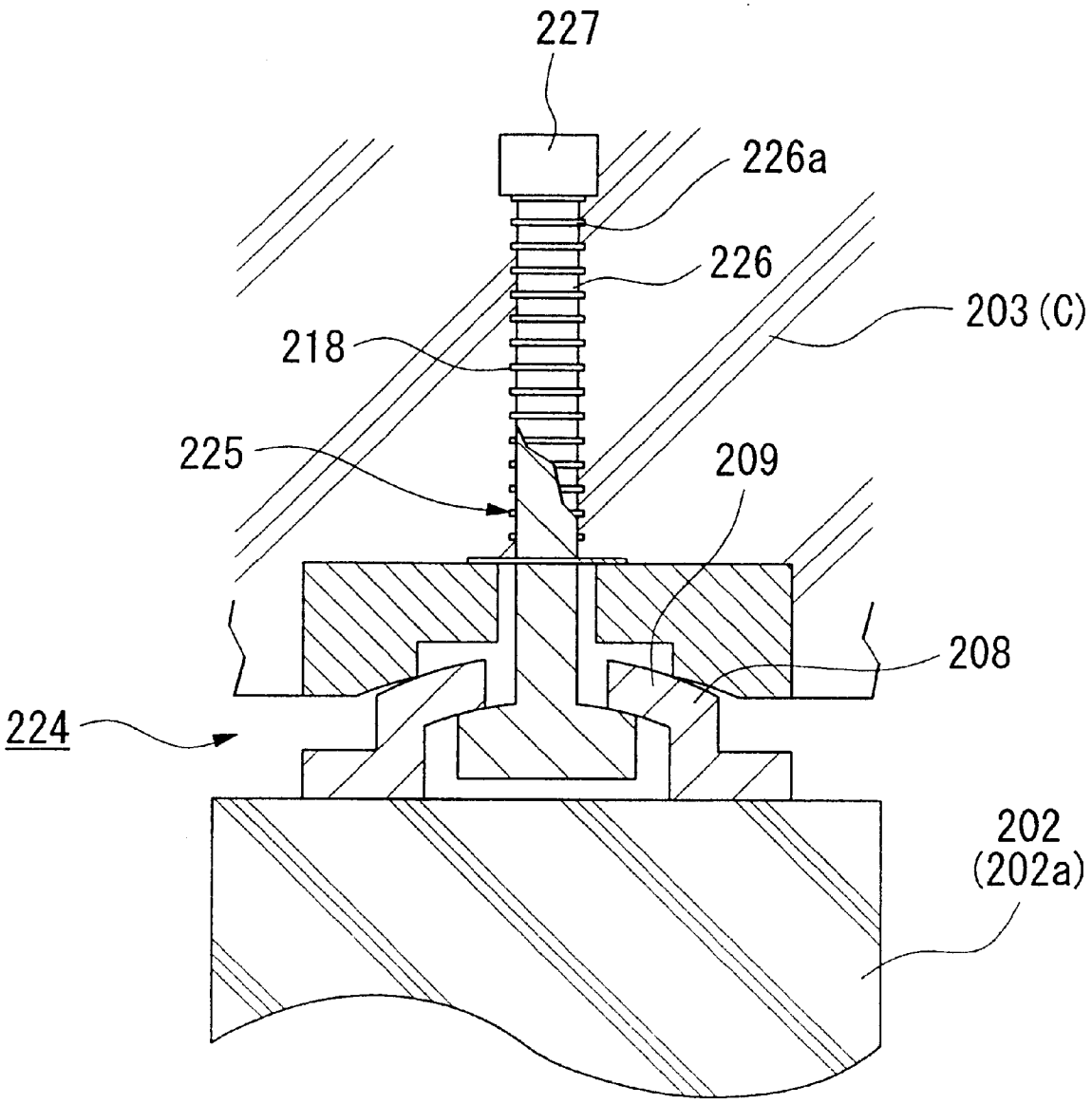
FIG. 34 is an enlarged vertical sectional figure showing in schematic form another example of a stress transmission device according to the third preferred embodiment of the present invention.

The stress transmission device 224 shown in FIG. 34 is of almost the same construction as that of the stress transmission device 204 which was shown in FIGS. 25 through 28, and only the structure of the upper end portion 226*a* of the main portion 226 of its pulling out resistant member 225 is different from that in that stress transmission device 204. In this pulling out resistant member 226, at the upper end portion 226*a* of the main portion 226 which is embedded in the upper structural portion 203 there is provided an enlarged portion 227 which is of a greater diametrical dimension as compared to the other portions of the main portion 226. Due to this, it is possible to ensure the force which resists against pulling the pulling out resistant member 225 out from the upper structural portion 203, and, in comparison with the pulling out resistance member 207 which was shown in FIGS. 25 through 28, it is possible to shorten the length of the fixing portion within the upper structural portion 203, and it is possible to enhance the mountability of the stress transmission device 224.

Figure 35:
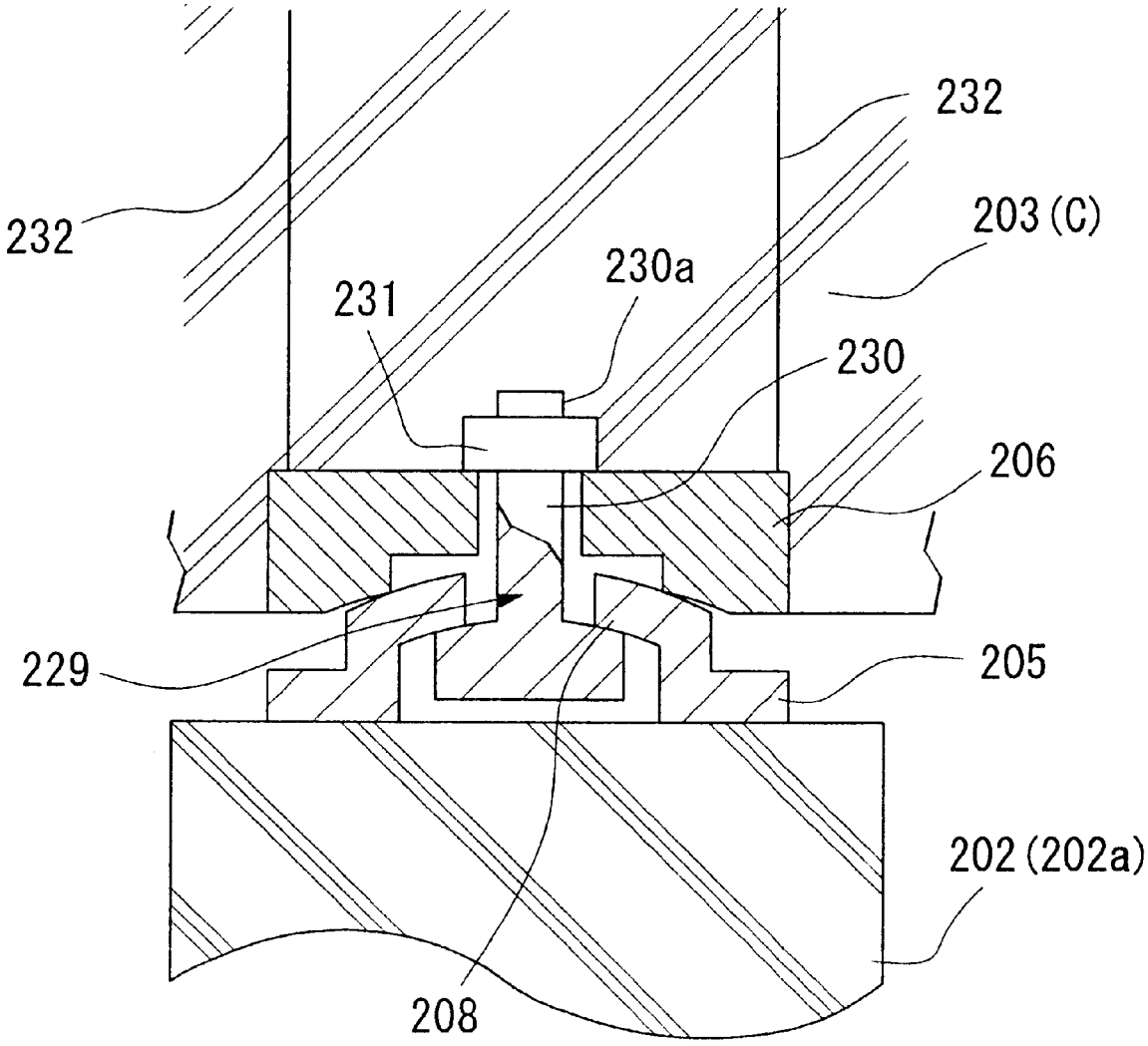
FIG. 35 is an enlarged vertical sectional figure showing in schematic form yet another example of a stress transmission device according to the third preferred embodiment of the present invention.

Further, as another possible structure for the stress transmission device, the one shown in FIG. 35 may also be employed, in which a nut (a radially expanded portion) 231 is provided at the upper end portion 230*a* of the main portion 230 of the pulling out resistant member 229, and the upper end portion 230*a* of the main portion 230 is fixed with respect to the structure support member 206 via this nut 231. In this case, if a fixed iron bar 232 is provided to the structure support member 206 so as to project in the upwards direction, then it is possible to fix the pulling out resistant member 229 strongly to the upper structural portion 203 via the structure support member 206. Further, here, it would also be acceptable to provide a wedge instead of the nut 231, or directly to weld the upper end portion 230*a* of the main portion 230 of the pulling out resistant member 229 to the structure support member 206.

Figure 36:
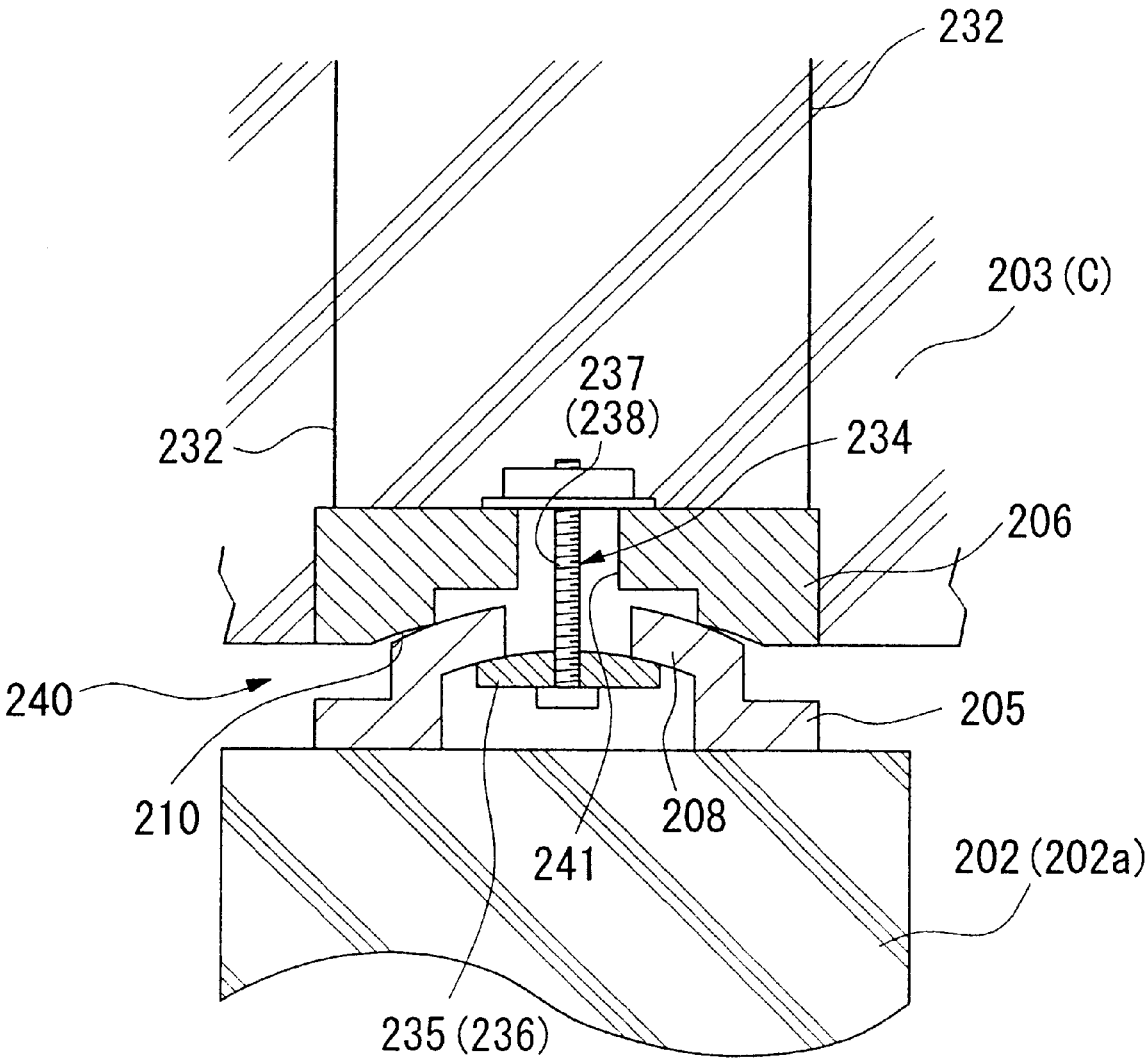
FIG. 36 is an enlarged vertical sectional figure showing in schematic form still yet another example of a stress transmission device according to the third preferred embodiment of the present invention.

Further, as shown in FIG. 36, as another alternative, it would also be possible to use a curved surface metallic seat washer 236 as a head portion 235 of a pulling out prevention member 234, and to form the head portion 235 and the main portion 237 of the pulling out prevention member 234 as being mutually separable. In this case, it is possible to make the head portion 235 and the main portion 237 of the pulling out prevention member 234 from different materials, and accordingly it is possible to use a high tension bolt 238 for the main portion 237 of the pulling out prevention member 234. By doing this, the force which sandwiches the spherical seat 208 between the pulling out resistant member 234 and the structure support member 206 in the upward and downward direction can be increased, and it is possible reliably to transmit shearing force from the upper structural portion 203 to the foundation pile 202, without any dependence upon the magnitude of the axial force which acts upon this stress transmission device 240. Further, in FIG. 36, it would be acceptable, along with forming the diametrical dimension of the through hole 241 in the structure support member 206 through which the high tension bolt 238 passes to be the same as the diametrical dimension of the high tension bolt 238, to cut a screw thread upon the inner surface of this through hole 241, so that the high tension bolt 238 can be screwingly engaged into this through hole 241. By doing this, it becomes possible even more securely to fix the high tension bolt 238 to the structure support member 206.

Further, although with the above described embodiment and with the variations thereof shown in FIGS. 34 through 36 the construction was such that the spherical seat 208 was formed upon the pile head member 205 and the concave surface 210 was formed upon the structure support member 206 and the pulling out prevention (resistant) members 207, 225, 229, and 234 were fixed to the upper structural portion 203, this is not to be considered as being limitative of the present invention; by contrast, it would also be possible for the concave surface 210 to be formed upon the pile head member 205 with the spherical seat being formed upon the structure support member 206, and for the pulling out prevention (resistant) members 207, 225, 229, and 234 were fixed to the foundation pile 202.

Figure 37:
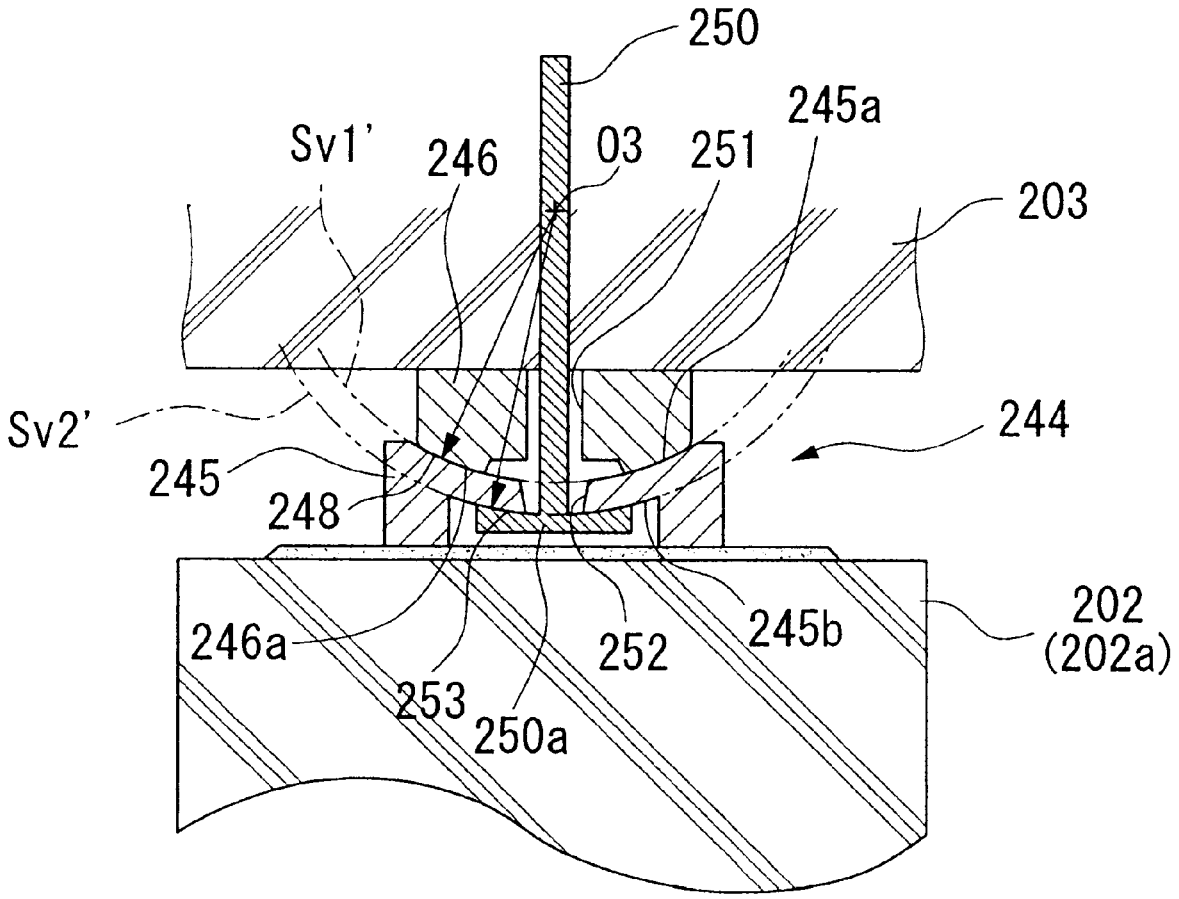
FIG. 37 is an enlarged vertical sectional figure showing in schematic form still yet a further example of a stress transmission device according to the third preferred embodiment of the present invention.

Yet further, it would also be possible to employ a stress transmission device 244 like the one shown in FIG. 37. In this stress transmission device 244, the outer surface 245*a* of the pile head member 245 which is fixed to the pile head 202*a* of the foundation pile 202 is formed as a concavity, and the lower surface 246*a* of the structure support member 246 which is fixed to the upper structural portion 203 is formed as a spherical seat 247, and this outer surface 245*a* of the pile head member 244 and the lower surface 246*a* of the structure support member 246 are mutually contacted together, so as to define a first contacting surface 248. Moreover, in this stress transmission device 244 along with the upper end portion of the pulling out resistant member 250 being fixed to the upper structural portion 203, the pulling out resistant member 250 is passed through a through hole 251 which is provided as pierced through the structure support member 246 and through an aperture portion 252 which is pierced through the outer surface 245*a* and the inner surface 245*b* of the pile head member 245; and, furthermore, the lower end portion 250*a* of the pulling out resistant member 250 is formed with a second contacting surface 253 which contacts against the inner surface 245*b* of the pile head member 245.

And the outer surface 245*a* and the inner surface 246*a* of the pile head member 244 are formed so as to define surfaces which are the same as first and second imaginary surfaces Sv1' and Sv2' which have the same center of curvature O3, and thereby the first and second contacting surfaces 248 and 253 come to define surfaces which are the same as these first and second imaginary spherical surfaces Sv1' and Sv2'.

Even employing this type of construction, when slippage occurs between the pile head member 245 and the structure support member 246 along the first imaginary spherical surface Sv1', the pulling out resistant member 250 can be displaced with respect to the pile head member 245 along the second imaginary spherical surface Sv2' which has the same center of curvature O3 as the first imaginary spherical surface Sv1', and accordingly, even if the axial force upon the pulling out resistant member 250 varies, it is possible for the pile head member 245 and the structure support member 246 to undergo mutual relative displacement without any problem being caused. Due to this, it is possible to obtain the same operation and benefits as in the case of the other embodiments and variants which have been described above.

Furthermore although, with the third embodiment described above, for the first contacting surface 220 the curvature of the concave surface 210 and the curvature of the outer surface 209 of the spherical seat 208 were made to agree, this is not to be considered as being limitative of the present invention; it would also be possible, as an alternative, for the curvature of the concave surface 210 to be made somewhat weaker as compared with the curvature of the outer surface 209 of the spherical seat 208. Furthermore, although for the second contacting surface 221 the curvature of the upper surface 217*a* of the head portion 217 of the pulling out resistant member 207 and the curvature of the inner surface 212 of the spherical seat 208 were made to agree, this is not to be considered as being limitative either. It would also be possible, as an alternative, for the curvature of the upper surface 217*a* of the head portion 217 of the pulling out resistant member 207 to be made somewhat weaker as compared with the curvature of the inner surface 212 of the spherical seat 208.

Yet further, although this stress transmission device 204 according to the third embodiment of the present invention has been described in terms of its application to a building 201, this should not be considered as being limitative of the present invention; this stress transmission device 204 could also be applied to a civil engineering structure or the like, or to any structure which includes a foundation pile 202 upon an upper structural portion 203.

Yet still further, in another connection, it would also be possible to implement the present invention with a different structure, as long as there were no departure from the gist of the present invention; and it is unnecessary to say that it would also be acceptable to utilize the above described variant examples according to a suitable selection and arrangement thereof.

The Fourth Preferred Embodiment

Next, a fourth preferred embodiment of the present invention will be explained.

Figure 38:
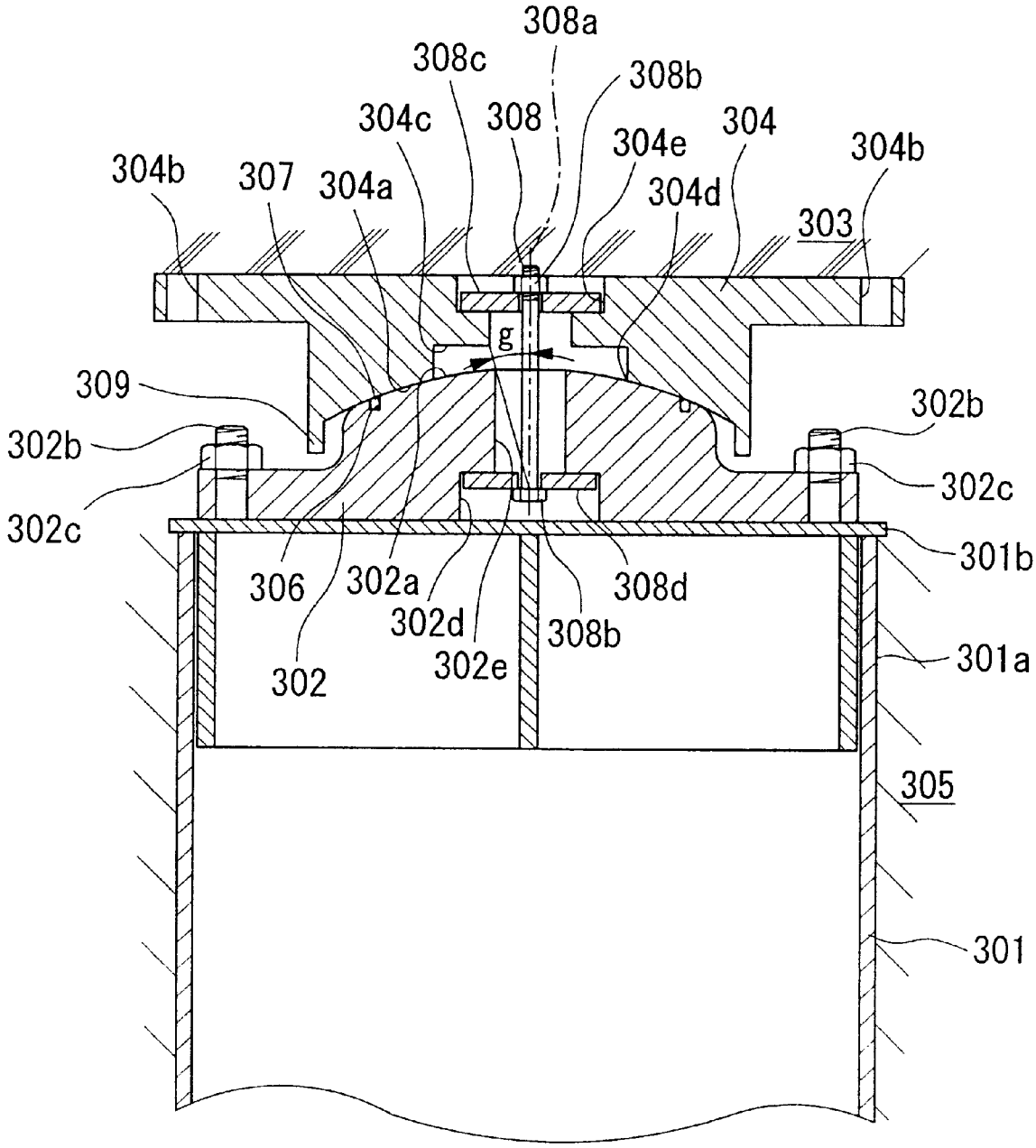
FIG. 38 is a sectional figure showing in schematic form a stress transmission device according to a fourth preferred embodiment of the present invention.

FIG. 38 is a sectional figure showing an example of this fourth preferred embodiment.

Referring to FIG. 38, the reference numeral 301 denotes a foundation pile which is set into a ground slab 305. This foundation pile 301 may be made from steel tube or ductile cast iron tube or the like. A cover body 301*b* is fitted upon the head portion 301*a* of the foundation pile 301, and upon this cover body 301*b* a pile head member 302, which has a convex spherical surface 302*a* and for example may be made from cast iron, is fixed so that its convex spherical surface 302*a* is uppermost.

This pile head member 302 is fixed to the cover body 301*b* by screwing nuts 302*c* onto bolts 302*b* which are provided as projecting upwards from the cover body 301*b*.

The reference numeral 303 denotes an upper structural portion, which may for example be a foundation portion of a building or the like, and to the under surface of this upper structural portion foundation 303 there is provided a structure support member 304, which lies upon the same axis as the pile head member 302, and may for example be made from cast iron, and the underside of which furthermore is formed with a concave spherical surface 304*a* which mates with the convex spherical surface 302*a* of the pile head member 302.

It should be understood that the radiuses of curvature of the convex spherical surface 302*a* and the concave spherical surface 304*a* may be approximately equal, or alternatively the radius of curvature of the convex spherical surface 302*a* may be made to be somewhat smaller than the radius of curvature of the concave spherical surface 304*a*.

And a cutaway portion 304*c* which extends around the common normal with the pile head member 302 as a central axis is formed upon the concave spherical surface 304*a* of the structure support member 304, and the structure support member 304 contacts against the convex spherical surface 302*a* at the circumferential edge portion 304*d* of this cutaway portion 304*c*.

The contact area of the portions near the horizontal of the two spherical surfaces 302*a* and 304*a* are reduced by the provision of this cutaway portion 304*c*, and thereby the frictional resistance between these contacting spherical surfaces while horizontal force is being transmitted is reduced, and, when during an earthquake or the like bending force acts upon the pile, only a small bending moment is imposed upon the pile head portion, by comparison with the strength of the pile.

Further, a stopper pin 308 extends along the common axial line 308*a* of both the spherical surfaces 302*a* and 304*a*, and washer plates 308*c* and 308*d* are fitted onto the ends of this stopper pin 308 and fixed thereon by nuts 308*b*, and are received in a reception portion 304*e* which is formed in the upper surface of the cutaway portion 304*c* and in a reception portion 302*d* which is formed upon the lower surface of the pile head member 302.

When a force in the upwards and downwards direction is imposed upon this stopper pin 308 by an earthquake or the like because it ties together the pile head member 302 and the structure support member 304 so as not to allow them to come away from one another, in order for it not to break even during a strong earthquake, a pre-stressed bolt is used which is made from high resistance metal.

Further, the through hole 302*e* for the stopper pin 308 through the pile head member 302 is, as shown in the figure, made to be greater in diameter than the stopper pin 308, and, as shown by the single-dotted line, even when the maximum relative rotational angle g is present between these two members, the stopper pin 308 does not come into contact with the inside of the through hole 302*e*.

And an annular shaped groove 306 is formed around the circumferential edge of the spherical surface of the pile head member 302, and a seal 307 is fitted into this annular shaped groove 306, with the mutually contacting spherical surfaces 302*a* and 304*a* and the stopper pin 308, the cutaway portion 304*c*, and the through hole 302*e* etc. being sealed off from the outside by this seal 307.

As material for the above described seal 307, there may be used a composite rubber material which excels in durability, such as chloroprene rubber, acrylic rubber, acrylonitrile-butadiene rubber, silicone rubber or the like.

Since it will be sufficient if the frictional resistance between the above described superimposed spherical surfaces, that is to say between the spherical surface 302*a* of the pile head member 302 and the spherical surface 304*a* of the structure support member 304, is made to be such that mutual sliding movement starts with a moment which is quite small as compared to the proof stress of the pile, therefore it will also be acceptable for the contact area between the two of them to be reduced, in a manner which differs from the construction described previously, by leaving them as rough surfaces just as they are released from the casting molds (supposing that the convex spherical surface 302*a* and the concave spherical surface 304*a* are made from cast iron), or by roughening the surfaces of both of the convex spherical surface 302*a* and the concave spherical surface 304*a* by blasting them with steel shot, or by roughening them by beating them with a peening hammer or the like.

Figure 39A:
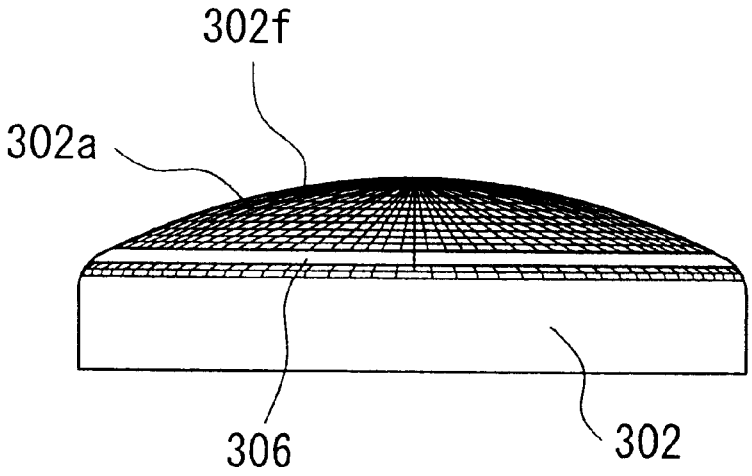
FIG. 39A is an elevation view of a convex spherical surface which shows an example of a structure for reducing the frictional resistance between the spherical surfaces, for the fourth preferred embodiment of the present invention.
Figure 39B:
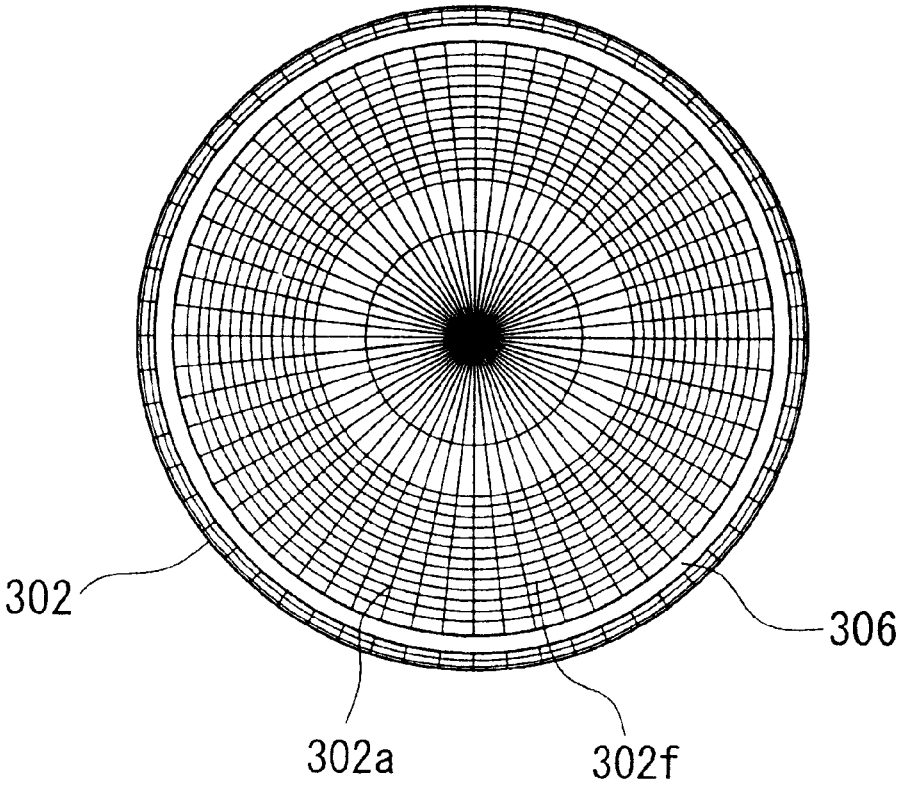
FIG. 39B is an plan view of this convex spherical surface which shows this example of the structure for reducing the frictional resistance between the spherical surfaces, for the fourth preferred embodiment of the present invention.

Further, it would also be acceptable, as shown in FIG. 39A and FIG. 39B, for minute grooves 302*f* arranged in the form of a radiant lattice to be formed upon the surfaces of the convex spherical surface 302*a* and the concave spherical surface (not shown in these figures), and for the frictional resistance to be reduced by reduction of the contact area between these two members.

Furthermore, as shown in FIG. 38, it is desirable to provide a circumferential wall 309 which, if it is attempted to mutually rotate the structure support member 304 and the pile head member 302 through a rotational angle greater than the maximum rotational angle g which it is anticipated by planning may occur, restricts the relative movement of these two members, so that the safety of the building may be assured.

It should be understood that the reference numerals 304*b* in FIG. 38 denote fixing holes for the upper structural portion 303.

Figure 40:
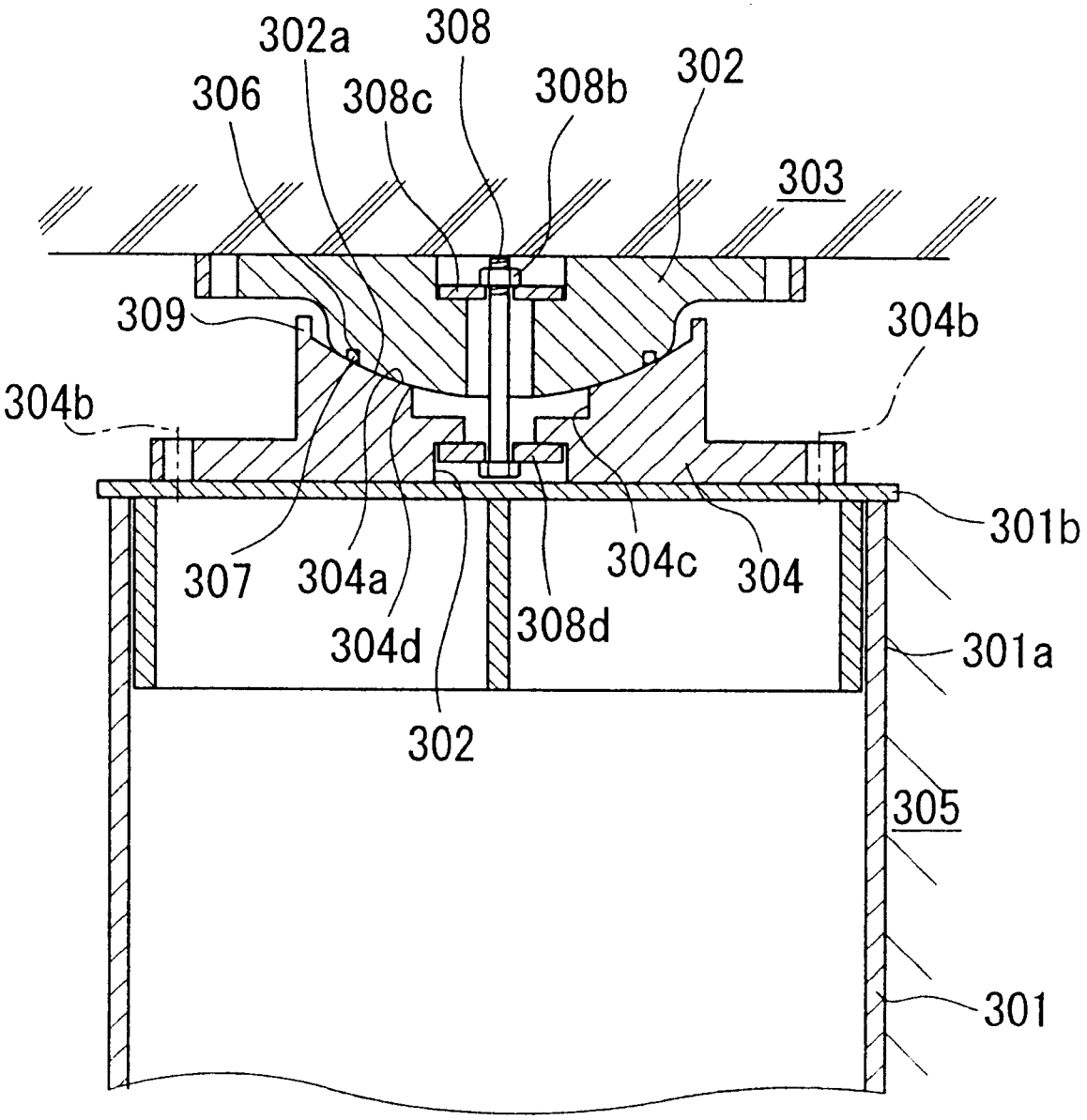
FIG. 40 is an enlarged sectional figure showing essential portions of another constructional example of the fourth preferred embodiment of the present invention.

Although in the above described embodiment the convex spherical surface was formed upon the pile head member 302 and the concave spherical surface was formed upon the structure support member 304, this is not to be considered as being limitative of the present invention; alternatively, in the opposite arrangement, it would also be possible, as shown in FIG. 40, for the concave spherical surface to be formed upon the pile head member 302, and the convex spherical surface to be formed upon the structure support member 304.

It should be understood that the reference numeral 309 in FIG. 40 denotes a circumferential wall, and this wall is provided for restricting relative movement between the pile head member 302 and the structure support member 304 greater than is anticipated, thus performing the same function as the circumferential wall 309 shown in FIG. 38.

In FIG. 40, members which correspond to members shown in FIG. 38 and which have the same functions are denoted by the same reference symbols, and detailed explanation thereof will be curtailed in the interests of brevity of description.

Next, the operation of the stress transmission device according to this embodiment will be explained, based upon FIG. 41.

Figure 41:
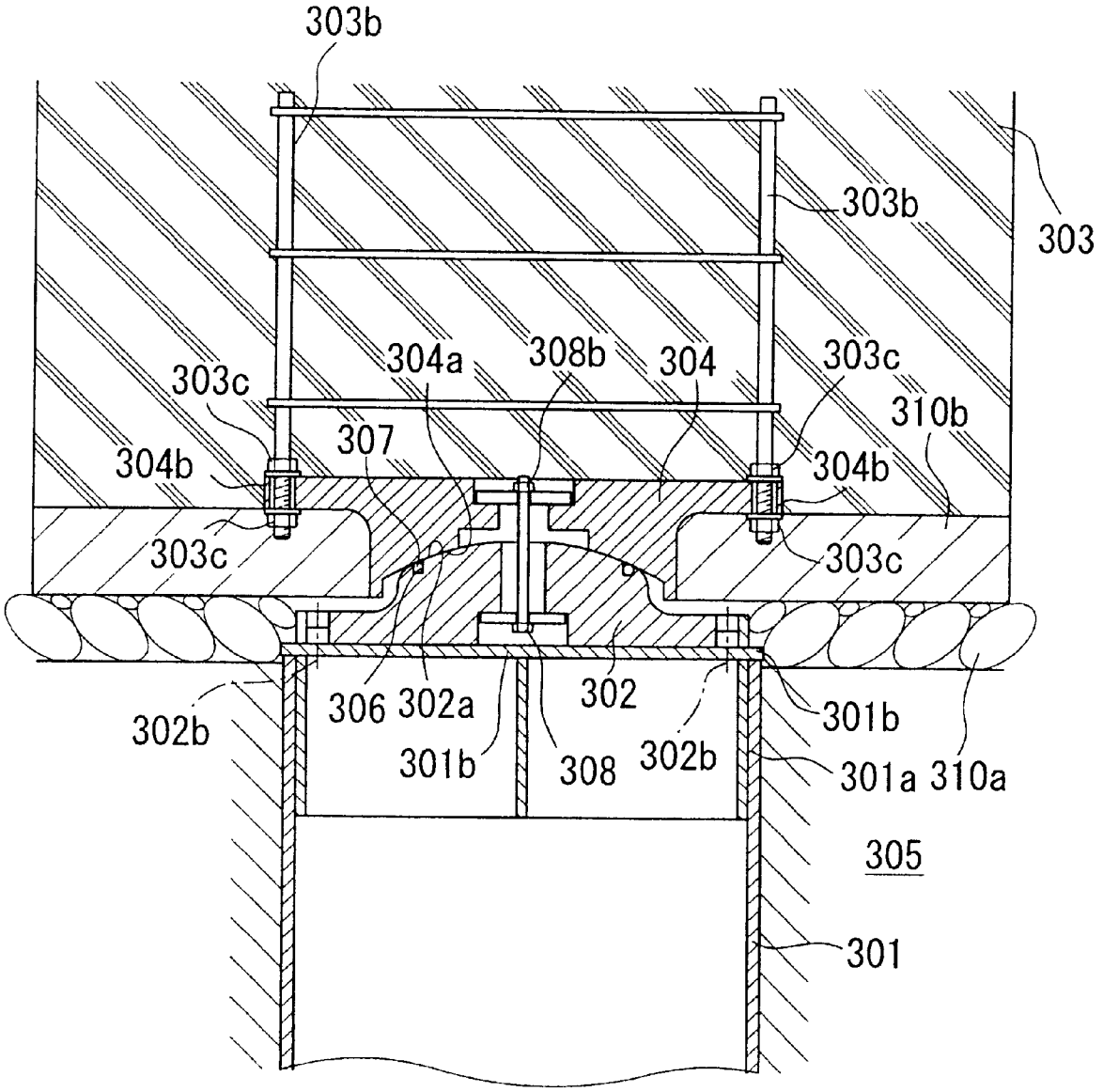
FIG. 41 is a sectional figure showing a situation during assembly of the fourth preferred embodiment of the present invention.

The pile head member 302 is attached by connecting members 302*b*, as shown in FIG. 41, via a cover member 301*b* to a pile head 301*a* of a foundation pile 301, which is made from steel tube or ductile cast iron pipe or the like, and which is embedded in a hard ground slab or in a support ground slab which provides an equally strong support force.

Moreover, the seal 307 is fitted in advance into the annular shaped groove 306 in the pile head member 302, and furthermore the structure support member 304 is set into place above them, and these two members are held together by the stopper pin 308. By doing this, the seal 307 is compressed and forms a seal against the outside between the two contacting spherical surfaces 302*a* and 304*a*.

And pebbles 310*a* are laid around the pile head member 302, and furthermore concrete 310*b* may be poured around the structure support member 304 for leveling it, according to requirements.

By the way, threaded iron bars 303*b* for the upper structural portion 303 are fixed by tightening members such as nuts 303*c* or the like to fixing apertures 304*b* in the structure support member 304, and thereby the upper structural portion 303 is constructed.

After manufacturing the upper structural portion as described above, the ingress of ground water or earth or sand or the like between the spherical surfaces 302*a* and 304*a* is prevented by the seal 307, and thereby corrosion or the like of the contacting regions due to the entry of water is reliably prevented, and undesirable variation of the frictional resistance between the contacting surfaces of the spherical surfaces 302*a* and 304*a* is prevented.

Accordingly when, during a large scale earthquake or the like, bending moment acts upon the pile head, and this bending moment exceeds the maximum bending moment which can be sustained by the friction that is present between the convex spherical surface 302*a* of the pile head member 302 and the concave spherical surface 304*a* of the structure support member 304, then relative movement takes place due to slippage between these two spherical surfaces, and the bending force that is imposed upon the pile is reduced, so that breakage of the pile by the bending force is prevented.

Moreover, if the amplitude of the earthquake is great and the mutual displacement of the two spherical surfaces is large, and the relative movement beyond expectations exceeds the maximum rotational angle which was anticipated in the planning stage, then the circumferential wall 309 acts as a stopper to the pile head member 302 and prevents further relative slippage, so that the safety of the building as a whole is assured.

Since as has been explained above, according to the stress transmission device of this embodiment, the contacting faces of the two mutually contacting spherical surfaces are protected from the outside by the seal 307, therefore the invasion of ground water or earth or sand is prevented. Accordingly, the surface condition of the spherical surfaces 302*a* and 304*a* which are in frictional contact is protected, and the earthquake proof performance is maintained, over a long period of time.

Next, another example of the fourth preferred embodiment of the present invention will be described.

Figure 42:
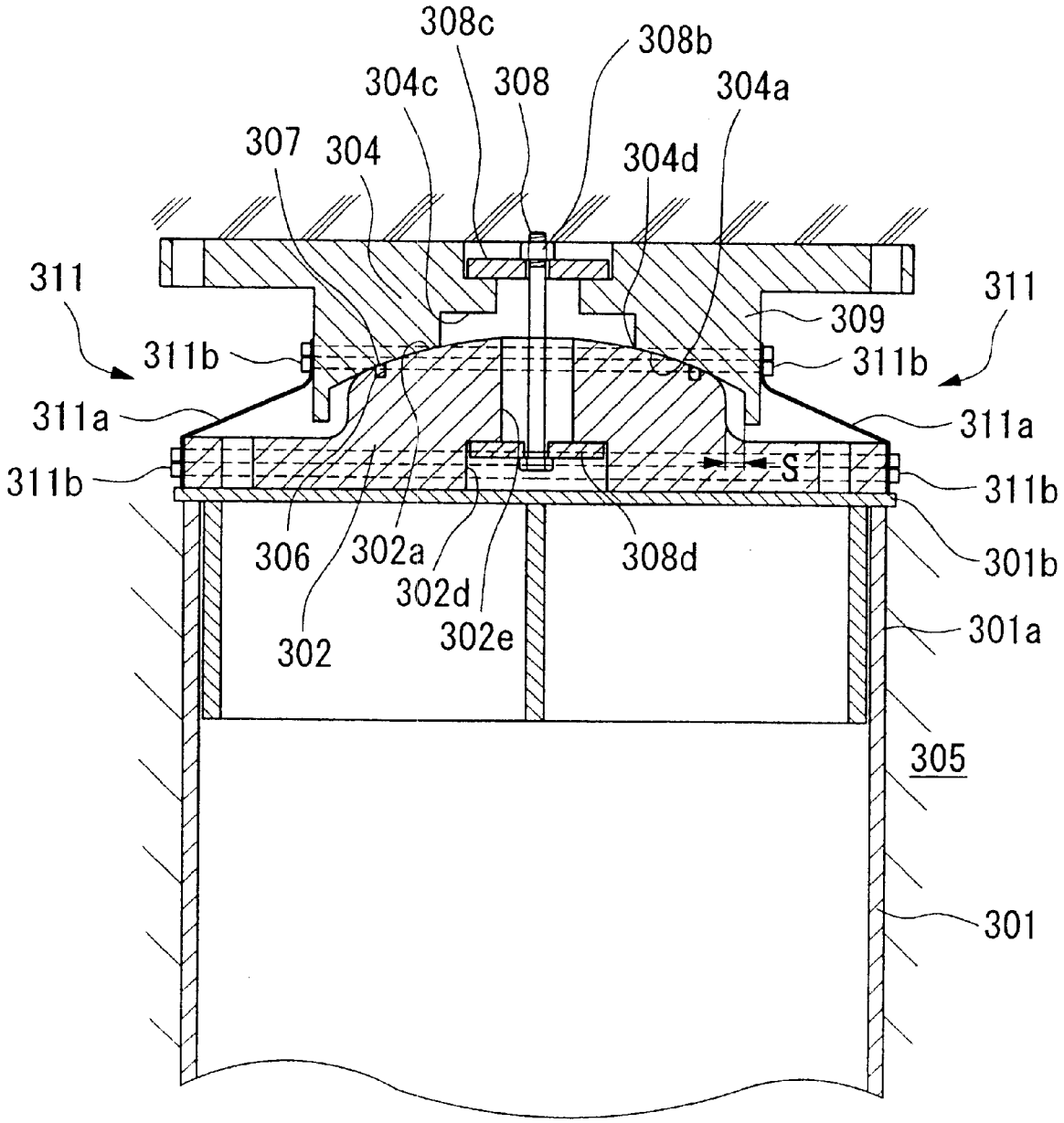
FIG. 42 is an enlarged sectional figure showing essential portions of a stress transmission device which is yet another constructional example of the fourth preferred embodiment of the present invention.

In this example of the stress transmission device, as shown in FIG. 42, a seal member 311 is provided so as to cover over between the outside surfaces of the mutually superimposed spherical surfaces, in other words between the outside surfaces of the spherical surface 302*a* of the pile head member 302 and of the spherical surface 304*a* of the structure support member 304. It should be noted that the iron bars and so on of the upper structural portion 303 have been omitted from this figure.

The seal member 311 of FIG. 42 is formed in a generally conical shape the diameter of which expands in the downward direction as shown in the figure, and its upper end is fitted around the outer circumference of the structure support member 304 while its lower end is fitted around the outer circumference of the pile head member 302, so that it functions as an engageable cover 311*a*.

The cover 311*a* may be made from an elastic material such as a composite rubber which excels in durability, such as chloroprene rubber, acrylic rubber, acrylonitrile-butadiene rubber or the like; but, since it will suffice if this seal member 311 is excellent for protecting the contact regions of the two spherical surfaces from the outside, it is also possible to wrap a plastic film or sheet for keeping out water, such as for example a polyethylene sleeve or the like, or a seal member made from waterproof canvas or the like, around from the outer circumference of the structure support member 304 to the outer circumference of the pile head member 302, and to attach it with rubber bands or fixing bands, or to fix it by wrapping it around with fixing members such as the fixing bands 311*b*, 311*b* used for packing, which are provided with a fixing mechanism which does not come loose when once it has been fixed.

It should be noted that, in this example, members which correspond to members shown in FIGS. 38 through 41 and which have the same functions are denoted by the same reference symbols, and detailed explanation thereof will be curtailed in the interests of brevity of description.

Figure 43:
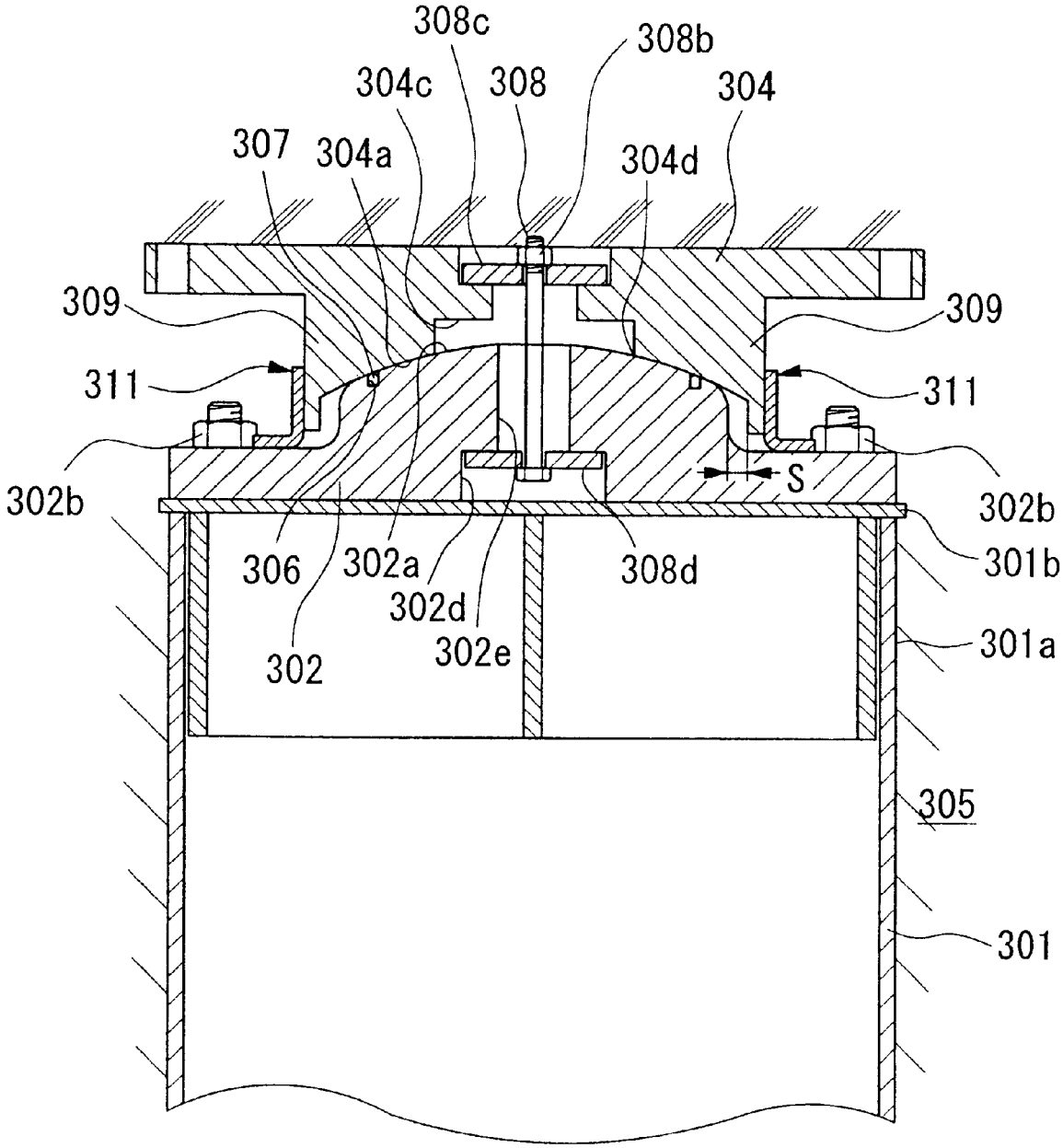
FIG. 43 is an enlarged sectional figure showing essential portions of a stress transmission device which is still yet another constructional example of the fourth preferred embodiment of the present invention.

Further, as shown in FIG. 43, the seal member 311 may be a cylindrical tube member made from an elastic material such as chloroprene rubber, butyl rubber, or the like. With the seal member 411 shown in this figure, its upper end is secured around the outer circumference of the structure support member 304, while its lower end is deformed by being radially expanded into a flange shape which is pressed into contact with the upper surface of the pile head member 302, thus preventing the invasion of water.

Moreover it should be noted that, in FIG. 43 as well, members which correspond to members shown in FIGS. 38 through 41 and which have the same functions are denoted by the same reference symbols, and detailed explanation thereof will be curtailed in the interests of brevity of description.

By this type of construction, the mutually contacting spherical surfaces 302*a* and 304*a* are sealed by the cylindrical pipe shaped seal member 311, and thereby it is possible reliably to prevent the concrete which is being poured from getting in between them, and to withstand the invasion of ground water or earth or sand etc.

Figure 44:
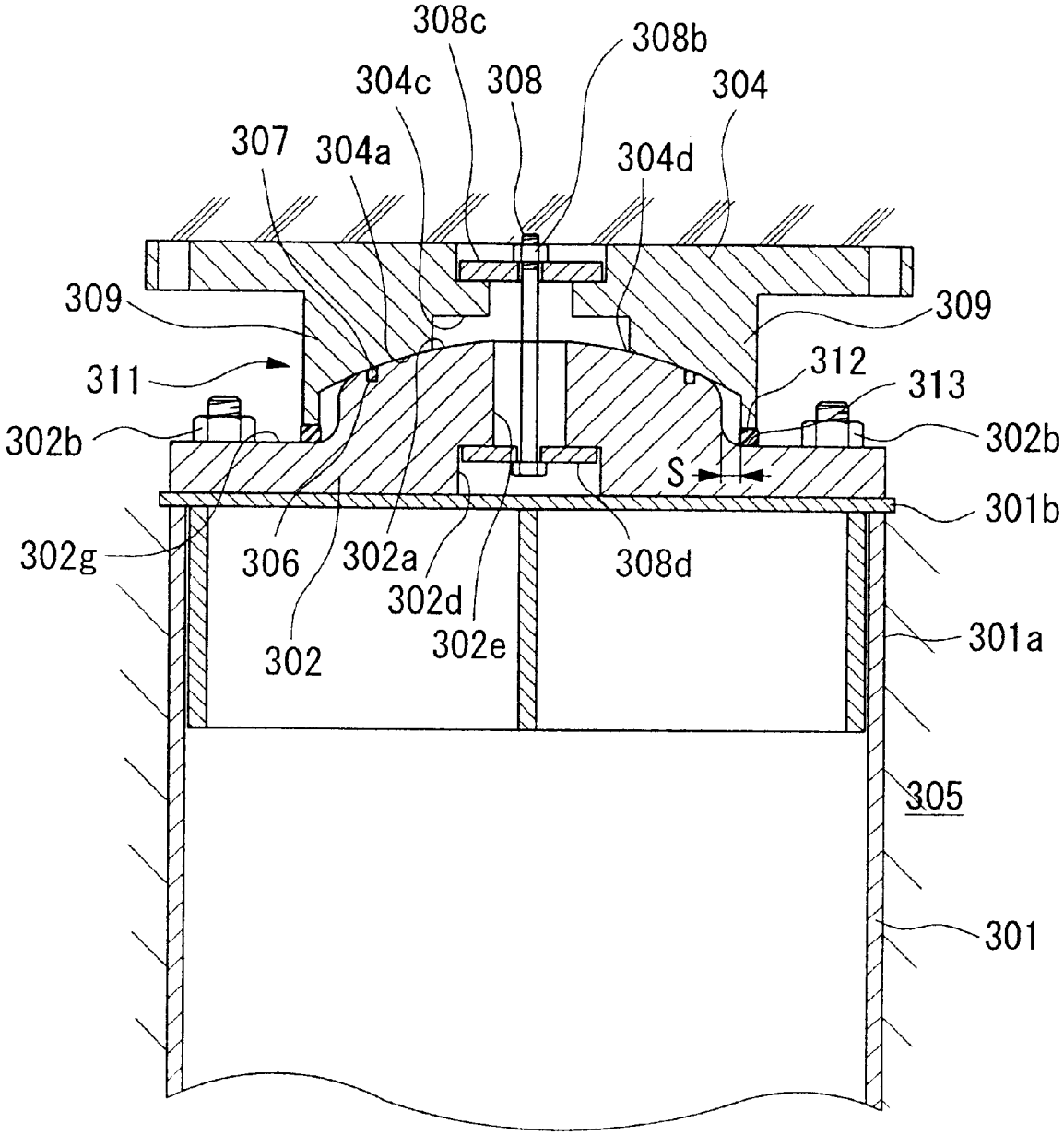
FIG. 44 is an enlarged sectional figure showing essential portions of a stress transmission device which is still a further constructional example of the fourth preferred embodiment of the present invention.

FIG. 44 shows another constructional example of the fourth preferred embodiment of the present invention. In this example, a seal gasket 312 is inserted and pressed between the upper surface of a base plate portion 302*g* of the pile head member 302 and the outer circumferential edge 309 of the structure support member 304. By this construction, the mutually superimposed spherical surfaces 302*a* and 304*a* are protected from the outside.

The above described sealing gasket 312 is made from an elastic material such as a composite rubber which exhibits outstanding durability such as chloroprene rubber, acrylic rubber, acrylonitrile-butadiene rubber or the like, or from a silicon rubber system, and it is received within an annular shaped groove 313 which is provided in the surface of the base plate 302*g* of the pile head member 302.

It should be noted that, in FIG. 44 just as in FIG. 42, members which correspond to members shown in FIGS. 38 through 41 and which have the same functions are denoted by the same reference symbols, and detailed explanation thereof will be curtailed in the interests of brevity of description.

Next, the operation of the stress transmission devices of FIGS. 43 and 44 will be explained.

First, after being inserted through the seal 307, the structure support member 304 is linked to the pile head member 302 by the stopper pin 308, and the seal member 311 (312) is fixed upon its outer circumference.

Accordingly, the mutually contacting spherical surfaces 302*a* and 304*a* which are sealed in by the seal 307 are further protected around their outside circumferences by the seal member 311 (312), and it is prevented that dust and dirt or earth or sand or the like should get in from the outside during storage after despatch of the goods from the factory, or during transport to the construction site.

And, in the same manner as with the examples described above, th pile head member 302 is attached to the embedded foundation pile 301, and, in its state with the seal member 311 (312) fitted, the upper structural portion 303 is constructed upon the structure support member 304.

Accordingly, since concrete poured into the foundation during construction or returned earth is intercepted by the seal member 311, thereby the invasion of foreign bodies between the pile head member 302 and the structure support member 304 is reliably prevented.

It should be understood that the seal 307 and the seal member 311 (312) of this fourth preferred embodiment could also be utilized in the stress transmission devices according to the first through the third preferred embodiments which were described above.

The Fifth Preferred Embodiment

Next, a fifth preferred embodiment of the present invention will be described with reference to the figures.

Figure 45:
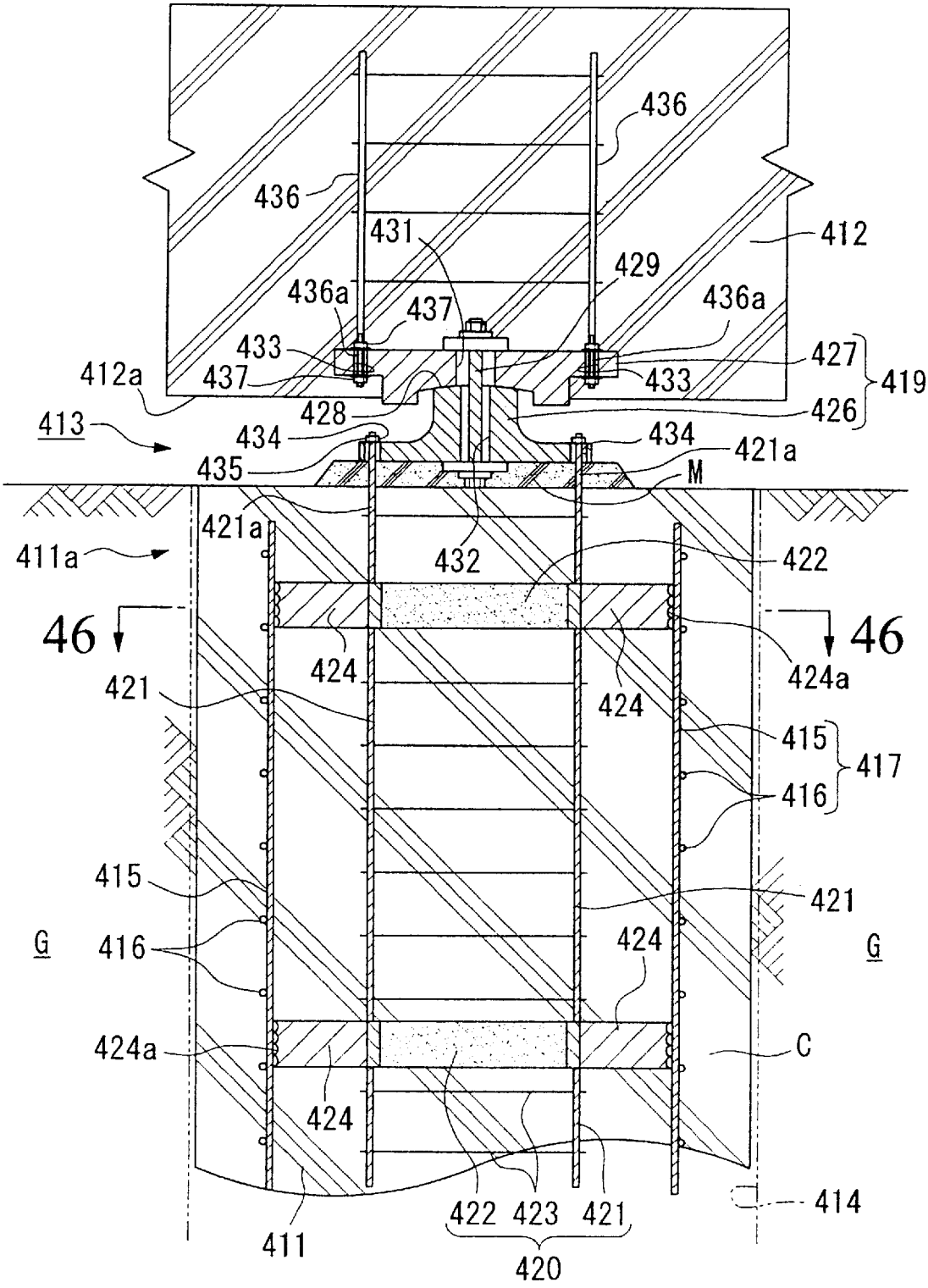
FIG. 45 is a vertical sectional figure showing in schematic form a pile and footing connecting structure of a fifth preferred embodiment of the present invention.
Figure 46:
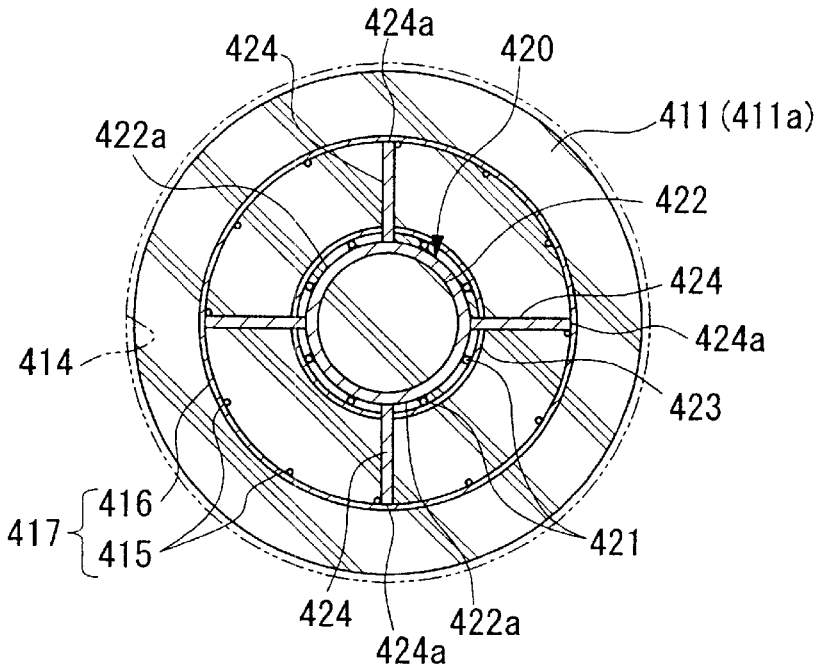
FIG. 46 is a sectional view of the structure of FIG. 45 as seen in the direction of the arrows 46—46.

FIG. 45 is a vertical sectional view showing the main portions of a structure 413 which is an example of the fifth preferred embodiment of the present invention, and FIG. 46 is a sectional view taken in a plane shown by the arrows I—I in FIG. 45. This structure 413 comprises a footing 412 of an upper structural portion which is supported upon a pile 411.

Here, the pile 411 is a cast-in-place concrete pile. And the pile 411 is formed by setting, into the interior of a dug out hole 414 which has been excavated in a ground slab G, a basket or cage of cylindrical tubular shape which is made up from iron bars arranged as main pile reinforcement members 415 and hoop reinforcement members 416, and by then pouring concrete C into the interior of the dug out hole 414. Further, the structure 413 is constituted by the footing 412 of the upper structural portion being connected via a stress transmission device 419 upon the pile head 411*a* of the pile 411.

Figure 47:
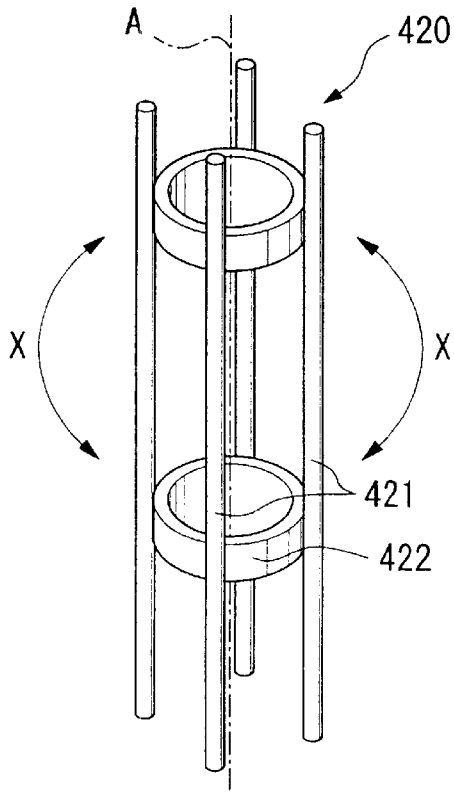
FIG. 47 is an perspective figure showing, in enlarged view, an iron bar cage for anchoring included in the structure shown in FIG. 45.

In this structure 413, in the interior of the iron bar cage 417 which is comprised in the pile 411, there is embedded an iron bar cage or basket 420 for anchoring of generally cylindrical tubular shape, whose diameter is smaller than that of the iron bar cage 417. This iron bar cage 420 for anchoring comprises anchoring reinforcement members 421, ring members 422, and hoop reinforcement members for anchoring 423. Among these, the anchoring reinforcement members 421, as shown in FIG. 47, are arranged to lie parallel to the central axial line A of the ring member 422. And the ring members 422 are arranged to extend around the circumferential direction (the x direction) of the iron bar cage 420 for anchoring, and link together neighboring ones of the anchoring reinforcement members 421. It should be understood that some of the anchoring reinforcement members 421 and some of the hoop reinforcement members for anchoring 423 have been omitted from FIG. 47.

Further, in the iron bar cage 420 for anchoring, as shown in FIG. 420, the upper end portions 421*a* of the anchoring reinforcement members 421 are arranged so as to project higher than the pile head 411*a*, and they moreover are linked to the iron bar cage 417 via tie plates 424 (position maintaining members). These tie plates 424, as shown in FIG. 46, are provided between the iron bar cage 417 and the ring members 422 in positions which are symmetrical with respect to the central axis of the iron bar cage 417.

The tie plates 424 are arranged so as to extend from the outer peripheral surfaces 422*a* of the ring members 422 outwards in the radial direction of the ring members 422. And, furthermore, the end portions 424*a* of the tie plates 424 at their ends remote from the ring members 422 are welded to the main pile reinforcement members 415 and the hoop reinforcement members 416.

The stress transmission device 419, as shown in FIG. 45, comprises a lower device portion 426 which is fixed to the pile head 411*a* and an upper device portion 427 which is fixed to the footing 412. This lower device portion 426 and upper device portion 427 mutually contact one another in the upwards and downwards direction at a contacting surface 428 which is formed as a spherical surface, and are mutually secured to one another by a high strength hexagonal bolt 429. Further, respective through holes 431 and 432 are formed in the upper device portion 427 and the lower device portion 426, through which the high strength hexagonal bolt 429 is passed, and these through holes 431 and 432 are formed so as to have greater internal diameter than the outer diameter of the high strength hexagonal bolt 429, and due to this the high strength hexagonal bolt 429 still allows relative displacement to take place between the upper device portion 427 and the lower device portion 426.

As shown in FIG. 45, respective bolt holes 433 and 434 are provided in the upper device portion 427 and the lower device portion 426, and the upper ends 421*a* of the anchoring reinforcement members 421 are passed through the bolt holes 434 and are fixed to the lower device portion 426 by nuts 435. And the lower end portions 436*a* of anchoring iron bars 436 for holding the footing, which are embedded in the footing 412, are passed through the bolt holes 433 of the upper device portion 427. These lower end portions 436*a* of the anchoring iron bars 436 for holding the footing are arranged to project in the downwards direction from the lower surface 412*a* of the footing 412 with threads being cut upon them, and nuts 437 are screwed thereupon, whereby the upper device portion is secured to the footing 412.

Next, the method whereby this structure 413 is constructed will be explained.

First, along with forming the dug out hole 414 for setting the pile 411 in the ground slab G, the iron bar cage 417 is positioned within the dug out hole 414. Further, on the other hand, an iron bar cage 420 for anchoring like the one shown in FIG. 47 is manufactured in a workshop or the like. This iron bar cage 420 for anchoring is made by fixing the anchoring reinforcement members 421, 421, . . . to at least two of the ring members 422 in predetermined positions by flare welding.

Moreover, when manufacturing the iron bar cage 420 for anchoring in this manner, it should be checked whether or not all of the upper ends 421*a*, 421*a*, . . . of all of the anchoring reinforcement members 421, 421, . . . have been properly passed through the corresponding bolt holes 434 which are formed in the lower device portion 426 of the stress transmission device 419.

Next, along with transporting the iron bar cage 420 for anchoring which has been manufactured in this manner to the building site, the plurality of tie plates 424, 424, . . . are put in place against the outer circumferential faces 422*a* of the ring members 422, so as to extend outwards in the radial direction of the ring members 422, and moreover symmetrically with respect to the central axial line A of the ring members 422.

Further, the iron bar cage 420 for anchoring is now put, while in this state, into the iron bar cage 417. At this time, along with positioning the upper end portions 421*a* of the anchoring reinforcement members 421 so that they project in the upwards direction out of the dug out hole 414, the end portions 424*a* of the tie plates 424 are fixed to the iron bar cage 417. In this case, along with fixing the tie plates 424 to the upper sides or the lower sides of the hoop reinforcement members 416 which are comprised in the iron bar cage 417, they are flare welded to the main pile reinforcement members 415.

Next, using a tremie pipe, concrete C is poured into the interior of the dug out hole 414. After pouring the concrete C, grading off processing of the concrete C at the pile head 411*a* is performed, and furthermore the stress transmission device 419 is put in place upon the pile head 411*a*. Moreover, at this time, the upper end portions 421*a* of the anchoring reinforcement members 421 are cut off to the lengths which are appropriate for it to be possible properly to set the stress transmission device 419 into place.

Next, non-shrink mortar M is filled in between the lower device portion 426 and the pile head 411*a*, and by doing this the horizontality etc. of the stress transmission device 419 is adjusted. After the non-shrink mortar M has hardened, the anchoring reinforcement members 421 are fixed to the lower device portion 426. On the other hand, the lower end portions 436*a* of the anchoring iron bars 436 for holding the footing which have been threaded are inserted through the bolt holes 433 which are provided in the upper device portion 427, and the upper device portion 427 and the lower end portions 436*a* of the anchoring iron bars 436 for holding the footing are fixed together. And concrete C is poured into the position in which the footing 412 is to be provided so as to construct the footing 412, so that the structure shown in FIGS. 45 and 46 is obtained.

With the above described structure 413 and method of constructing it, since, along with setting the iron bar cage 420 for anchoring inside the iron bar cage 417 of the pile 411, this iron bar cage 420 for anchoring is fixed to the iron bar cage 417 via the tie plates 424, and furthermore the iron bar cage 420 for anchoring is embedded in the concrete C from which the pile 411 is made, thereby, during the manufacture of the pile 411, it is possible to set in place the iron bar cage 420 for anchoring at the same time as pouring the concrete C. By doing this it is possible to shorten the period of construction as compared with the prior art, and the efficiency of construction is enhanced. Further, since the iron bar cage 420 for anchoring is fixed to the iron bar cage 417, it is possible to ensure the strength of the anchoring against being pulled out, and it is possible to implement a connecting structure of very high strength.

With the above described structure 413 and method of constructing it, since the plurality of tie plates 424 of the same shape are fixed to the outer circumferential faces 422*a* of the ring members 422 in the iron bar cage 420 for anchoring, so that it is possible to perform determination of the position of the iron bar cage 424 for anchoring in the interior of the iron bar cage 417 by using these tie plates 424, thereby it is possible easily to set up the iron bar cage 420 for anchoring in the central portion of the pile 411, so that the accuracy of construction is high.

With the above described structure 413, since the upper device portion 427 of the stress transmission device 419 is fixed to the lower end portions 436*a* of the anchoring iron bars 436 for holding the footing which are embedded in the footing 412, thereby it is possible to fix the stress transmission device 419 very strongly to the footing 412, and by doing this it is possible to ensure the resistance of the structure 413 against bending stress, and it is possible to enhance its reliability.

It should be understood that, with the above embodiment, it would also be possible to utilize other constructions, while remaining within the scope of the present invention and not deviating from its gist.

For example, the stress transmission device 419 is not to be considered as being limited to the ones described above; it would be possible to use any alternative construction for it, provided that it were one which is capable of transmitting stress between the pile 411 and the footing 412. Accordingly, it would be possible to use any of the stress transmission devices of the first through the fourth preferred embodiments shown and described above, as the stress transmission device 419.

What is claimed is:

1. A stress transmission device, comprising a pile head member which is set upon a pile head of a foundation pile, and a structure support member which is fixed to an upper structural portion and is arranged to face said pile head member; wherein:

said pile head member and said structure support member mutually contact one another in the vertical direction via a first contacting surface which defines a portion of a first imaginary spherical surface;

a tension member is fitted to said pile head member and said structure support member for holding them together in contact while pressing them together via said first contacting surface;

one of said pile head member and said structure support member is provided with a spherical seat and a concave surface is formed upon the other, and said first contacting surface is constituted by mutually contacting together the outer surface of said spherical seat and said concave surface;

the outer surface of said spherical seat is formed so as to define the same surface as said first imaginary spherical surface;

a through hole is formed in said concave surface for passing through said tension member, and an aperture portion is formed in a position of said spherical seat which opposes said through hole; and along with said tension member being arranged so as to pass through said through hole and said aperture portion, both its ends are respectively engaged to said pile head member and said structure support member by engagement members.

2. A stress transmission device according to claim 1, wherein said tension member is arranged so that its central axis lies along the vertical axis which passes through the center of curvature of said spherical seat.

3. A stress transmission device according to claim 1, wherein one of said engagement members which are provided at both the ends of said tension member contacts said pile head member or said structure support member via a second contacting surface which defines a portion of a second imaginary spherical surface, and the centers of curvature of said first and said second imaginary spherical surfaces coincide.

4. A stress transmission device according to claim 1, wherein:

the diameter of a one of said through hole and said aperture portion at said first contact surface is greater than that of the other; and the radial dimensions of said through hole and said aperture portion are determined so that, when said pile head member and said structure support member are relatively displaced through the maximum rotational angle which is anticipated to take place between said foundation pile and said upper structural portion, at said first contacting surface, said other of said through hole and said aperture portion is positioned in the interior of said one.

5. A stress transmission device according to claim 1, wherein the radial dimensions of said through hole and said aperture portion are determined so that their inner circumferential surfaces are positioned outside the range in which said tension member is positioned, when said pile head member and said structure support member are relatively displaced through the maximum rotational angle which is anticipated to take place between said foundation pile and said upper structural portion.

6. A structure, comprising a foundation pile, an upper structural portion which is supported by said foundation pile, and, between said foundation pile and said upper structural portion, a stress transmission device for transmitting stress therebetween, comprising a pile head member which is set upon a pile head of said foundation pile, and a structure support member which is fixed to said upper structural portion and is arranged to face said pile head member; wherein:

said pile head member and said structure support member mutually contact one another in the vertical direction via a first contacting surface which defines a portion of a first imaginary spherical surface;

a tension member is fitted to said pile head member and said structure support member for holding them together in contact while pressing them together via said first contacting surfaces;

one of said pile head member and said structure support member is provided with a spherical seat and a concave surface is formed upon the other, and said first contacting surface is constituted by mutually contacting together the outer surface of said spherical seat and said concave surface;

the outer surface of said spherical seat is formed so as to define the same surface as said first imaginary spherical surface;

a through hole is formed in said concave surface for passing through said tension member, and an aperture portion is formed in a position of said spherical seat which opposes said through hole; and along with said tension member being arranged so as to pass through said through hole and said aperture portion, both its ends are respectively engaged to said pile head member and said structure support member by engagement members.

7. A structure according to claim 6, wherein said tension member is arranged so that its central axis lies along the vertical axis which passes through the center of curvature of said spherical seat.

8. A structure according to claim 6, wherein one of said engagement members which are provided at both the ends of said tension member contacts said pile head member or said structure support member via a second contacting surface which defines a portion of a second imaginary spherical surface, and the centers of curvature of said first and said second imaginary spherical surfaces coincide.

9. A structure according to claim 6, wherein:

the diameter of a one of said through hole and said aperture portion at said first contact surface is greater than that of the other; and the radial dimensions of said through hole and said aperture portion are determined so that, when said pile head member and said structure support member are relatively displaced through the maximum rotational angle which is anticipated to take place between said foundation pile and said upper structural portion, at said first contacting surface, said other of said through hole and said aperture portion is positioned in the interior of said one.

10. A structure according to claim 6, wherein the radial dimensions of said through hole and said aperture portion are determined so that their inner circumferential surfaces are positioned outside the range in which said tension member is positioned, when said pile head member and said structure support member are relatively displaced through the maximum rotational angle which is anticipated to take place between said foundation pile and said upper structural portion.

* * * * *